US005096805A

United States Patent [19]

Aoki et al.

[11] Patent Number: 5,096,805

[45] Date of Patent: * Mar. 17, 1992

[54] SILVER HALIDE COLOR PHOTOGRAPHIC MATERIAL CONTAINING 5-PYRAZOLONE MAGENTA COUPLER AND AMINE-TYPE STAIN PREVENTING AGENT

[75] Inventors: Kozo Aoki; Masakazu Morigaki, both of Ashigara, Japan

[73] Assignee: Fuji Photo Film Co., Ltd., Kanagawa, Japan

[ * ] Notice: The portion of the term of this patent subsequent to Feb. 19, 2008 has been disclaimed.

[21] Appl. No.: 683,503

[22] Filed: Apr. 5, 1991

Related U.S. Application Data

[63] Continuation of Ser. No. 382,389, Jul. 20, 1989, abandoned.

[30] Foreign Application Priority Data

Jul. 25, 1988 [JP] Japan ..... 63-185203

[51] Int. Cl.[5] ..... G03C 1/34; G03C 7/384

[52] U.S. Cl. ..... 430/551; 430/555; 430/607; 430/613

[58] Field of Search ..... 430/607, 663, 555, 551, 430/387, 958, 955

[56] References Cited

U.S. PATENT DOCUMENTS

| | | | |
|---|---|---|---|
| 4,483,919 | 11/1984 | Kobayashi et al. | 430/566 |
| 4,555,479 | 11/1985 | Sakai et al. | 430/372 |
| 4,585,728 | 4/1986 | Furutachi et al. | 430/372 |
| 4,704,350 | 11/1987 | Morigaki et al. | 430/546 |
| 4,741,994 | 5/1988 | Ichijima et al. | 430/549 |
| 4,770,987 | 9/1988 | Takahashi et al. | 430/546 |
| 4,842,985 | 7/1989 | Ono et al. | 430/226 |
| 4,842,994 | 7/1989 | Sakanoue et al. | 430/543 |
| 4,853,319 | 8/1989 | Krishnamurthy et al. | 430/387 |
| 4,876,182 | 10/1989 | Buckland | 430/555 |
| 4,929,540 | 5/1990 | Furutachi et al. | 430/555 |
| 4,994,359 | 2/1991 | Morigaki et al. | 430/555 |

FOREIGN PATENT DOCUMENTS

| | | | |
|---|---|---|---|
| 0230048 | 3/1986 | European Pat. Off. . | |
| 0255722 | 1/1987 | European Pat. Off. . | |
| 0256722 | 11/1987 | European Pat. Off. . | |
| 0258662 | 3/1988 | European Pat. Off. . | |
| 58-102231 | 6/1983 | Japan . | |
| 0194452 | 10/1985 | Japan | 430/555 |

*Primary Examiner*—Charles L. Bowers, Jr.
*Assistant Examiner*—Lee C. Wright
*Attorney, Agent, or Firm*—Birch, Stewart, Kolasch & Birch

[57] ABSTRACT

A silver halide color photographic material containing at least one silver halide emulsion and at least one kind of 5-pyrazolone couplers having the releasable group shown by following formula (I) at the coupling position and at least one kind of the compounds shown by following formula (II):

(I)

wherein $L_1$ and $L_2$ each represents a methylene group or an ethylene group; l and m each represents 0 or 1; $R_1$ represents a hydrogen atom, an alkyl group, an aryl group, or a heterocyclic group; $R_2$ represents a group bonded to A by a carbon atom, an oxygen atom, a nitrogen atom or a sulfur atom; A represents a carbon atom or a sulfur atom; n represents 1 when A is a carbon atom, or 1 or 2 when A is a sulfur atom; B represents a carbon atom, an oxygen atom, a nitrogen atom, or a sulfur atom; and X represents an atomic group necessary for forming a ring; said $R_1$ and $R_2$ may combine with each other to form a ring; and when B is a carbon atom or a nitrogen atom, said B and $R_2$ may combine with each other to form a ring;

(II)

wherein $R_{21}$ represents a hydrogen atom, a hydroxy group, or a substituted or unsubstituted alkyl, alkenyl, alkoxy, acyl, aryloxy, heterocyclic oxy or acyloxy group and $R_{22}$ and $R_{23}$ each represents a substituted or unsubstituted alkyl, alkenyl or heterocyclic group; said $R_{21}$, $R_{22}$ and $R_{23}$ may form together a nitrogen-containing monocyclic or polycyclic heterocyclic ring and the sum of the carbon atom numbers of $R_{21}$, $R_{22}$, and $R_{23}$ is at least 10.

22 Claims, No Drawings

SILVER HALIDE COLOR PHOTOGRAPHIC MATERIAL CONTAINING 5-PYRAZOLONE MAGENTA COUPLER AND AMINE-TYPE STAIN PREVENTING AGENT

This application is a continuation, of application Ser. No. 07/382,389 filed on Jul. 20, 1989, now abandoned.

FIELD OF THE INVENTION

This invention relates to a silver halide color photographic material containing 2-equivalent 5-pyrazolone type magenta couplers. More specifically, the invention relates to a method of preventing color stain formed with the passage of time after development processing of color photographic light-sensitive materials containing 2-equivalent 5-pyrazolone type magenta couplers.

BACKGROUND OF THE INVENTION

A silver halide color photographic material is imagewise exposed and developed by an aromatic amine series color developing agent to form dye images by the reaction of the oxidized product of the color developing agent formed as the result of the development and dye image-forming couplers (hereinafter referred to as couplers). For a color photographic material, a combination of a yellow coupler, a cyan coupler, and a magenta coupler is usually used.

As the magenta coupler, a pyrazolone type coupler, a pyrazolobenzimidazole type coupler, an indazolone type coupler, and a pyrazoloazole type coupler including pyrazolotriazole are known. Additionally 4-equivalent magenta couplers requiring theoretically 4 mols of silver halide for forming 1 mol of a dye and a 2 equivalent couplers requiring 2 mols of silver halide for forming 1 mol of a dye are known.

These couplers form a so-called color stain by coloring the unexposed portions of the color photographic materials containing the couplers, with the passage of time after development processing regardless of the specific kind of magenta coupler utilized. However, the extent of color stain differs according to the processing process, the composition of the color developer, and the extent of the deterioration of the color developer. The formation of the color stain is severer in the 2-equivalent magenta coupler.

The stain at the unexposed portions of a silver halide color photographic material determines the quality of transparence of such portions of color images as well as reduces the visual sharpness of color images. In particular, in the case of reflection type photographic light-sensitive material (e.g., color photographic papers, reversal color photographic papers, etc.), the reflection density of stain is theoretically emphasized several times the transmission density, so that even slight stains can reduce the image quality.

Furthermore, the occurrence of such a color stain at the unexposed portions of a photograph by photographic processing can not be sufficiently prevented by using fading inhibitors such as hydroquinones, hindered phenols, tocopherols, chromans, coumarans, etc., since such color stains are different from so-called yellow stains formed by the decomposition of a coupler itself by light or heat.

However, a method of using a 2-equivalent 5-pyrazolone type magenta coupler together with a specific aniline compound for inhibiting the occurrence of undesired magenta color stain is proposed in U.S. Pat. No. 4,483,919. It has also been proposed to use compounds capable of forming a substantially colorless product, by reacting with a developing agent or the oxidation product of a developing agent capable of forming a dye by causing coupling with couplers, which remain in the processed light-sensitive material after development processing. See European Patent Applications (unexamined published) 255,722, 258,662, 228,655, and 230,048 and U.S. Pat. No. 4,704,350. In particular, in the case of photographic record preservation wherein magenta color stains are visually very noticeable, even if the occurrence thereof is slight, they are a serious defect for light-sensitive materials, and it has been strongly desired to prevent the occurrence of such color stains together by utilizing the above proposed inhibition means with a stable storage of color images away from light, heat, and humidity for a long period of time. The inhibition means proposed above are not always sufficient for such long stable storage of color images.

Also, the aforesaid specific aniline compound can not always inhibit the occurrence of the color stain in the case of using the newly developed 2-equivalent magenta couplers and thus the development of new means for inhibiting the occurrence of the color stain has been desired.

Likewise, in the case of using the amine series compounds proposed by U.S. Pat. Nos. 4,555,479 and 4,585,728 and JP-A-58-102231 (the term "JP-A" as used herein means an "unexamined published Japanese patent application"), the coloring speed of the couplers are greatly reduced and, in particular, in photographic processing of a very short time, which has recently been strongly required, sufficient densities are not obtained by these amine series magenta couplers described in the aforesaid patents.

Furthermore, the 2-equivalent magenta couplers having a specific releasable group proposed in WO 88/4795 give serious magenta-like color stain due to the quick coloring speed and thus an improvement has been required.

SUMMARY OF THE INVENTION

A first object of this invention is, therefore, to inhibit the occurrence of color stain at the unexposed portions of a photographic light-sensitive material containing a 2-equivalent magenta coupler with the passage of time after development processing of the light-sensitive material, and in particular, to substantially inhibit the occurrence of color stain even in the case of processing a photographic light-sensitive material containing a 2-equivalent magenta coupler in a running state or processing the light-sensitive material with a small amount of wash water or with water-less processing.

A second object of this invention is to provide a color photographic light-sensitive material giving a sufficient color density by processing of a very short time, for example, a time of shorter than one minute for development with a processing solution (not substantially containing benzyl alcohol) in the case of processing a photographic light-sensitive material containing a 2-equivalent magenta coupler.

A third object of this invention is to provide a color photographic light-sensitive material capable of giving color images having excellent fastness and causing substantially no color stain in the case of storing the color images.

As the result of various investigations, the inventors have discovered that the aforesaid objects of this invention can be specifically attained by using a 2-acylaminoarylthio releasable type 5-pyrazolone magenta coupler having a specific structure as a combination with the amine series compound proposed in U.S. Pat. Nos. 4,555,479 and 4,585,728 and JP-A-58-102231 described above. Furthermore, the extent of the improvement has never been anticipated by combinations of the amine series compound with other conventional couplers.

That is, the aforesaid objects have been attained by a silver halide color photographic material containing at least one kind of 5-pyrazolone couplers having a releasable group represented by following formula (I) at the coupling position and at least one of the amine-type stain preventing compounds represented by following formula (II):

(I)

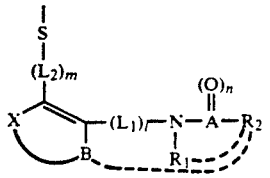

wherein $L_1$ and $L_2$ each represents a methylene group or an ethylene group; l and m each represents 0 or 1; $R_1$ represents a hydrogen atom, an alkyl group, an aryl group, or a heterocyclic group; $R_2$ represents a group bonded to A by a carbon atom, an oxygen atom, a nitrogen atom or a sulfur atom; A represents a carbon atom or a sulfur atom; n represents 1 when A is a carbon atom and 1 or 2 when A is a sulfur atom; B represents a carbon atom, an oxygen atom, a nitrogen atom, or a sulfur atom; and X represents an atomic group necessary for forming a ring; said $R_1$ and $R_2$ may combine with each other to form a ring and when B is a carbon atom or a nitrogen atom, said B and $R_2$ may combine with each other to form a ring;

(II)

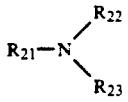

wherein $R_{21}$ represents a hydrogen atom, a hydroxy group, a substituted or unsubstituted alkyl group, a substituted or unsubstituted alkenyl group, a substituted or unsubstituted alkoxy group, a substituted or unsubstituted acyl group, a substituted or unsubstituted aryloxy group, a substituted or unsubstituted heterocyclic oxy group, or a substituted or unsubstituted acyloxy group; and $R_{22}$ and $R_{23}$ each represents a substituted or unsubstituted alkyl group, a substituted or unsubstituted alkenyl group, or a substituted or unsubstituted heterocyclic group; said $R_{21}$, $R_{22}$ and $R_{23}$ may together form a heterocyclic ring comprising a nitrogen-containing monocyclic or plural cyclic ring, and the sum of the carbon atoms of said $R_{21}$, $R_{22}$, and $R_{23}$ is at least 10.

DETAILED DESCRIPTION OF THE INVENTION

First, the compounds shown by formula (I) described above are explained.

In Formula (I), $L_1$ and $L_2$ represents a substituted or unsubstituted methylene group or a substituted or unsubstituted ethylene group. As the substituent for the group, there are a halogen atom (e.g., fluorine, chlorine, and bromine), an aliphatic group (e.g., a straight chain or branched alkyl group having from 1 to 22 carbon atoms, including aralkyl, alkenyl, alkynyl, cycloalkyl, and cycloalkenyl), an aryl group (e.g., phenyl and naphthyl), a heterocyclic group (e.g., 2-furyl and 3-pyridyl), an alkoxy group (e.g., methoxy, ethoxy, and cyclohexyloxy), an aryloxy group (e.g., phenoxy, p-methoxyphenoxy, and p-methylphenoxy), an alkylamino group (e.g., ethylamino and dimethylamino), an alkoxycarbonyl group (e.g., methoxycarbonyl and ethoxycarbonyl), a carbamoyl group (e.g., N,N-dimethylcarbamoyl), an anilino group (e.g., phenylamino and N-ethylanilino), a sulfamoyl group (e.g., N,N-diethylsulfamoyl), an alkylsulfonyl group (e.g., methylsulfonyl), an arylsulfonyl group (e.g., tolylsulfonyl), an alkylthio group (e.g., methylthio and octylthio), an arylthio group (e.g., phenylthio and 1-naphthylthio), an acyl group (e.g., acetyl and benzoyl), an acylamino group (e.g., acetamido and benzamido), an imido group (e.g., succinic acid imido and phthalic acid imido), a ureido group (e.g., phenylureido and N,N-dibutylureido), a sulfamoylamino group (e.g., N,N-dipropylsulfamoylamino), an alkoxycarbonylamino group (e.g., methoxycarbonylamino), a sulfonamido group (e.g., methanesulfonamido), a hydroxy group, and a cyano group. $L_1$ and $L_2$ are preferably an unsubstituted methylene or ethylene group. Also, l and m represent 0 or 1, and are preferably 0.

$R_1$ represents a hydrogen atom, an alkyl group, an aryl group, or a heterocyclic group. More specifically, $R_1$ represents a hydrogen atom, an alkyl group (such as a straight chain or branched alkyl group having from 1 to 22 carbon atoms), an aryl group (such as a phenyl group or a naphthyl group), or a heterocyclic group (such as a 2-furyl group, a 2-thienyl group, a 2-pyrimidinyl group a 4-pyridyl group, etc.). These groups may have a substituent as those described as substituents for the groups shown by $L_1$ and $L_2$. $R_1$ is preferably a hydrogen atom or an alkyl group.

$R_2$ represents a group bonded to A by a carbon atom, an oxygen atom, a nitrogen atom, or a sulfur atom. Specifically, $R_2$ represents a group bonded by a carbon atom, such as an alkyl group, an aryl group, a heterocyclic group (bonded by the carbon atom thereof), an acyl group, an alkoxycarbonyl group, a carbamoyl group, etc.; a group bonded by an oxygen atom, such as an alkoxy group, an aryloxy group, etc.; a group bonded by a nitrogen atom, such as an alkylamino group, an anilino group, an acylamino group, a ureido group, a sulfamoylamino group, an alkoxycarbonylamino group, a sulfonamido group, etc.; or a group bonded by a sulfur atom, such as an alkylthio group, an arylthio group, etc. The aforesaid groups may be substituted by the substituents described above for the groups shown by $L_1$ and $L_2$. $R_2$ is preferably an alkyl group, an aryl group, an alkylamino group or an anilino group.

In formula (I), A represents a carbon atom or a sulfur atom, and represents preferably a carbon atom. When A is a carbon atom, n represents 1 and when A is a sulfur atom, n represents 1 or 2.

B represents a carbon atom, an oxygen atom, a nitrogen atom or a sulfur atom, preferably a carbon atom or a nitrogen atom, and more preferably a carbon atom.

X represents an atomic group necessary for forming a ring, and is preferably an atomic group constituted by the atom selected from carbon atom, oxygen atom, nitrogen atom and sulfur atom necessary for forming a saturated or unsaturated 5-, 6-, or 7-membered ring. More preferably, X represents an atomic group constituted by the atom selected from carbon atom, oxygen atom and nitrogen atom necessary for forming an unsaturated 5- or 6-membered ring. The ring may have a substituent described above for the groups shown by $L_1$ and $L_2$ and also the ring containing X may be condensed to other ring.

$R_1$ and $R_2$ may combine with each other to form a ring, preferably a 5- or 6-membered saturated or unsaturated ring. Also, these rings may have a substituent described above as a substituent for the groups shown by $L_1$ and $L_2$.

When B is a carbon atom or a nitrogen atom, B and $R_2$ may combine with each other to form a ring, preferably a 5- or 6-membered saturated or unsaturated ring, and more preferably a 5- or 6-membered saturated ring. Also, these rings may have a substituent described above as a substituent for the groups shown by $L_1$ and $L_2$.

A 1st type of preferred pyrazolone couplers having the releasable group shown by formula (I) described above can be shown by the following general formula

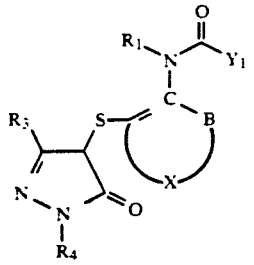

In the above general formula, $Y_1$ represents Ra or $Z_1$ Rb (wherein Ra represents a substituted or unsubstituted aryl group, a substituted or unsubstituted heterocyclic or a secondary or tertiary group shown by

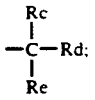

$Z_1$ represents an oxygen atom, a sulfur atom or NRf; Rb represents a substituted or unsubstituted alkyl group, a substituted or unsubstituted aryl group, or a substituted or unsubstituted heterocyclic group; Rc and Rd each represents a halogen atom, Rb, or $Z_2$Rg; Re represents a hydrogen atom or a group defined by Rc and Rd; Rf represents a hydrogen atom or a group defined by Rb; $Z_2$ represents an oxygen atom, a sulfur atom, or NRh; Rg represents a group defined by Rf; Rh represents a group defined by Rf; Rc may combine with at least one of Rd and Re to form one or two carbon rings or heterocyclic rings, which may further have a substituent; $R_1$, X and B are the same as defined above for formula (I); $R_3$ represents an anilino group, an acylamino group, a ureido group, a carbamoyl group, an alkoxy group, an aryloxycarbonyl group, an alkoxycarbonyl group, or an N-heterocyclic group, with all these $R_3$ groups preferably containing an oil-solubilizing group; $R_4$ represents a substituted or unsubstituted aryl group, preferably a substituted phenyl group, and more preferably a 2,4,6-trichlorophenyl group.

More preferred pyrazolone couplers of the pyrazolone couplers shown by the aforesaid general formula, are those shown by the following general formula;

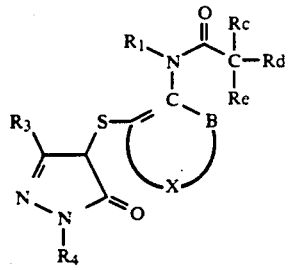

wherein $R_1$, $R_3$, $R_4$, Rc, Rd, Re, X, and B have the same significance as defined above.

A 2nd type of preferred pyrazolone coupler can be shown by the following general formula;

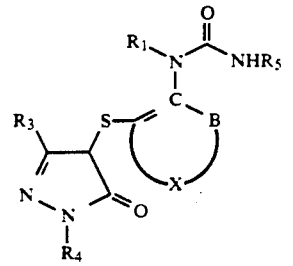

wherein $R_5$ represents a substituted or unsubstituted alkyl group, a substituted or unsubstituted aryl group, or a substituted or unsubstituted heterocyclic group; and $R_1$, $R_3$, $R_4$, X and B have the same values as defined above. In the immediately aforesaid general formula, $R_3$ is preferably a group shown by —NH—$Y_2$ wherein $Y_2$ represents a substituted or unsubstituted aryl group, an arylcarbonyl group, or an arylaminocarbonyl group) and $R_4$ is preferably a 2,4,6-trichlorophenyl group.

A 3rd type of preferred pyrazolone coupler can be shown by the following general formula;

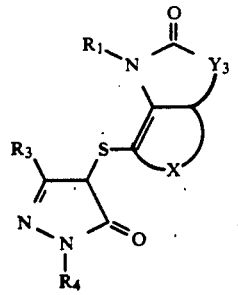

wherein $R_1$, $R_3$, $R_4$, and X have the same values as defined above, and $Y_3$ represents a substituted or unsubstituted methylene group, a substituted or unsubstituted ethylene group, or >NRf (wherein Rf has the same values as defined above).

The most preferred pyrazolone couplers of the aforesaid third type of preferred pyrazolone couplers are shown by the following general formula;

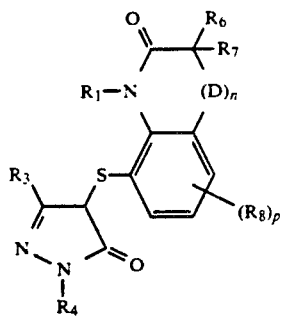

wherein $R_1$, $R_3$, and $R_4$ have the same significance as defined above; $R_6$ and $R_7$ each represents an alkyl group or an aryl group; $R_8$ represents those substituents defined above for $L_1$ and $L_2$; D represents a methylene group, an oxygen atom, a nitrogen atom, or a sulfur atom; n represents an integer of from 0 to 2 when D is a methylene group or 1 when D is oxygen, nitrogen or sulfur; and p represents an integer of from 0 to 4.

Thereinafter, the term "coupler moiety" means the portion of a coupler from which a coupling releasable group is removed and the term "coupler" means the whole compound including both the coupler moiety and the coupling releasable group.

The "coupler moiety" is a pyrazolone coupler forming a dye, in particular, a magenta dye, by causing a reaction with an oxidized color developing agent, which is well known in the field of photography. Preferred examples of the pyrazolone coupler moiety are described in U.S. Pat. Nos. 4,413,054, 4,443,536, 4,522,915, 4,336,325, 4,199,361, 4,351,897, and 4,385,111, JP-A-60-170854, JP-A-60-194452, and JP-A-60-194451, U.S. Pat. Nos. 4,407,936, 3,419,391, and 3,311,476, British Patent 1,357,372, U.S. Pat. Nos. 2,600,788, 2,908,573, 3,062,653, 3,519,429, 3,152,896, 2,311,082, 2,343,703, and 2,369,489.

When a coupling releasable group is substituted to the pyrazolone coupler moieties described in the aforesaid patents, the coupling releasable group can be replaced by the coupling releasable group of this invention shown by general formula (I). The pyrazolone couplers in this invention can be used together with other pyrazolone couplers as described in the aforesaid patents.

Examples of the preferred "coupler moiety" can be shown by the following general formula;

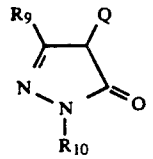

wherein Q represents a coupling releasable group of the present invention, $R_9$ represents an anilino group, an acylamino group, a ureido group, a carbamoyl group, an alkoxy group, an aryloxycarbonyl group, an alkoxycarbonyl group, or an N-heterocyclic group and $R_{10}$ represents a substituted or unsubstituted aryl group and is preferably a phenyl group having at least one substituent selected from a halogen atom, an alkyl group, an alkoxy group, an alkoxycarbonyl group, an arylamino group, a sulfamido group, a sulfonamido group, and cyano group. The carbon atom or the nitrogen atom of these groups may be unsubstituted, or substituted by a group which does not reduce the effect of the coupler.

In the aforesaid general formula, $R_9$ is preferably an anilino group, and more preferably an anilino group shown by the following general formula;

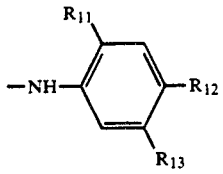

wherein $R_{11}$ represents an alkoxy group having from 1 to 30 carbon atoms, an aryloxy group, or a halogen atom (preferably, chlorine) and $R_{12}$ and $R_{13}$ each represents a hydrogen atom, a halogen atom (e.g., chlorine, bromine, and fluorine), an alkyl group (e.g., an alkyl group having from 1 to 30 carbon atoms), an alkoxy group (e.g., an alkoxy group having from 1 to 30 carbon atoms), an acylamino group, a sulfonamido group, a sulfamoyl group, a sulfamido group, a carbamoyl group, a diacylamino group, an aryloxycarbonyl group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, or a carboxy group. $R_{12}$ and $R_{13}$ each may be a hydrogen atom or a ballast group.

$R_{10}$ in the above general formula is preferably a substituted phenyl group. Examples of suitable substituents are a halogen atom (e.g., chlorine, bromine, and fluorine), an alkyl group having from 1 to 22 carbon atoms (e.g., methyl, ethyl, propyl, t-butyl, and tetradecyl), an alkoxy group having from 1 to 22 carbon atoms (e.g., methoxy, ethoxy, and dodecyloxy), an alkoxycarbonyl group having from 1 to 23 carbon atoms (e.g., methoxycarbonyl, ethoxycarbonyl, and tetradecyloxycarbonyl), an acylamino group (e.g., α-[3-pentadecylphenoxy]-butylamido) and a cyano group. $R_{10}$ is more preferably a 2,4,6-trichlorophenyl group.

$R_{12}$ and $R_{13}$ in the aforesaid general formula are now explained in more detail.

That is, $R_{12}$ and $R_{13}$ each is a hydrogen atom, a halogen atom (e.g., chlorine, bromine, and fluorine), a straight chain or branched alkyl group having from 1 to 30 carbon atoms (e.g., methyl, trifluoromethyl, ethyl, t-butyl, and tetradecyl), an alkoxy group having from 1 to 30 carbon atoms (e.g., methoxy, ethoxy, 2-ethylhexyloxy, and tetradecyloxy), an acylamino group (e.g., acetamino, benzamido, butylamido, tetradecaneamido, α-(2,4-di-t-pentylphenoxy)acetamido, α-(2,4-di-t-pentylphenoxy)butylamido, α-(4-hydroxy-3-t-butylphenoxy)tetradecaneamido, 2-oxo-pyrrolidin-1-yl, 2-oxy-5-tetradecylpyrrolin-1-yl, N-methyltetradecaneamido, and t-butylcarbonamido), a sulfonamido group (e.g., methanesulfonamido, benzenesulfonamido, p-toluenesulfonamido, p-dodecylbenzenesulfonamido, N-methyltetradecylsulfonamido, and hexadecanesulfonamido), a sulfamoyl group (e.g., N-methylsulfamoyl, N-hexadecylsulfamoyl, N,N-dimethylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl), a sulfamido group (e.g., N-methylsulfamido and N-octadecylsulfamido), a carbamoyl group (e.g., N-methylcarbamoyl, N-octadecylcarbamoyl, N-[4-(2,4-di-t-pentylphenoxy)-butyl]carbamoyl, N-methyl-N-tetradecylcarbamoyl, and N,N-dioctylcarbamoyl), a diacylamino group (e.g., N-succinic acid imido, N-phthalimido, 2,5-dioxo-1-oxazolidinyl, 3-dodecyl-2,5-dioxo-1-imidazolyl, and N-acetyl-N-dodecylamino), an aryloxycarbonyl group (e.g., phenoxycarbonyl and p-dodecyloxyphenoxycarbonyl), an alkoxycarbonyl group having from 2 to 30 carbon atoms (e.g., methoxycarbonyl, tetradecyloxycarbonyl, ethoxycarbonyl, benzyloxycarbonyl, and dodecyloxycarbonyl), an alkoxysulfonyl group having from 1 to 30 carbon atoms (e.g., methoxysulfonyl, octylsulfonyl, tetradecyloxysulfonyl, and 2-ethylhexyloxysulfonyl), an aryloxysulfonyl group (e.g., phenoxysulfonyl and 2,4-di-t-pentylphenoxysulfonyl), an alkanesulfonyl group having from 1 to 30 carbon atoms (e.g., methanesulfonyl, octanesulfonyl, 2-ethylhexanesulfonyl, and hexadecanesulfonyl), an arylsulfonyl group (e.g., benzenesulfonyl, 4-nonylbenzenesulfonyl, and p-toluenesulfonyl), an alkylthio group having from 1 to 22 carbon atoms (e.g., ethylthio, octylthio, benzylthio, tetradecylthio, and 2-(2,4-di-t-pentylphenoxy)ethylthio), an arylthio group (e.g., phenylthio and p-tolylthio), an alkoxycarbonylamino group (e.g., ethoxycarbonylamino, benzyloxycarbonylamino, and hexadecyloxycarbonylamino), an alkylureido group (e.g., N-methylureido, N,N-dimethylureido, N-methyl-N-dodecylureido, N-hexadecylureido, N,N-dioctadecylureido, and N,N-dioctyl-N'-ethylureido), an acyl group (e.g., acetyl, benzoyl, octadecanoyl, p-dodecaneamidobenzoyl, and cyclohexanecarbonyl), a nitro group, a cyano group, or a carboxy group.

The alkoxy group and the aryloxy group shown by $R_{11}$ are explained in more detail. Examples of the alkoxy group are methoxy, ethoxy, propoxy, butoxy, 2-methoxyethoxy, sec-butoxy, hexyloxy, 2-ethylhexyloxy, 2-(2,4-di-t-pentylphenoxy)ethoxy, and 2-dodecyloxyethoxy and examples of the aryloxy group are phenoxy, α-naphthyloxy, β-naphthyloxy, and 4-tolyloxy.

A monomer including the pyrazolone coupler having the releasable group shown by formula (I) described above may form a copolymer with a non-coloring ethylenical monomer causing no coupling reaction with the oxidation product of an aromatic primary amine developing agent.

As the non-coloring ethylenical monomer causing no coupling reaction with the oxidation product of an aromatic primary amine developing agent, there are acrylic acid, α-chloroacrylic acid, α-alkylacrylic acid (e.g., methacrylic acid), the esters or amides induced from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, vinyl esters (e.g., vinyl acetate, vinyl propionate, and vinyl laurate), acrylonitrile, methacrylonitrile, aromatic vinyl compounds (e.g., styrene and derivatives of styrene, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine, 2-vinylpyridine, and 4-vinylpyridine.

The non-coloring ethylenically unsaturated monomers described above can be used singly or as a combination thereof. Examples of such a combination are n-butyl acrylate and methyl acrylate, styrene and methacrylic acid, methacrylic acid and acrylamide, and methyl acrylate and diacetoneacrylamide.

As is well-known in the field of polymer color coupler, the non-coloring ethylenically unsaturated monomer for copolymerizing with the solid water-insoluble monomer coupler can be selected such that the copolymer formed has preferred physical and chemical properties such as solubility, compatibility with a binder (e.g., gelatin) of a photographic colloid composition, plasticity, heat-stability, etc.

The polymer coupler for use in this invention may be water soluble or water insoluble and in these couplers, a polymer coupler latex is particularly preferred.

Specific examples of the coupling releasable group (Q) shown by formula (I) are illustrated below but the invention is not limited to them.

Q-1)

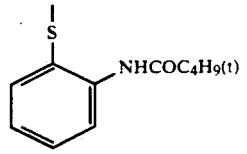

Q-2)

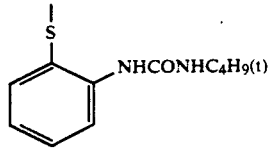

Q-3)

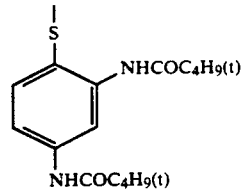

Q-4)

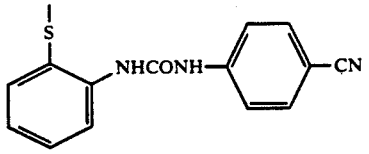

Q-5)

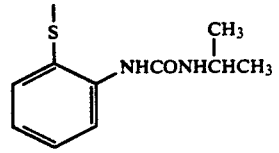

Q-6)

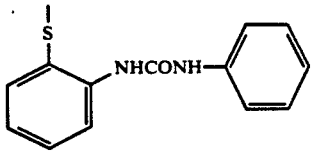

-continued
Q-7)
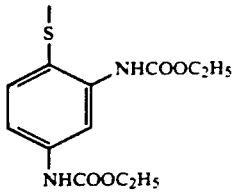
Q-8)
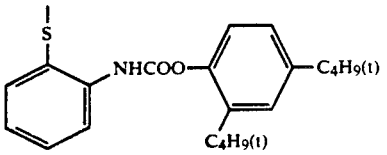
Q-9)
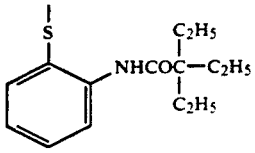
Q-10)
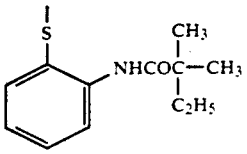
Q-11)
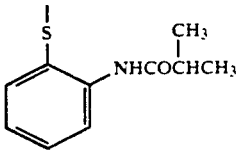
Q-12)
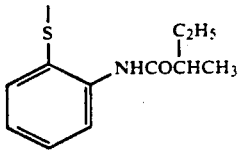
Q-13)
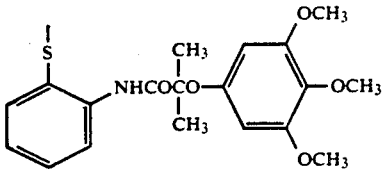
Q-14)
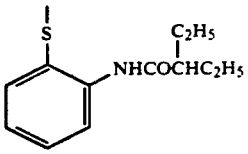
Q-15)
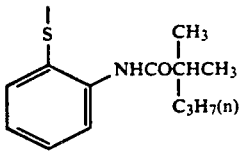
-continued
Q-16)
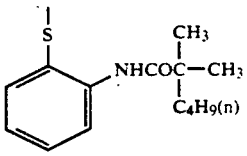
Q-17)
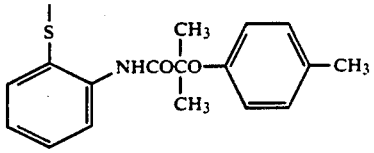
Q-18)
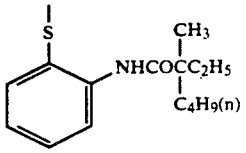
Q-19)
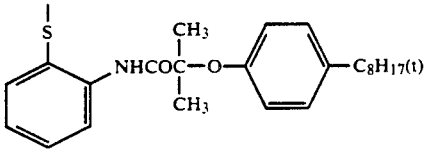
Q-20)
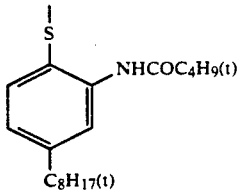
Q-21)
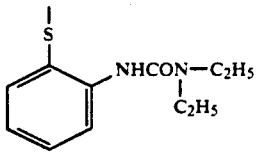
Q-22)
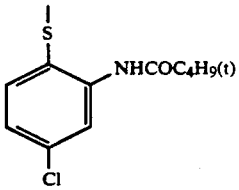
Q-23)
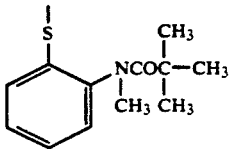

-continued
Q-24)
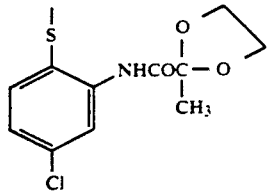
Q-25)
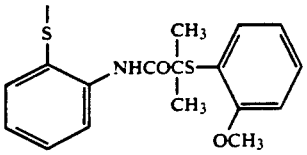
Q-26)
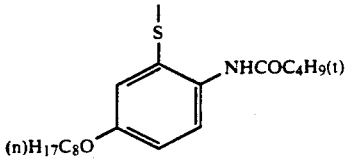
Q-27)
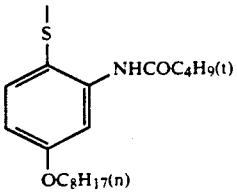
Q-28)
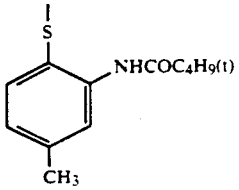
Q-31)
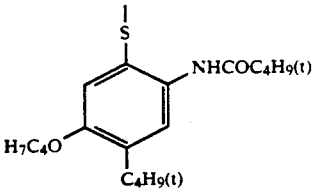
Q-32)
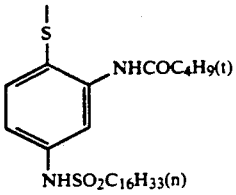
Q-33)
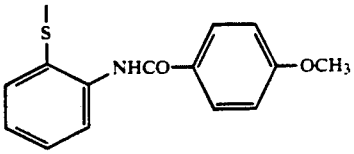
-continued
Q-34)
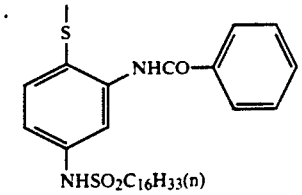
Q-35)
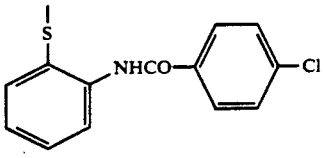
Q-36)
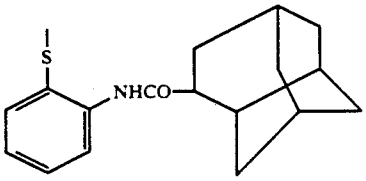
Q-37)
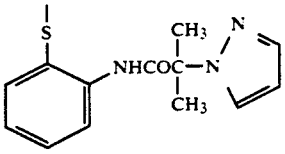
Q-38)
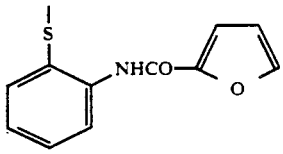
Q-39)
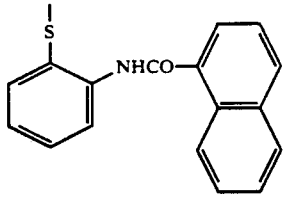
Q-40)
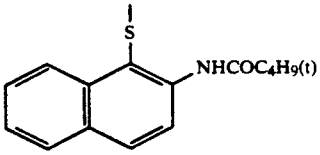
Q-41)
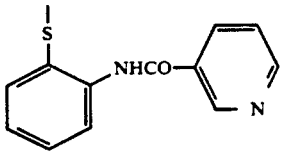

-continued
Q-43)
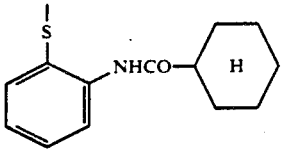
Q-44)
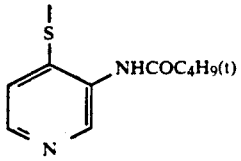
Q-45)
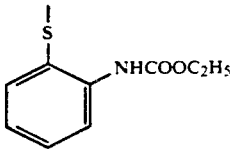
Q-46)
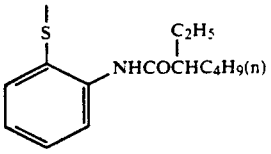
Q-47)
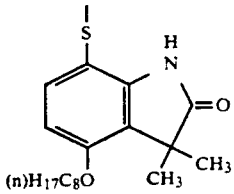
Q-48)
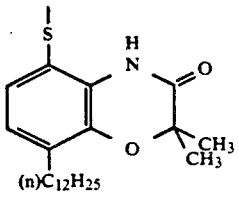
Q-49)
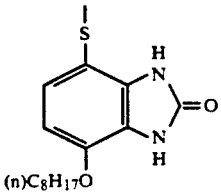
-continued
Q-50)
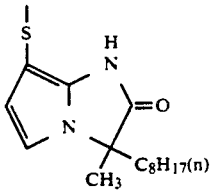
Q-53)
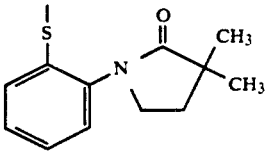
Q-54
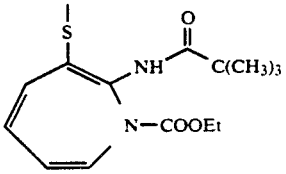
Q-55)
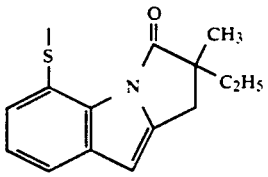
Q-56)
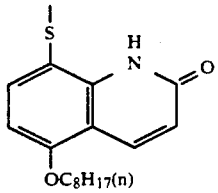
Q-57)
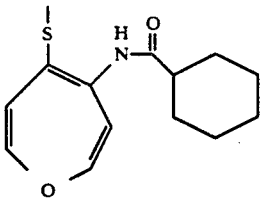
Then, specific examples of the 5-pyrazolone magenta coupler for use in this invention are shown below but the invention is not limited to them.

(M-1)
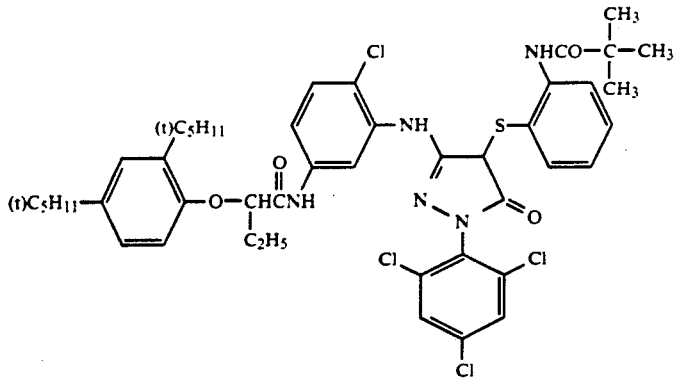
(M-2)
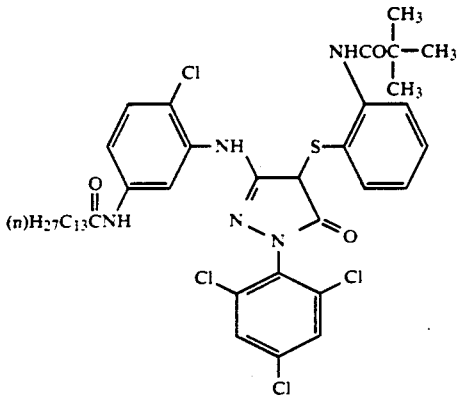
(M-3)
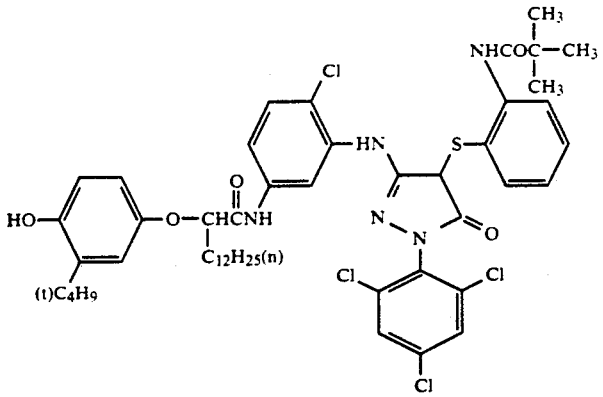
(M-4)
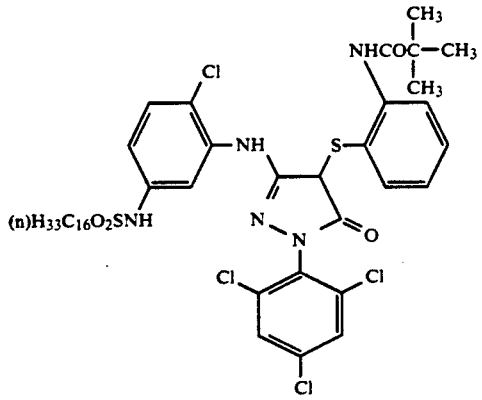

-continued
(M-5)
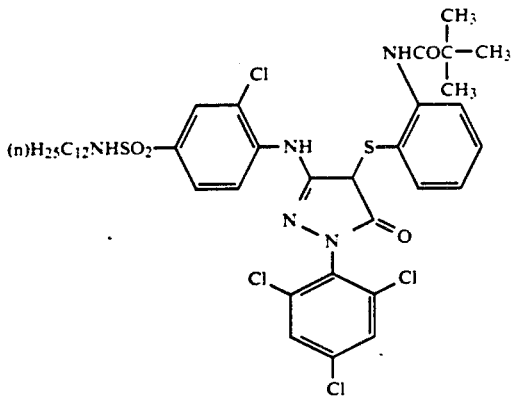
(M-6)
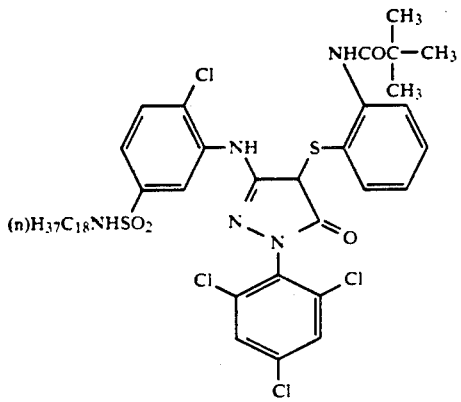
(M-7)
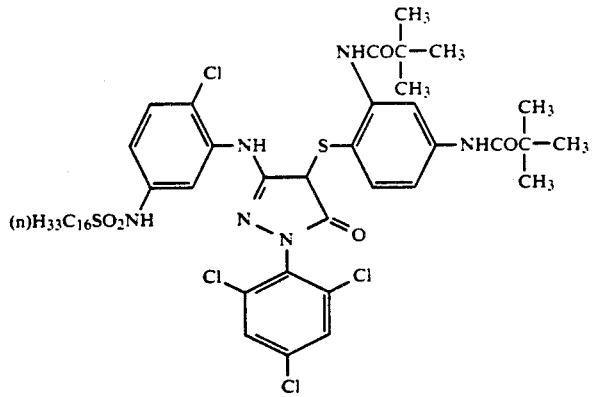
(M-8)
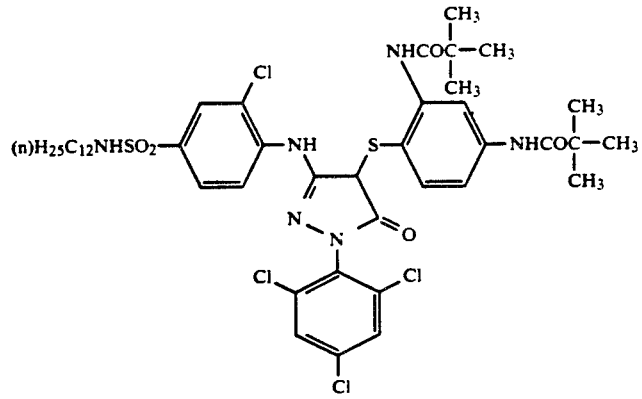

-continued
(M-9)
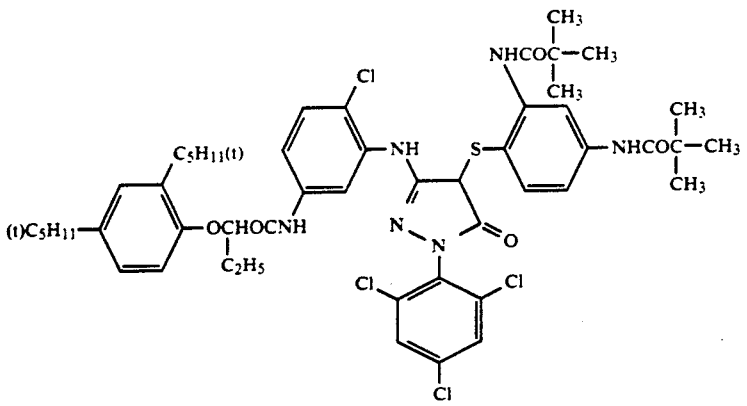
(M-10)
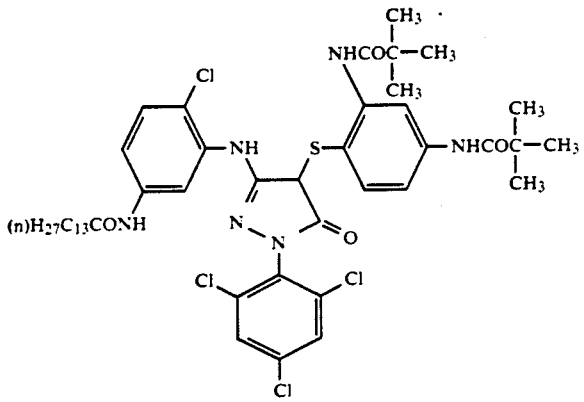
(M-11)
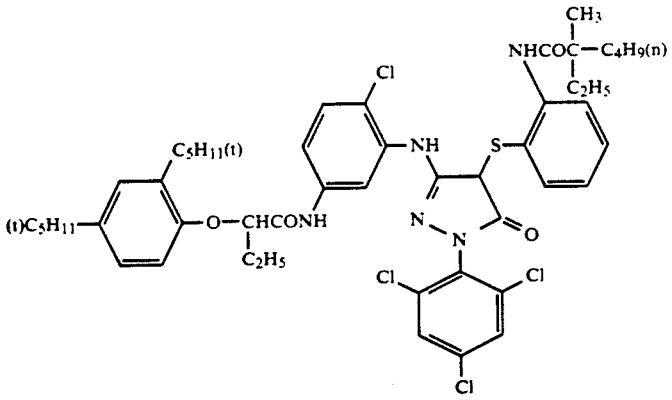
(M-12)
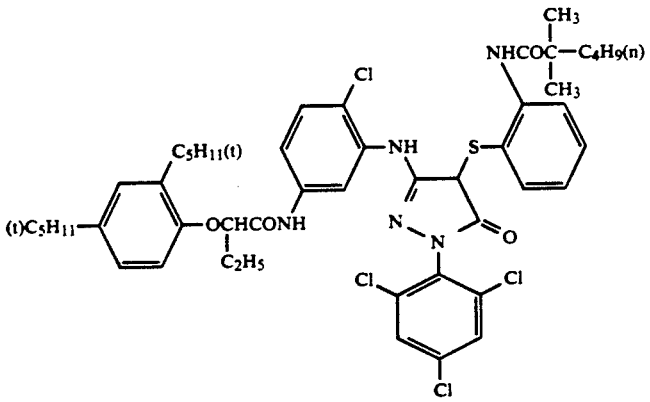

-continued
(M-13)
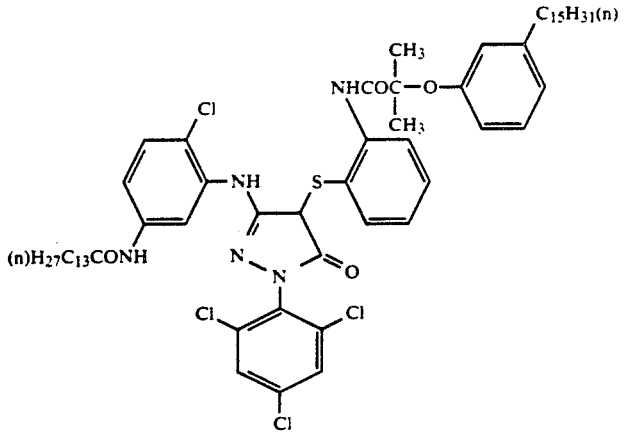
(M-14)
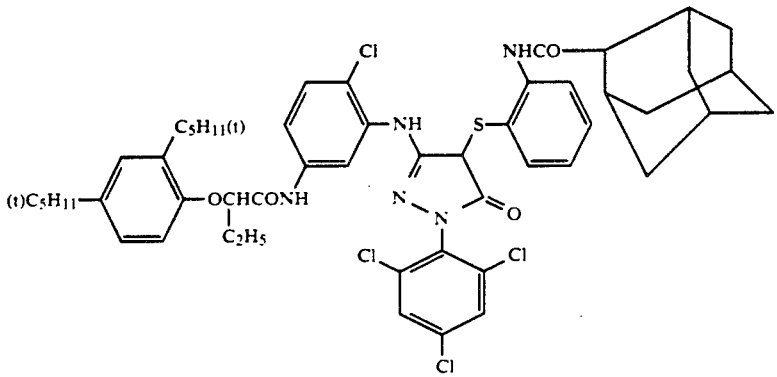
(M-15)
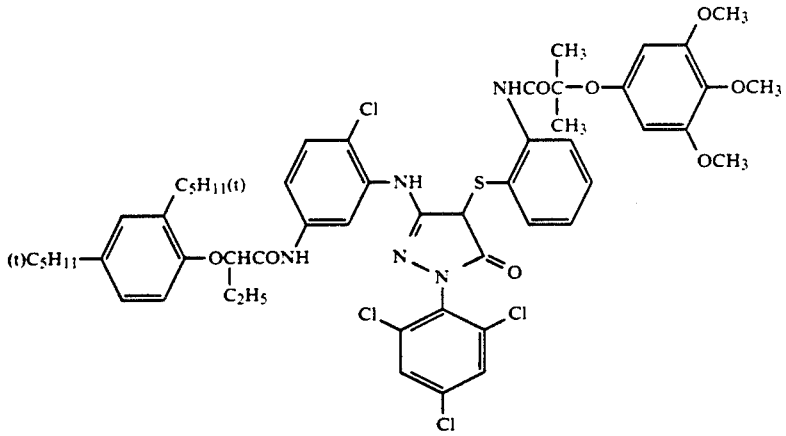
(M-16)
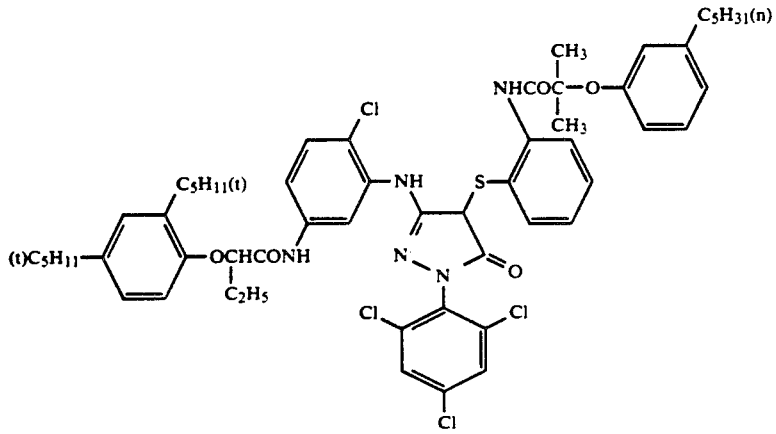

-continued
(M-17)
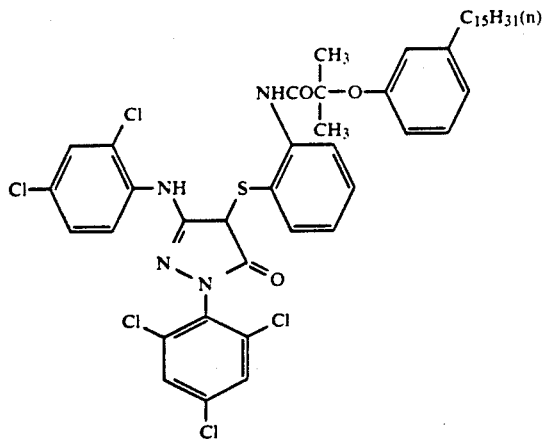
(M-18)
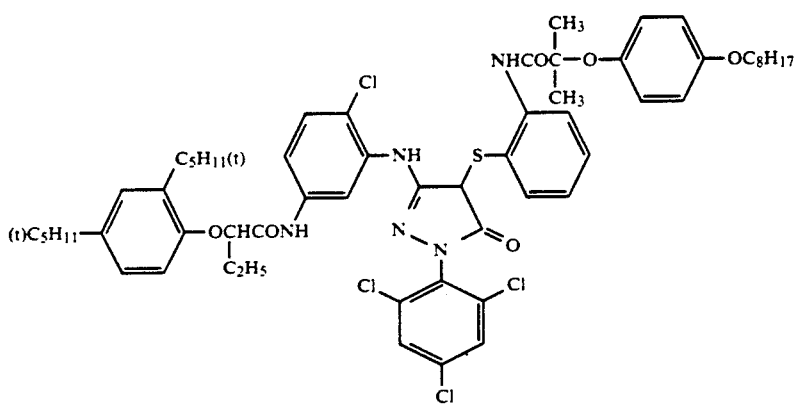
(M-19)
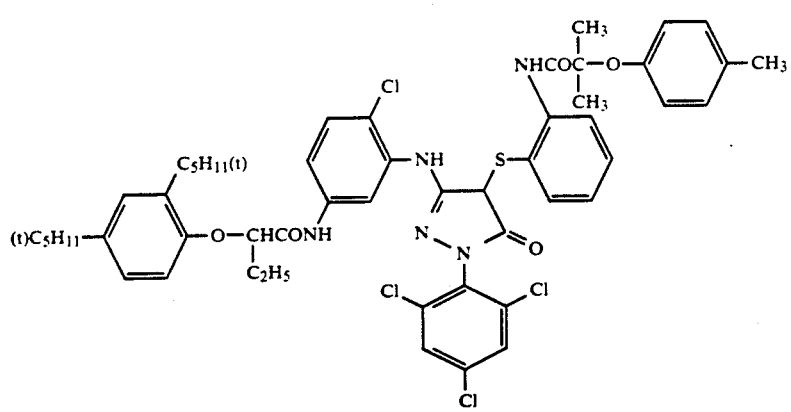
(M-20)
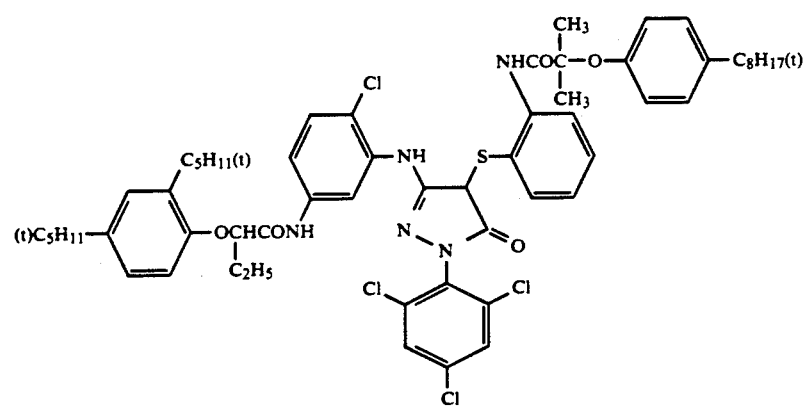

-continued
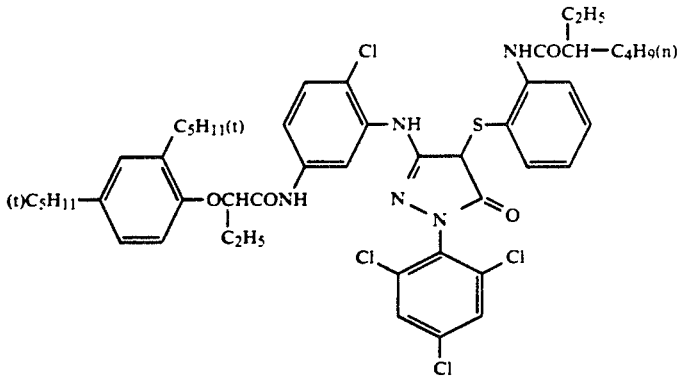
(M-21)
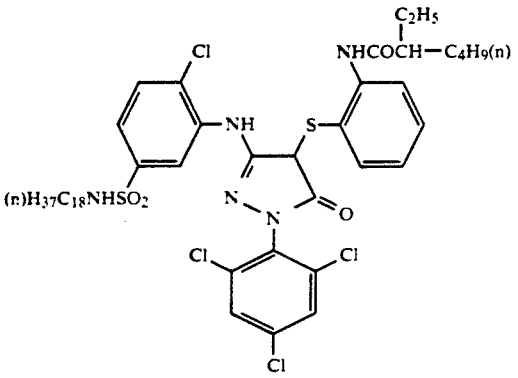
(M-22)
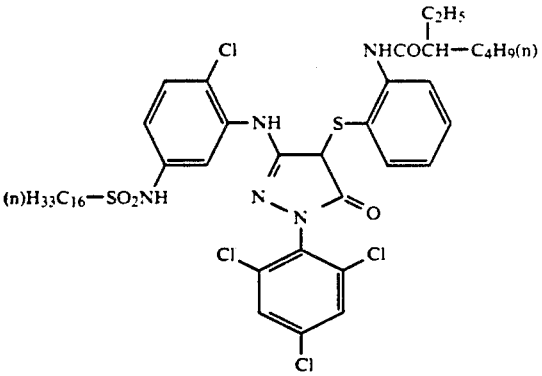
(M-23)
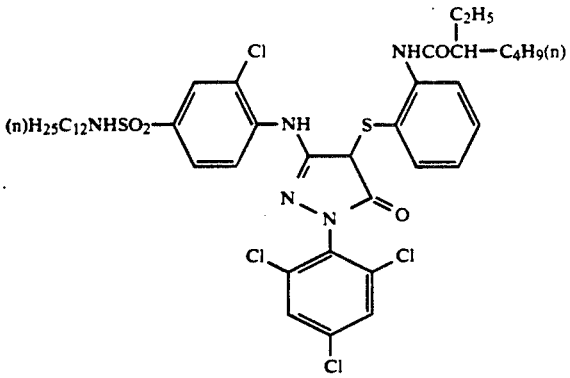
(M-24)

-continued
(M-25)
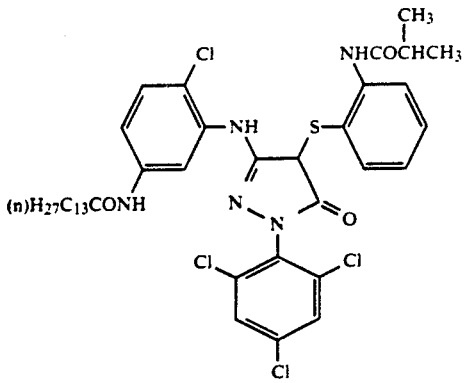
(M-26)
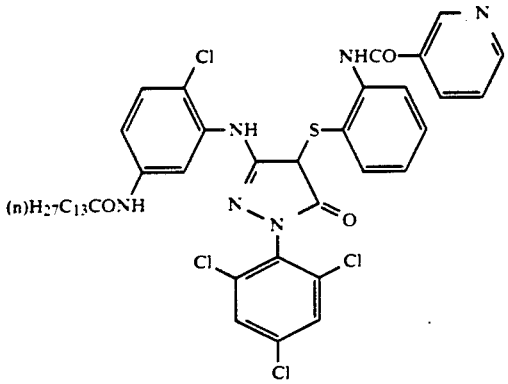
(M-27)
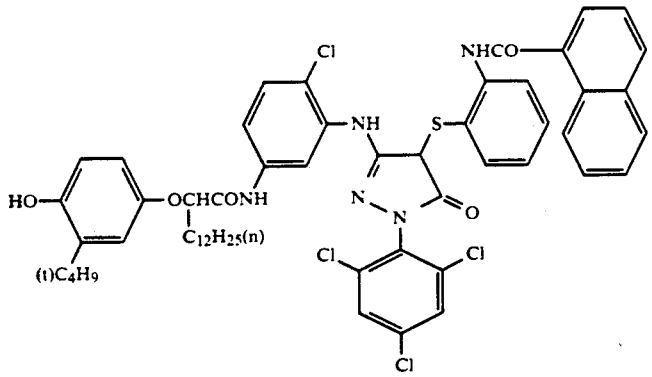
(M-28)
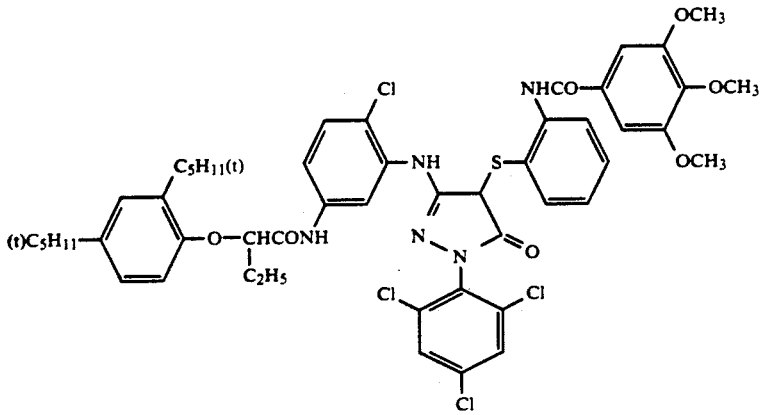

-continued
(M-29)
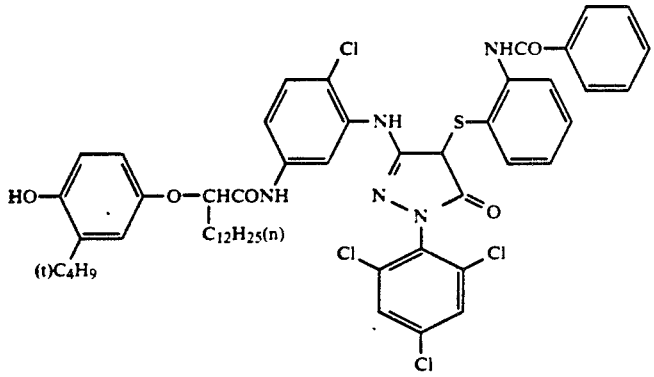
(M-30)
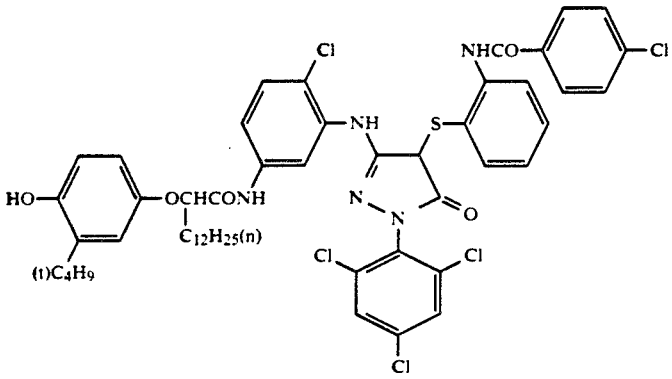
(M-31)
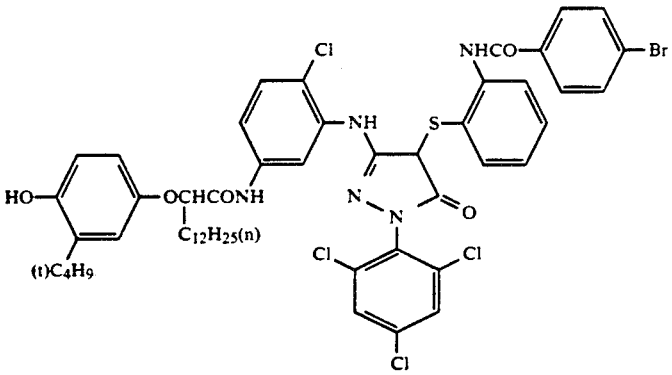
(M-32)
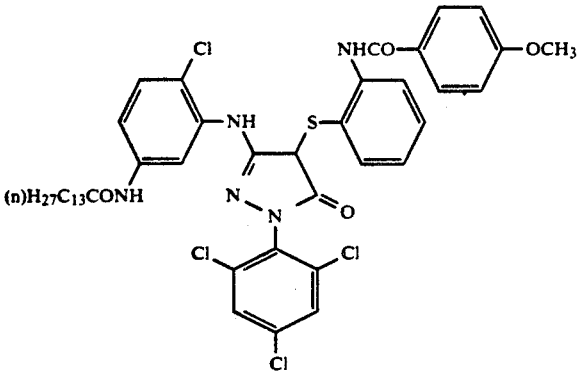

-continued
(M-33)
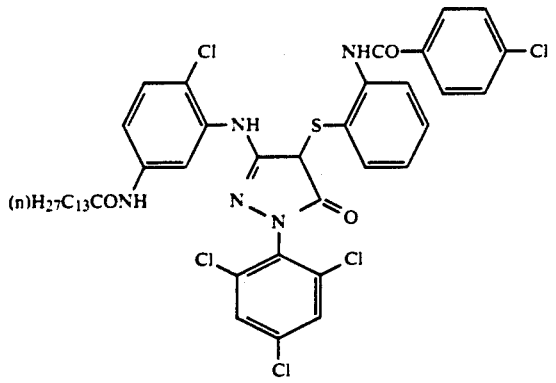
(M-34)
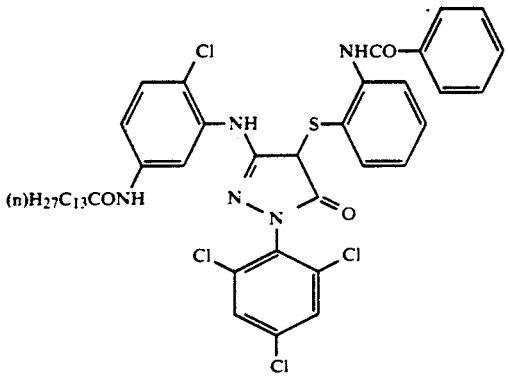
(M-35)
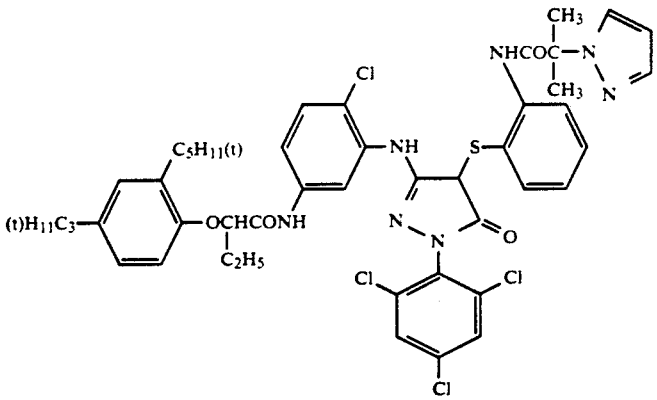
(M-36)
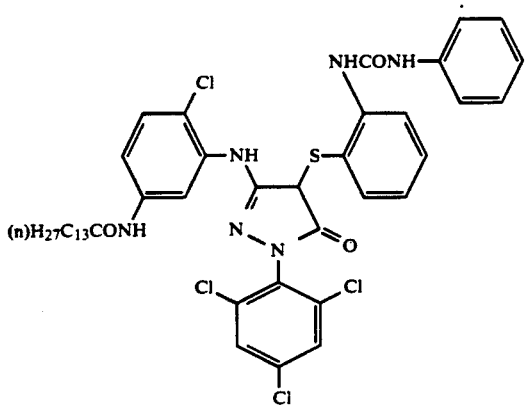

-continued
(M-37)
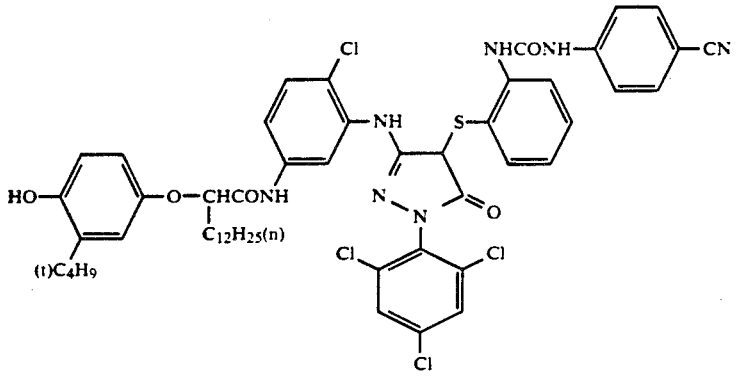
(M-38)
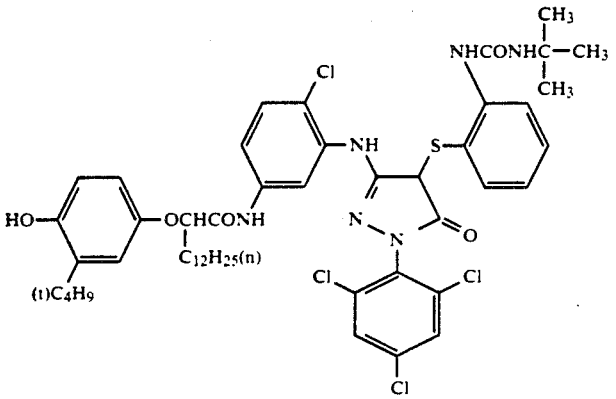
(M-39)
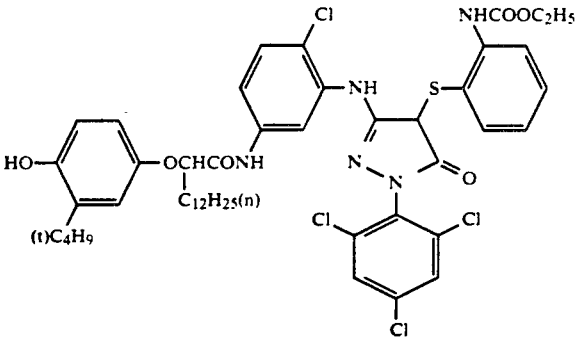
(M-40)
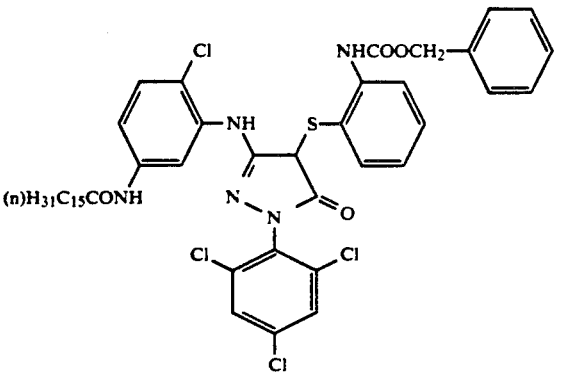

-continued
(M-41)
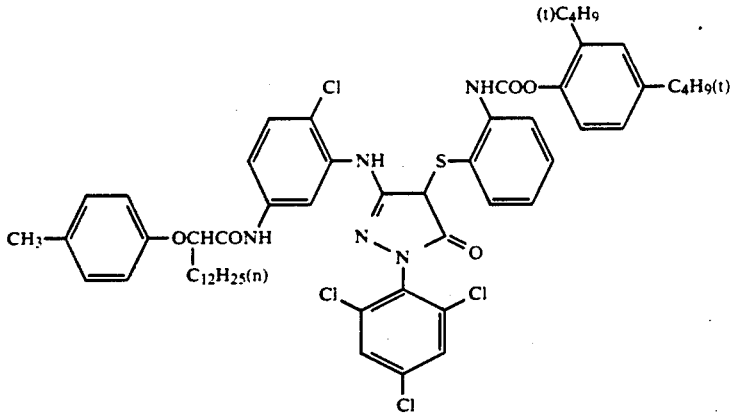
(M-42)
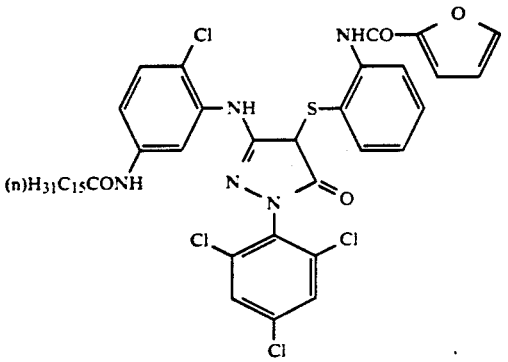
(M-43)
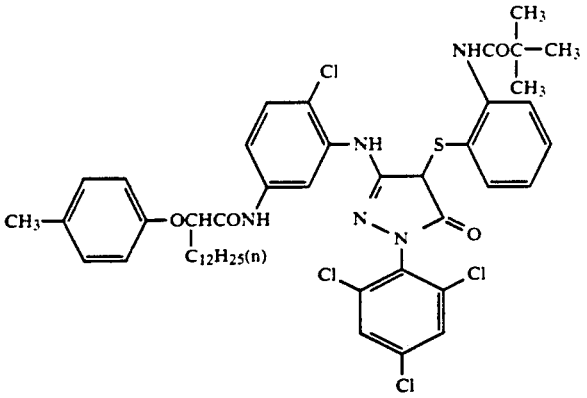
(M-44)
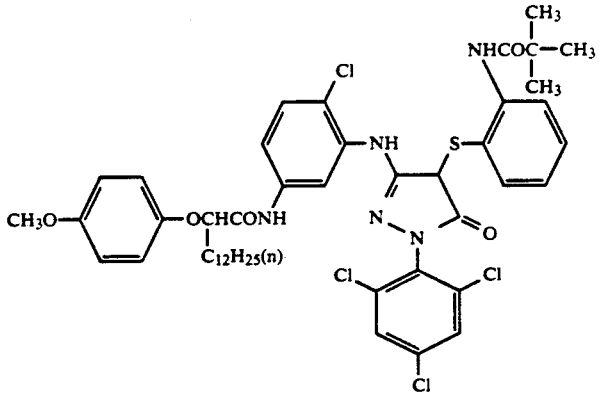

-continued
(M-45)
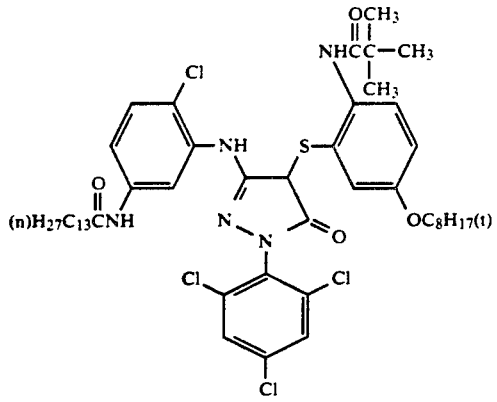
(M-49)
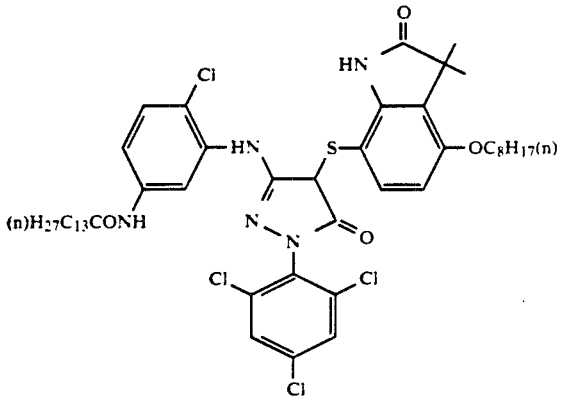
(M-50)
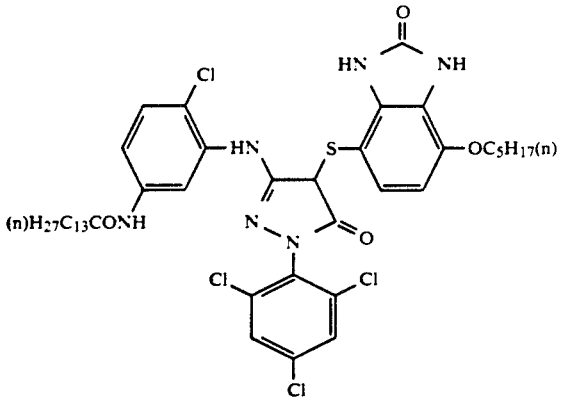
(M-51)
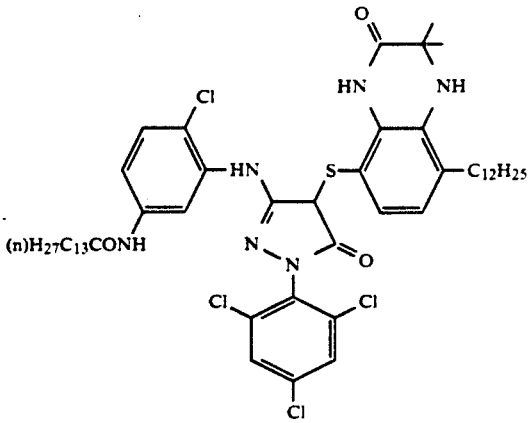

-continued (M-53)

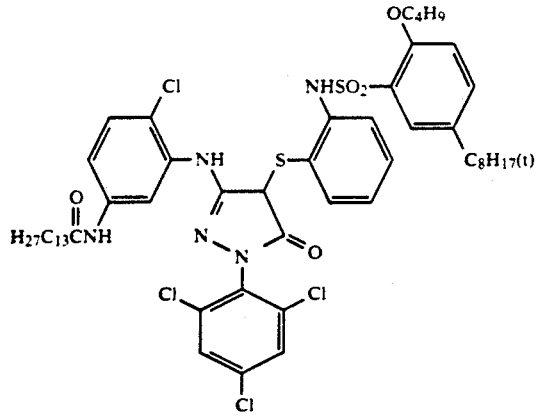

(M-54)

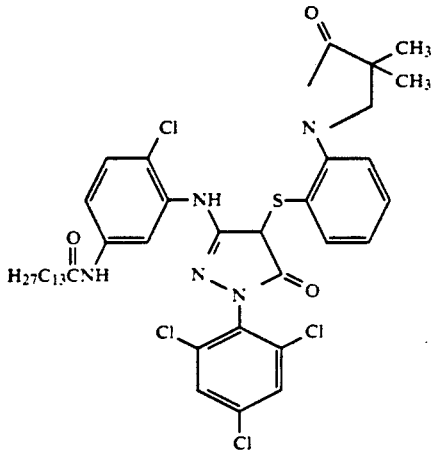

(M-55)

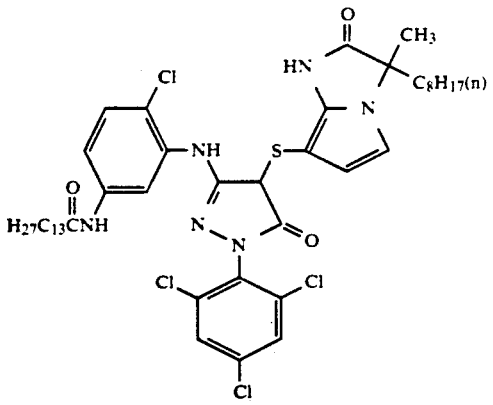

The compounds of general formula (II) useful in the present invention are now explained in detail.

In formula (II), $R_{21}$ represents a hydrogen atom, a hydroxy group, an alkyl group (e.g., methyl, ethyl, butyl, hexadecyl, tert-butyl, and cyclohexyl), an alkenyl group (e.g., vinyl and allyl), an alkoxy group (e.g., methoxy, butoxy, dodecyloxy, iso-propoxy, and cyclopentyloxy), an acyl group (e.g., acetyl, benzoyl, and dodecanoyl), an aryloxy group (e.g., phenoxy and naphthyloxy), a heterocyclic group (e.g., 2-pyridyloxy), or an acyloxy group (e.g., acetoxy and benzoyloxy).

In formula (II), $R_{22}$ and $R_{23}$ each represent an alkyl group (e.g., methyl, ,ethyl, butyl, dodecyl, tertoctyl, and cyclohexyl), ,an alkenyl group (e.g., vinyl and allyl), or a heterocyclic group (e.g., 2-pyridyl and 2,4,6-triazinetriyl).

The alkyl group, alkenyl group, aryl group, heterocyclic group, etc., shown by $R_{21}$, $R_{22}$, and $R_{23}$ may be substituted by the groups defined for R12 described above, or a hydroxy group, a cyano group, an aryl group or a phosphoric acid group.

$R_{21}$, $R_{22}$, and $R_{23}$ may combine with each other to form a 5-membered to 8-membered ring, the ring may be a monocyclic ring or a condensed ring formed by the condensation of plural rings, the 5-membered ring or 6-membered ring is preferred.

The sum of the carbon atoms of $R_{21}$, $R_{22}$, and $R_{23}$ is at least 10, and preferably from 12 to 50.

When $R_{22}$ or $R_{23}$ of formula (II) is a heterocyclic ring, the compound of formula (II) is preferably a compound shown by following formula (V)

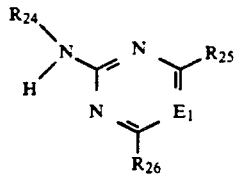

(V)

wherein $R_{24}$ has the same values as defined above for $R_{23}$; $R_{25}$ and $R_{26}$ each represents a hydrogen atom, a halogen atom, a hydroxy group, a cyanothio group, a nitro group, a cyano group or a substituted or unsubstituted alkyl, aryl, alkoxy, aryloxy, heterocyclicoxy, acylamino, alkylamino, arylamino, heterocyclic amino, ureido, sulfonamido, sulfamoylamino, N-imido, alkylthio, arylthio, heterocyclic thio, alkoxycarbonylamino, aryloxycarbonylamino, carbamoyl, sulfamoyl, sulfonyl, sulfinyl, acyl, alkoxycarbonyl, aryloxycarbonyl, phosphonyl, imino, acyloxy, or sulfonyloxy group; and $E_1$ represents a methine group,

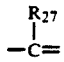

or —N=(wherein $R_{27}$ has the same values as defined above for $R_{25}$ and $R_{26}$.

In formula (V), $E_1$ is preferably —N=.

When $R_{22}$ and $R_{23}$ in formula (II) combine with each other to form a ring, the compound of formula (II) is preferably the compound shown by following formula (VI);

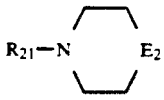

(VI)

wherein $R_{21}$ has the same values as defined in formula (II) and $E_2$ represents a simple bond, $—CH_2—$, $>N—R_{28}$, —O—, or $—SO_n—$(wherein $R_{28}$ has the same values as defined for $R_{21}$, and n represents an integer of from 0 to 2).

In the above formula, the ring shown by

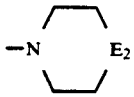

may have a substituent, may form a condensed ring with another ring ($R_{21}$ and $R_{28}$ may form together the ring), or may form a double bond by the adjacent carbon atoms thereof.

In formula (II) described above, $R_{21}$, $R_{22}$, and $R_{23}$ each is preferably an alkyl group which may be substituted.

Specific examples of the amines useful in this invention, as shown by formula (II) described above, are illustrated below but the invention is not limited to these compounds.

$(C_{18}H_{37})_3N$ (A-1)

$C_{12}H_{25}N(CH_2CH_2OH)_2$ (A-2)

$(C_8H_{17})_3N$ (A-3)

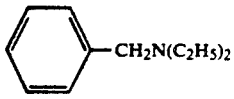

(A-4)

-continued

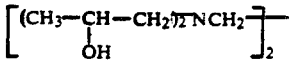

(A-5)

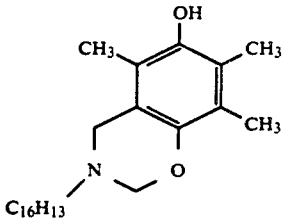

(A-6)

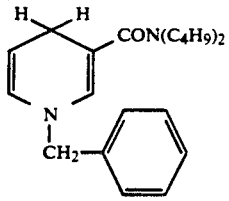

(A-7)

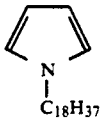

(A-8)

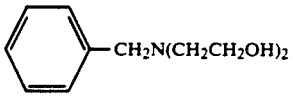

(A-9)

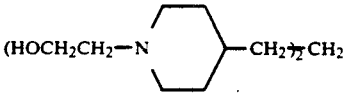

(A-10)

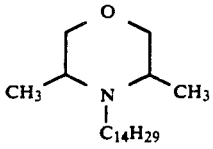

(A-11)

$(C_{18}H_{37})_2NH$ (A-12)

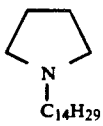

(A-13)

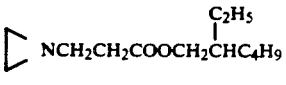

(A-14)

$(CH_3)_2N(CH_2)_2OP(OC_2H_5)_2$ (A-15)

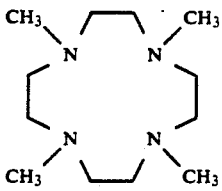

(A-16)

-continued
(A-17)
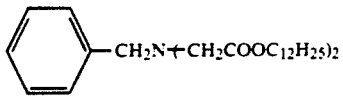
(A-18)
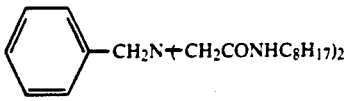
$C_{18}H_{37}N(CH_2CH_2OC_6H_{13})_2$ (A-19)
(A-20)
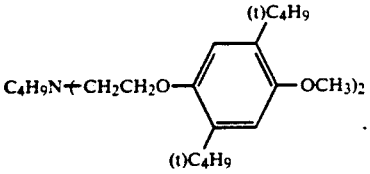
$C_2H_5N(CH_2CH_2SO_2C_6H_{13})_2$ (A-21)
(A-22)
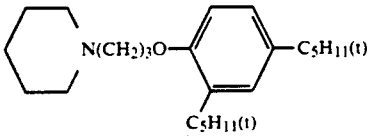
(A-23)
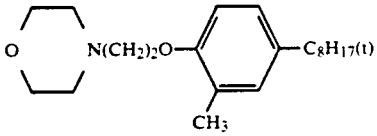
$(C_8H_{17})_2NCH_2CH_2CN$ (A-24)
$C_{16}H_{33}N(CH_2CH{=}CH_2)_2$ (A-25)
(A-26)
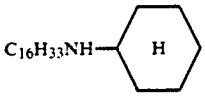
(A-27)
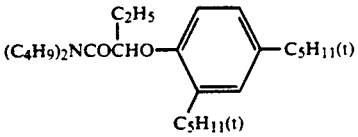
(A-28)
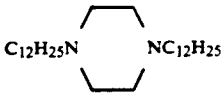
(A-29)
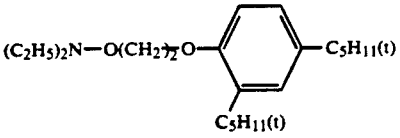
(A-30)
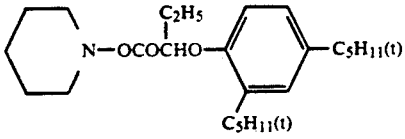
-continued
(A-31)
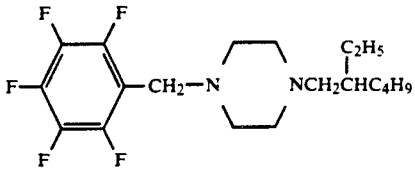
(A-32)
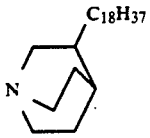
(A-33)
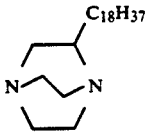
(A-34)
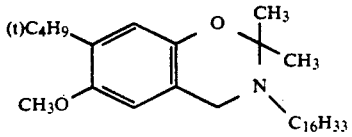
(A-35)
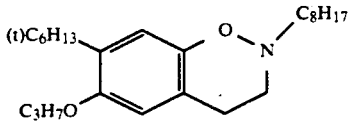
(A-36)
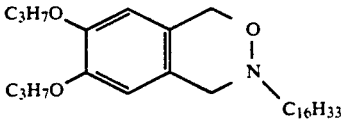
(A-37)
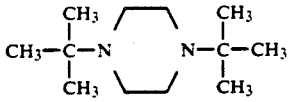
(A-38)
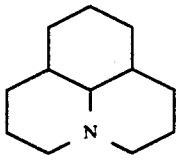
(A-39)
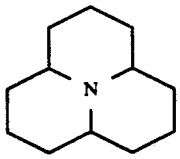
(A-40)
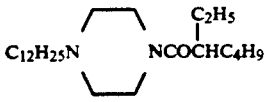
(A-41)
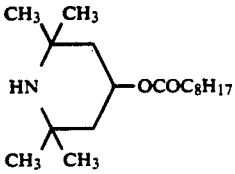

-continued
(A-42)
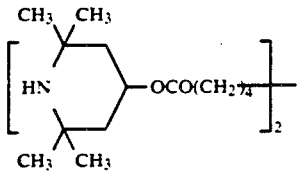
(A-43)
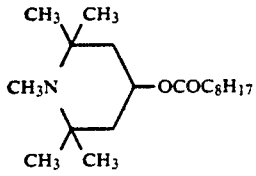
(A-44)
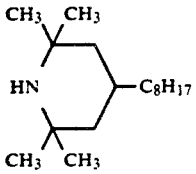
(A-45)
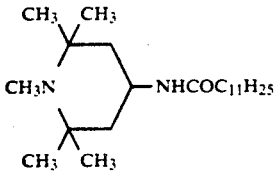
(A-46)
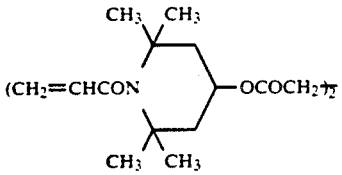
(A-47)
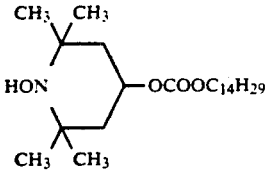
(A-48)
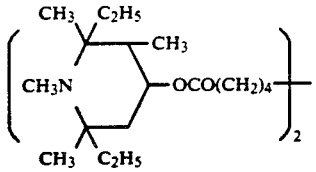
(A-49)
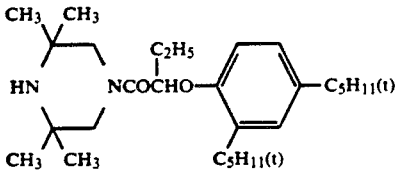
(A-50)
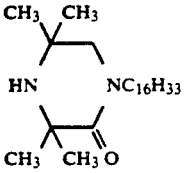
-continued
(A-51)
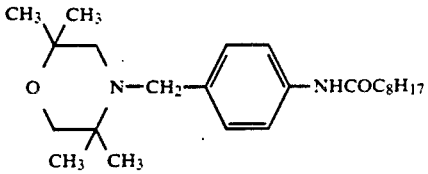
(A-52)
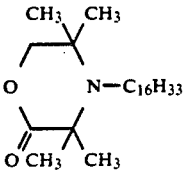
(A-53)
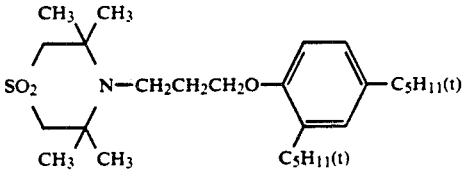
(A-54)
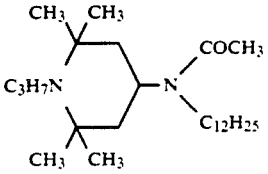
(A-55)
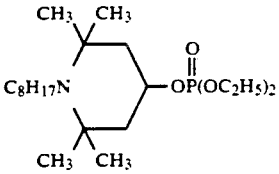
(A-56)
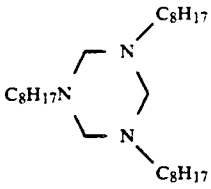
(A-57)
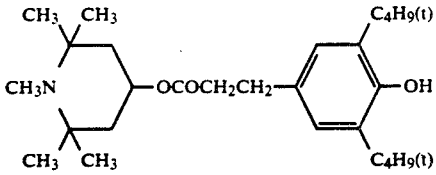
(A-58)
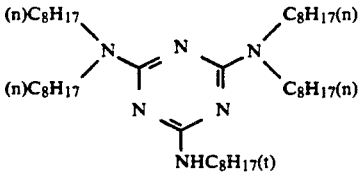
(A-59)
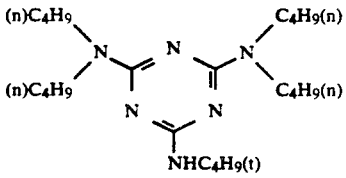

-continued
(A-60)
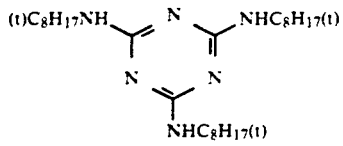
(A-61)
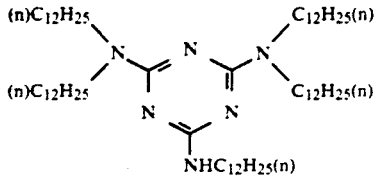
(A-62)
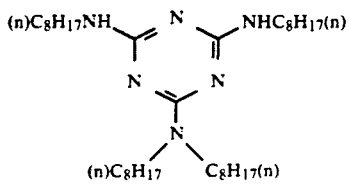
(A-63)
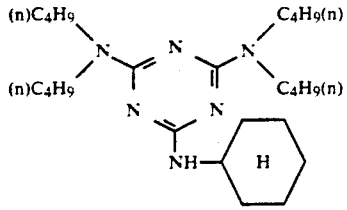
(A-64)
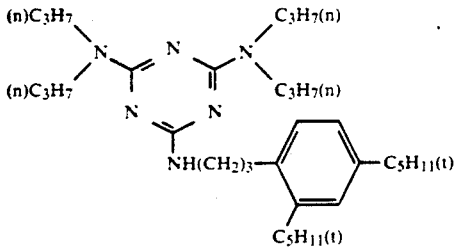
(A-65)
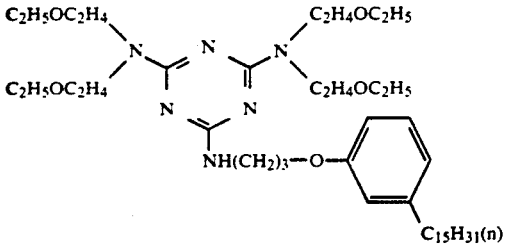
(A-66)
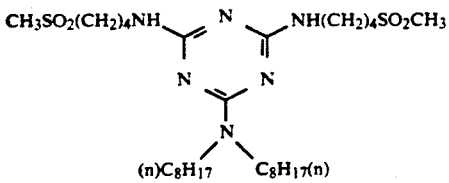
(A-67)
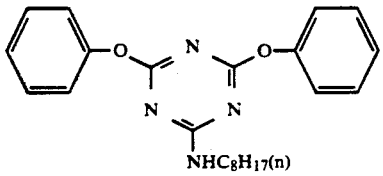
-continued
(A-68)
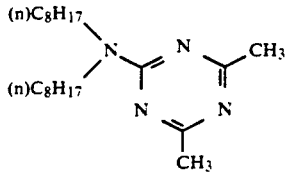
(A-69)
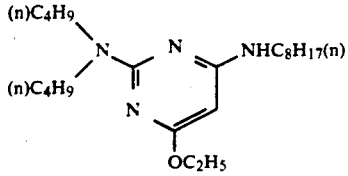
(A-70)
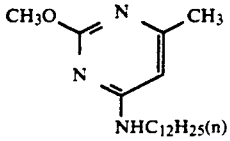
(A-71)
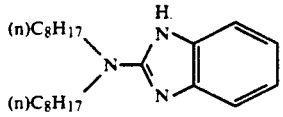
(A-72)
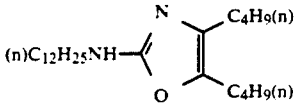
(A-73)
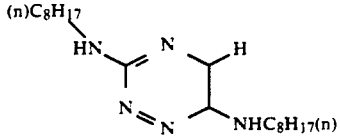
(A-74)
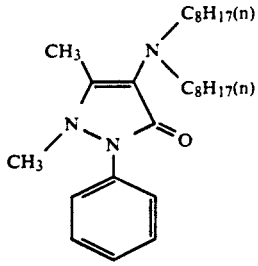
(A-75)
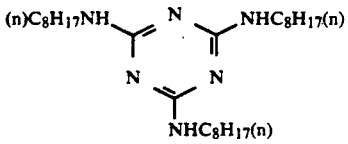
(A-76)
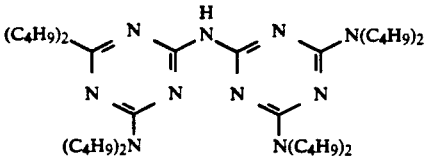
(A-77)
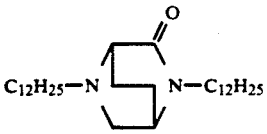

-continued (A-78)

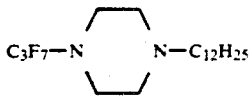

(A-79)

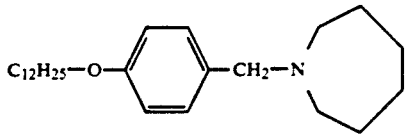

(A-80)

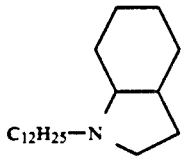

(A-81)

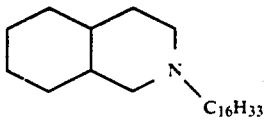

The compounds shown by formula (II) described above are known compounds or can be synthesized by known methods. For example, the compounds shown by formula (V) can be synthesized by the methods described in JP-A-218445.

The magenta coupler shown by formula (I) described above is incorporated in a silver halide emulsion layer in an amount of from $2\times10^{-3}$ mol to $5\times10^{-1}$ mol, and preferably from $1\times10^{-2}$ mol to $5\times10^{-1}$ mol per mol of silver in the emulsion layer.

On the other hand, the compound shown by formula (II) is, used in an amount of from $1\times10^{-2}$ to 10 mols, and preferably from $3\times10^{-2}$ to 5 mols per mol of the magenta coupler.

The compound shown by formula (II) is incorporated in the photographic light-sensitive material during the production of the light-sensitive material, during development processing of the light-sensitive material, or after development processing of the light-sensitive material. In particular, the aforesaid compound having a low molecular weight or being easily soluble in water is preferably added to a processing solution and incorporated in the photographic light-sensitive material during or after development processing of the light-sensitive material.

Also, the compound shown by formula (II) may be used as a high-boiling solvent for dispersing coupler.

Color photographic light-sensitive material useful with this invention can have a structure, wherein, on a support at least one blue-sensitive silver halide emulsion layer, at least one green-sensitive silver halide emulsion layer, and at least one red-sensitive silver halide emulsion layer exist. In an ordinary color photographic paper, the silver halide emulsion layers are usually formed on such a support in the aforesaid order but other orders of the emulsion layers may be employed. A color reproduction, by a subtractice color process, can be performed by using silver halide emulsions each having a sensitivity to each wavelength region and so-called color couplers forming dyes in complementary color relations with light sensitive to the emulsions, that is, a yellow dye for blue, a magenta dye for green, and a cyan dye for red for the light-sensitive emulsion layers. The light-sensitive emulsion layers may not have the aforesaid construction in which they correspond to colored hues of the couplers.

As to the silver halide emulsion for use in this invention, an emulsion composed of a silver halide containing substantially no silver iodide, such as silver chlorobromide and silver chloride is preferably used. The term "containing substantially no silver iodide" means the silver halide wherein the content of silver iodide is less than 1 mol %, and preferably less than 0.2 mol %. The halogen composition of the silver halide emulsion may be different or same among silver halide grains, but when a silver halide emulsion exists having a same halogen composition among the grains, the properties of the silver halide grains can be easily homogenized. Also, as to the halogen composition distribution in the insides of silver halide grains of a silver halide emulsion, so-called homogeneous type structure grains have a same halogen composition in every portions of the silver halide grains; so-called multilayer type structure grains having different halogen compositions between the core or the inside of the silver halide grains and the shell (one layer or plural layers) surrounding the core; or the grains which may have a structure having a non-layer form portion having a different halogen composition in the inside, or on the surface of the silver halide grains (when the portion is at the surface of the grains, the portion having a different composition is junctioned to the edges, corners, or the plane of the grains) may be properly used. For obtaining a high sensitivity, the use of the latter two types of emulsions is more advantageous than the use of the former homogeneous type structure grains and the use of the latter types is also preferred from the view point of pressure resistance. When the silver halide grains have the aforesaid structure, the area between the portions having a different halogen composition may be a distinct boundary, or an indistinct boundary forming mixed crystals by the difference in halogen composition, or may have a continuously changing structure positively formed.

For the halogen composition of the silver chlorobromide emulsion, an optional silver bromide/ silver chloride ratio can be employed. The ratio can be selected in a wide range according to the purposes desired, but it is preferred that the proportion of silver chloride is at least 2%.

Also, for the photographic light-sensitive material suitable for quick processing, a so-called high silver chloride emulsion having a high content of silver chloride is preferably used. In such a high silver chloride emulsion, the content of silver chloride is preferably at least 90 mol %, and more preferably at least 95 mol %.

For such a high silver chloride emulsion, the aforesaid structure of having a silver bromide localized phase in the inside of the silver halide grains and/or on the surface thereof inlayer(s) or in non-layer form as described above is preferred. The halogen composition of the aforesaid localized phase is preferably at least 10 mol %, and more preferably over 20 mol % in the content of silver bromide. Also, the silver bromide localized phase can exist in the inside of the silver halide grain, at the edges or corners of the grain surface, or on the plane of the grain surface. However, in a preferred embodiment, such a localized phase is epitaxially grown at the corner portions of the grains.

On the other hand, for inhibiting the reduction of sensitivity in the case of applying a pressure onto the photographic light-sensitive material as completely as possible, it is preferred in a high silver chloride content emulsion having a silver chloride content of at least 90 mol % to use the grains of the homogeneous type structure having a small distribution of the halogen composition in the grains.

Also, for reducing the amount of the replenishers for processing solutions, it is effective to further increase the silver chloride content of the silver halide emulsion. In such a case, an almost pure silver chloride emulsion having a silver chloride content of from 98 mol % to 100 mol % is preferably used.

The mean grain size (shown by the number average of the diameters of circles equivalent to the projected areas of the grains) of the silver halide grains contained in the silver halide emulsion for use in this invention is preferably from 0.1 μm to 2 μm.

Also, the silver halide emulsion for use in this invention is preferably also a so-called monodispersed emulsion having a coefficient of variation (the standard deviation of the grain size divided by the mean grain size) of 20% or less, and preferably 15% or less. In this case, for obtaining a broad latitude, it is preferably practiced to use the aforesaid mono-dispersed emulsion for a same emulsion layer as a blend thereof or to use the aforesaid emulsion as multilayer.

The silver halide grains for use in this invention may have a regular crystal form such as cubic, octahedral, tetradecahedral, etc., an irregular crystal form such as spherical, tabular, etc., or a composite form thereof. Also, the silver halide grains may be a mixture of grains having the various crystal forms. In this invention, it is preferred that the content of the aforesaid regular crystals is at least 50%, preferably at least 70%, and more preferably at least 90%.

Also, a silver halide emulsion wherein the tabular silver halide grains having a mean aspect ratio (i.e., circular-calculated diameter/thickness) of at least 5, and preferably at least 8 is over 50% of the whole grains as the projected area can be preferably used.

The silver chlorobromide emulsions for use in this invention can be prepared using the methods described in P. Glafkides, *Chemie et Physique Photographique*, (published by Paul Montel, 1967), G. F. Duffin, *Photographic Emulsion Chemistry*, (published by Focal Press, 1966), V. L. Zelikman et al, *Making and Coating Photographic Emulsion*, (published by Focal Press, 1964).

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the existence of excess silver ions can be also used. As one system of the double jet method, a so-called controlled double jet method of keeping a constant pAg in a liquid phase of forming silver halide grains can be also used. According to the method, a silver halide emulsion containing silver halide grains having a regular crystal form and substantially homogeneous grain sizes can be obtained.

To the silver halide emulsions useful in this invention can be introduced various multivalent metal ion impurities during the formation or physical ripening of the emulsion grains. Examples of such compounds useful in the aforesaid case are salts of cadmium, zinc, lead, copper thallium, etc., or salts or complex salts of the metals belonging to group VIII of the periodic table, such as iron, luthenium, rhodium, palladium, osmium, iridium, platinum, etc. In particular, the salts or complex salts of the metals belonging to group VIII can be preferably used. The addition amount of the aforesaid compound depends upon the purpose but is preferably from $10^{-9}$ to $10^{-2}$ mol per mol of silver halide.

The silver halide emulsions useful in this invention are usually chemically sensitized and spectrally sensitized.

As the chemical sensitization, a sulfur sensitization typified by the addition of an unstable sulfur compound, a noble metal sensitization typified by gold sensitization, and a reduction sensitization can be used solely or as a combination thereof. As the compounds being used for the chemical sensitization, the compounds described in JP-A-62-215272, pages 18 to 22 can be preferably used.

The spectral sensitization is performed by imparting a spectral sensitivity for a desired wavelength region to the silver halide emulsion of each emulsion layer in the photographic light-sensitive material of this invention. In this invention, it is preferred to perform the spectral sensitization by adding a spectral sensitizing dye, i.e., a dye absorbing light of the wavelength region corresponding to the desired spectral sensitization. Examples of the spectral sensitizing dyes are those described in F. M. Harmer, *Heterocyclic Compounds-Cyanine Dyes and Relates Compounds*, published by John Wiley & Sons, 1964. Specific examples of the spectral sensitizing dyes which can be preferably used in this invention are described in aforesaid JP-A-62-215272, pages 22 to 38.

The silver halide emulsions for use in this invention can contain various compounds or the precursors therefor inhibiting the occurrence of fog during the production, storage, and/or processing of the photographic light-sensitive materials of this invention or stabilizing the photographic performance thereof. They are generally called photographic stabilizers. Specific examples of the preferred compounds are described in aforesaid JP-A-62-215272, pages 39 to 72.

The silver halide emulsion for use in this invention may be a so-called surface latent image type emulsion forming latent images mainly on the surfaces of the silver halide grains or a so-called inside latent image type emulsion forming latent images mainly in the inside of the grain.

For the color photographic light-sensitive material there are usually used a yellow coupler, a magenta coupler and a cyan coupler coloring in yellow, magenta, and cyan, respectively, by causing coupling with the oxidation product of an aromatic primary amine color developing agent.

In yellow couplers for use in this invention, acylacetamide derivatives such as benzoylacetanilide and pivaloylacetanilide are preferred.

In these derivatives, the yellow couplers shown by following formulae (Y-1) and (Y-2) are suitable.

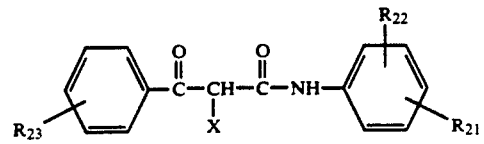

(Y-1)

-continued (Y-2)

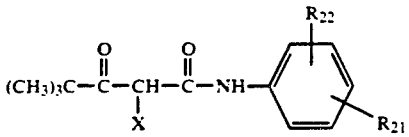

In the above formulae, X represents a hydrogen atom or a coupling releasable group; $R_{21}$ represents a non-diffusible group having a total carbon atom number of from 8 to 32; $R_{22}$ represents a hydrogen atom, one or more halogen atoms, a lower alkyl group, a lower alkoxy group, or a non-diffusible group having a total carbon atom number of from 8 to 32; $R_{23}$ represents ,a hydrogen atom or a substituent, and when two or more $R_{23}$s exist, they may be the same or different.

Details of the pivaloylacetanilide type yellow coupler are described in U.S. Pat. No. 4,622,287, from column 3, line 15 to column 8, line 39 and U.S. Pat. No. 4,623,616, from column 14, line 50 to column 19, line Details of the benzoylacetanilide type yellow coupler are described in U.S. Pat. Nos. 3,408,194, 3,933,501, 4,046,575, 4,133,958, and 4,401,752.

As specific examples of the pivaloylacetanilide type yellow coupler, are Compounds (Y-1) to (Y-39) described in U.S. Pat. No. 4,622,287, column 37 to column 54. In these compounds, Compounds (Y-1), (Y-4), (Y-6), (Y-7), (Y-15), (Y-21), (Y-22), (Y-23), (Y-26), (Y-35), (Y-36), (Y-37), (Y-38), and (Y-39) are preferred.

Also, other specific examples of the yellow coupler are Compounds (Y-1) to (Y-33) described in aforesaid U.S. Pat. No. 4,623,616, column 19 to column 24 and in these compounds, Compounds (Y-2), (Y-7), (Y-8), (Y-12), (Y-20), (Y-21), (Y-23), and (Y-29) are preferred.

Other preferred yellow couplers are Compound (34) described in U.S. Pat. No. 3,408,194, column 6, Compounds (16) and (19) described in U.S. Pat. No. 3,933,501, column 8, Compound (9) described in U.S. Pat. No. 4,046,575, columns 7 to 8, Compound (1) described in U.S. Pat. No. 4,133,958, columns 5 to 6, Compound 1 described in U.S. Pat. No. 4,401,752, column 5, and following compounds a) to h).

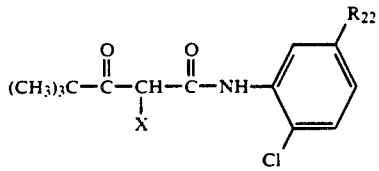

| Compound | $R_{22}$ | X |
|---|---|---|
| a | $-COOCH(CH_3)COOC_{12}H_{25}$ | 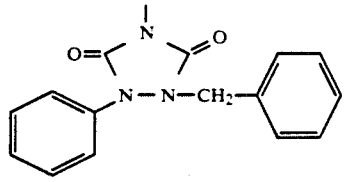 |
| b | $-COOCH(C_4H_9)COOC_{12}H_{25}$ | 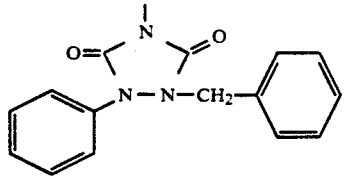 |
| c | 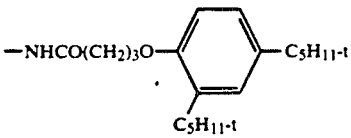 | 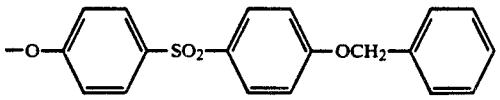 |
| d | 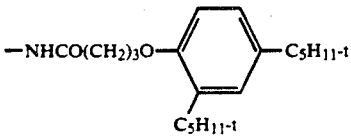 | 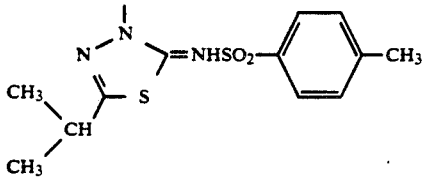 |

-continued

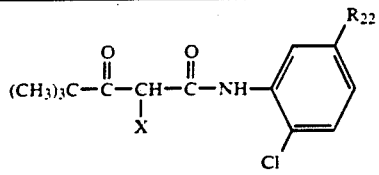

| Compound | $R_{22}$ | X |
|---|---|---|
| e | 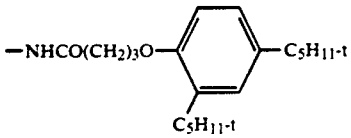 | 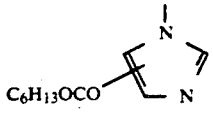 |
| f | $-NHSO_2C_{12}H_{25}$ | 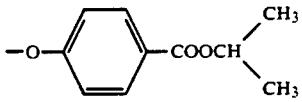 |
| g | $-NHSO_2C_{16}H_{33}$ | 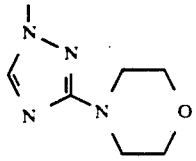 |
| h | 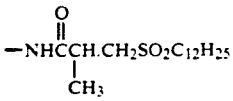 | 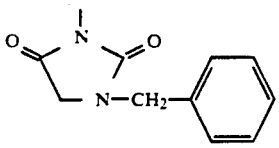 |

In the aforesaid couplers, the couplers having a nitrogen atom as a releasable atom are particularly preferred.

Also, as other magenta couplers which can be used together with the pyrazolone series magenta couplers defined in this invention, there are oil-protect type indazolone series and cyanoacetyl series magenta couplers, and preferably 5-pyrazolone series magenta couplers and pyrazoloazole series magenta couplers such as pyrazolotriazoles. In the 5-pyrazolone series magenta couplers, the couplers having an arylamino group or an acylamino group at the 3-position are preferred with respect to the hue and color density of colored dyes. Specific examples thereof are described in U.S. Pat. Nos. 2,311,082, 2,343,703, 2,600,788, 2,908,573, 3,062,653, 3,152,896, and 3,936,015. As the releasable group for the 2-equivalent 5-pyrazolone series magenta couplers, the nitrogen atom releasable groups described in U.S. Pat. No. 4,310,619 and the arylthio groups described in U.S. Pat. No. 4,351,897 are preferred. Also, 5-pyrazolone series magenta couplers having a ballast group described in European Patent 73,636 give high coloring density.

Pyrazoloazole series magenta couplers include pyrazolobenzimidazoles described in U.S. Pat. No. 2,369,879, preferably pyrazolo[5,1-c][1,2,4]triazoles described in U.S. Pat. No. 3,725,067, pyrazolotetrazoles described in *Research Disclosure*, No. 24220 (June 1984), and pyrazolopyrazoles described in *Research Disclosure*, No. 24230, (June 1984). The aforesaid couplers may be polymer couplers.

Specific examples of these magenta couplers are those shown by following general formula (M-1), (M-2), or (M-3).

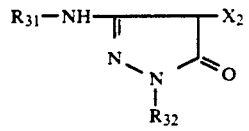

(M-1)

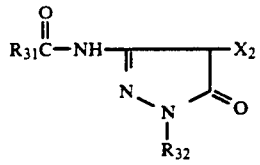

(M-2)

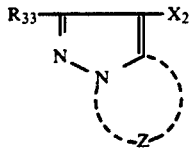

(M-3)

In the above formulae, $R_{31}$ represents a nondiffusible group having total carbon atom number of from 8 to 32; $R_{32}$ represents a phenyl group or a substituted phenyl group; $R_{33}$ represents a hydrogen atom or a substituent; Z represents a non-metallic atomic group necessary for forming a 5-membered azole ring including from 2 to 4 nitrogen atoms, said azole ring may have a substituent (including a condensed ring); and $X_2$ represents a hydrogen atom or a releasable group. Details of the substituent for $R_{33}$ and the substituent for the azole ring are described in U.S. Pat. No. 4,540,654, column 2, line 41 to column 8, line 27.

In the pyrazoloazole series magenta couplers, the imidazo[1,2-b]pyrazoles described in U.S. Pat. No. 4,500,630 are preferred and pyrazolo[1,5-b][1,2,4]triazole described in U.S. Pat. No. 4,540,654 are particularly preferred from the points of less yellow side absorption and light fastness of the colored dye formed thereof.

Other examples of the pyrazoloazole series couplers are the pyrazolotriazole couplers wherein a branched alkyl group is directly bonded to the 2, 3, or 6-position of the pyrazolotriazole ring as described in JP-A-61-65245, the pyrazoloazole couplers having a sulfonamido group in the molecule as described in JP-A-61-65246, the pyrazoloazole couplers having an alkoxyphenylsulfonamide ballast group as described in JP-A-61-147254, and the pyrazolotriazole couplers having an alkoxy group or an aryloxy group at the 6-position as described in European Patent (unexamined published) Application 226,849.

Specific examples of these magenta couplers are illustrated below.

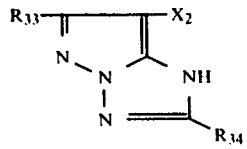
| Compound | $R_{33}$ | $R_{34}$ | $X_2$ |
|---|---|---|---|
| 1 | $CH_3$— | 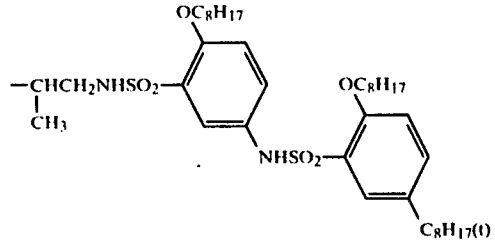 | Cl |
| 2 | $CH_3$— | 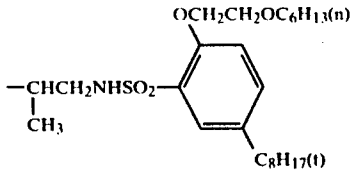 | Cl |
| 3 | $CH_3$— | 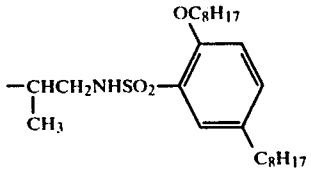 | 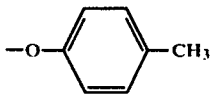 |
| 4 | 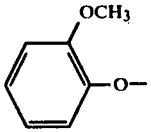 | 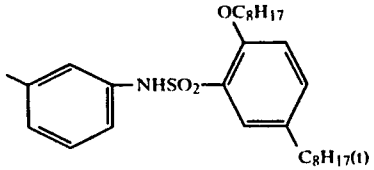 | 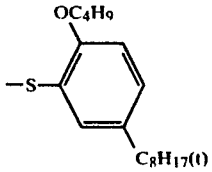 |

-continued
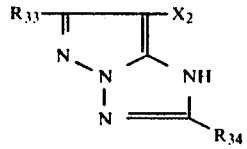
| Compound | $R_{33}$ | $R_{34}$ | $X_2$ |
|---|---|---|---|
| 5 | $CH_3$— | 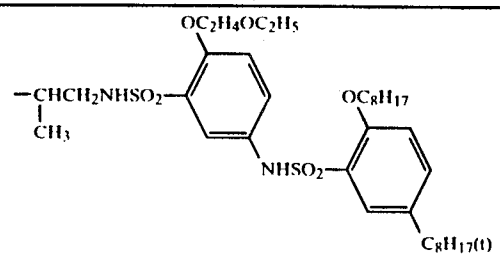 | Cl |
| 6 | $CH_3$— | 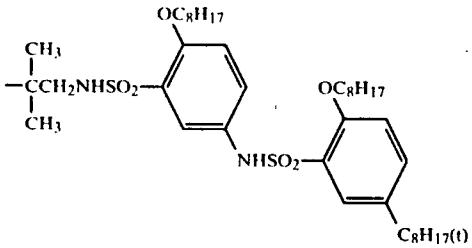 | Cl |
| 7 | 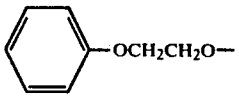 | 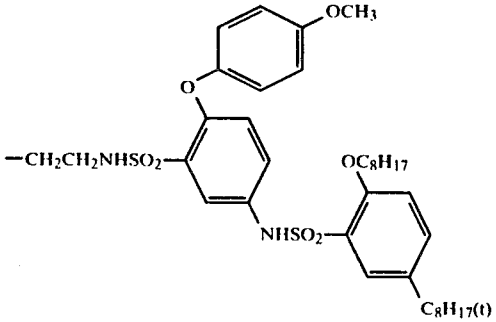 | 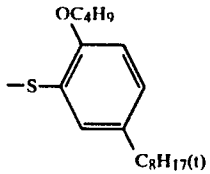 |
| 8 | $CH_3CH_2O$— | as above | as above |

-continued
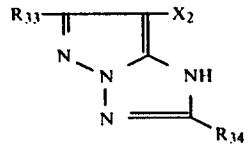
| Compound | $R_{33}$ | $R_{34}$ | $X_2$ |
|---|---|---|---|
| 9 | 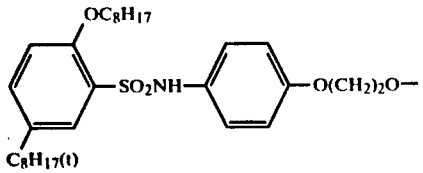 | 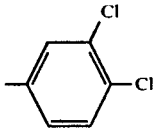 | 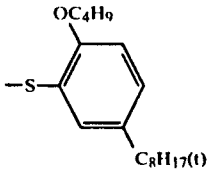 |
| 10 | 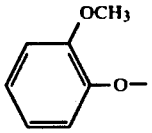 | 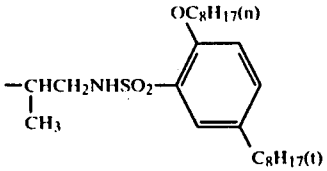 | Cl |
| 11 | $CH_3$— | 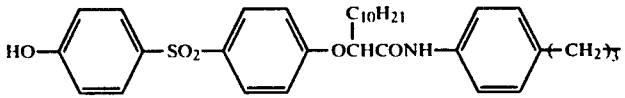 | Cl |
| 12 | $CH_3$— | 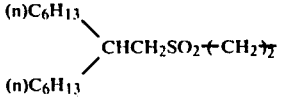 | Cl |
| 13 | 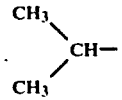 | 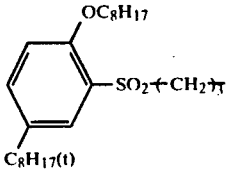 | Cl |
| 14 | 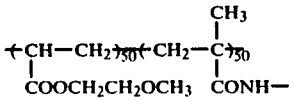 | 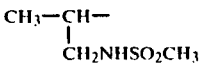 | as above |

-continued
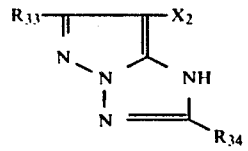
| Compound | $R_{33}$ | $R_{34}$ | $X_2$ |
|---|---|---|---|
| 15 | 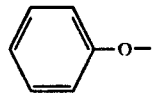 | 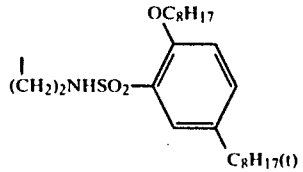 | Cl |
| 16 | 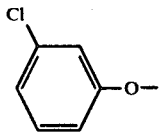 | 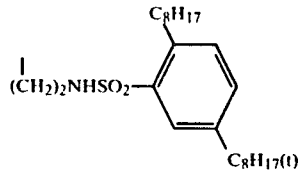 | 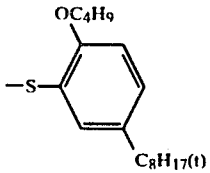 |

As the cyan couplers for use in this invention, phenolic cyan couplers and naphtholic cyan couplers are most typical.

As the cyan couplers, there are the cyan couplers (including polymer couplers) having an acylamino group at the 2-position of the phenol nucleus and an alkyl group at the 5-position thereof as described in U.S. Pat. Nos. 2,369,929, 4,518,687, 4,511,647, and 3,772,002 and specific examples thereof are the coupler in Example 2 described in Canadian Patent 625,822, Compound (1) described in U.S. Pat. No. 3,772,002, Compounds (I-4) and (I-5) described in U.S. Pat. No. 4,564,590, Compounds (1), (2), (3), and (24) described in JP-A-61-39045, and Compound (C-2) described in JP-A-62-70846.

As the phenolic cyan coupler, there are 2,5-diacylaminophenolic couplers described in U.S. Pat. No. 2,772,162, 2,895,826, 4,334,011, and 4,500,653, and JP-A-59-164555 and specific examples thereof are Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396 and Compound (I-19) described in U.S. Pat. No. 4,613,564.

As other phenolic cyan couplers, there are the cyan couplers wherein a nitrogen-containing heterocyclic ring is condensed to the phenol nucleus as described in U.S. Pat. Nos. 4,372,173, 4,564,586, and 4,430,423, JP-A-61-390441, and Japanese Patent Application No. 61-100222 and specific examples thereof are Couplers (1) and (3) described in U.S. Pat. No. 4,327,173, Compounds (3) and (16) described in U.S. Pat. No. 4,564,586, Compounds (1) and (3) described in U.S. Pat. No. 4,430,423 and also the following compounds.

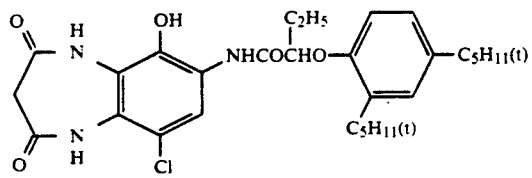

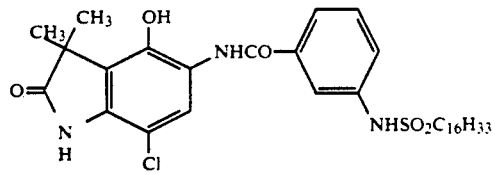

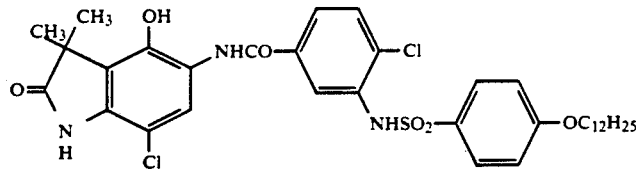

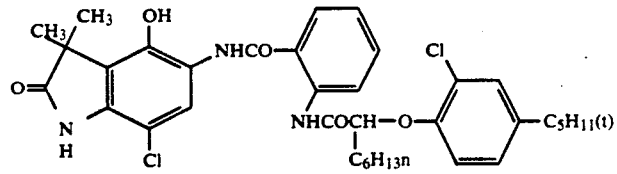

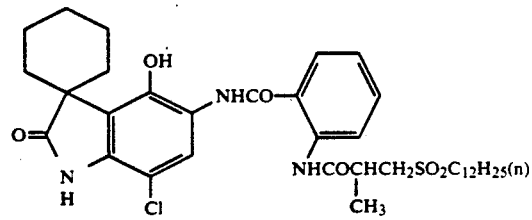

-continued
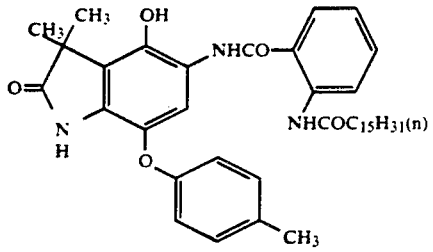
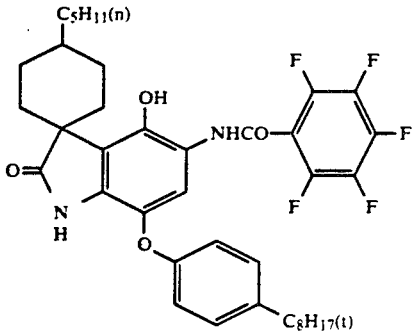
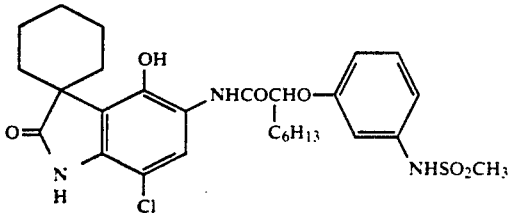
As other cyan couplers than the aforsaid cyan couplers, there are the diphenylimidazole series cyan couplers described in European Patent (unexamined published) Application EP 0,249,453A2, such as shown below.
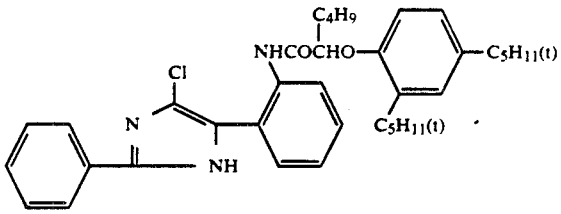
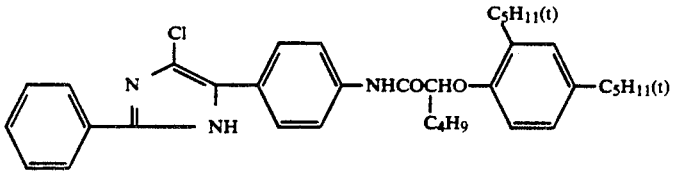
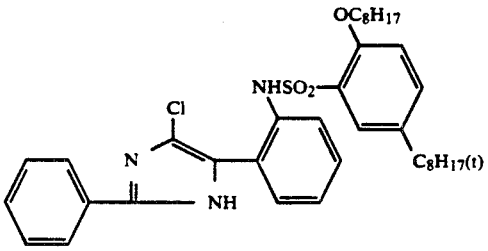

-continued

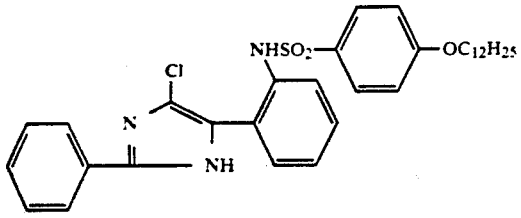

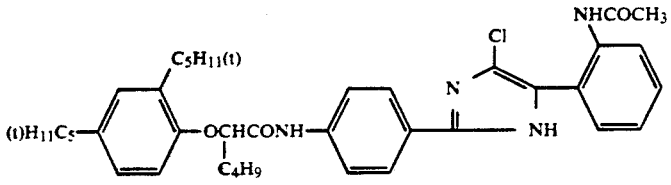

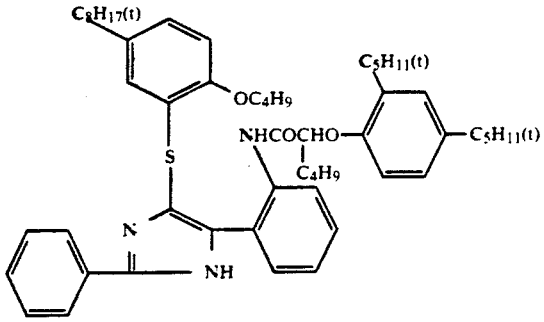

As still other phenolic cyan couplers, there are the ureido series cyan couplers described in U.S. Pat. Nos. 4,333,999, 4,451,559, 4,444,872, 4,427,767, 4,579,813, and European Patent (EP) 067,689B1and specific examples thereof are Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1, and Coupler (3) described in JP-A-61-42658.

As the naphtholic cyan couplers for use in this invention, there are cyan couplers having an N-alkyl-N-arylcarbamoyl group at the 2-position of the naphthol nucleus as described in U.S. Pat. No. 2,313,586, the cyan couplers having a alkylcarbamoyl group at the 2-position of the naphthol nucleus as described in U.S. Pat. Nos. 2,474,293 and 4,282,312, the cyan couplers having an arylcarbamoyl group at the 2-position of the naphthol nucleus as described in JP-B-50-14523 (the term "JP-B" as used herein means an "examined published Japanese patent application"), the cyan couplers having a carbonamido group or a sulfonamido group at the 5-position of the naphthol nucleus as described in JP-A-60-237448, 61-145557, and 61-153640), the cyan couplers having an aryloxy releasable group as described in U.S. Pat. No. 3,476,563, the cyan couplers having a substituted alkoxy releasable group as described in U.S. Pat. No. 4,296,199, and the cyan couplers having a glycol acid releasable group as described in JP-A-60-39217.

These couplers can be incorporated in a silver halide emulsion layer be dispersing in the emulsion with at least one of high-boiling organic solvents, such as, preferably the high boiling organic solvents shown by following formulae (A) to (E);

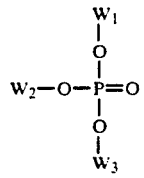

(A)

$W_1-COO-W_2$ (B)

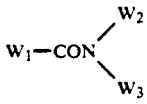

(C)

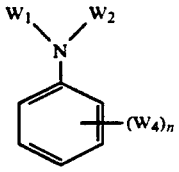

(D)

$W_1-O-W_2$ (E)

In the above formulae, $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S-W_1$; and n represents an integer of from 1 to 5, when n is 2 or more, $W_4$s may be the same or different, and in formula (E), $W_1$ and $W_2$ may combine with each other to form a condensed ring.

Also, the aforesaid couplers may be caused to be permeated into a loadable latex polymer in the existence or absence of the aforesaid high-boiling organic solvent (as described in U.S. Pat. No. 4,203,716) or may be dispersed in an aqueous solution of a hydrophilic colloid as a solution in a polymer which is insoluble in water and soluble in an organic solvent.

As the polymers, the homopolymers or copolymers described in PCT Application (unexamined published) WO 88/00723, pages 12 to 30 are used, and in particular, acrylamide series polymers are preferred with respect to color image stability.

The photographic light-sensitive materials of this invention may contain hydroquinone derivatives, aminophenol derivatives, gallic acid derivatives, ascorbic acid derivatives, etc., as color fog inhibitors.

For the photographic light-sensitive materials of this invention can be used various fading inhibitors. That is, an organic fading inhibitors for cyan, magenta, and/or yellow images, there are hydroquinones, 6-hydroxychromans, 5 hydroxycoumarans, spirochromans, spiroindanes, p-alkoxyphenols, hindered phenols (such as bisphenols), gallic acid derivatives, methylenedioxybenzenes, aminophenols, hindered amines, and the ether or ester derivatives obtained by silylating or alkylating the phenolic hydroxy groups of the aforesaid compounds. Also, metal complexes such as (bissalicylaldoxymate)-nickel complexes and (bis-N,N-dialkyldithiocarbamate)nickel complexes can be used.

Specific examples of the organic fading inhibitors described above are as follows.

That is, the hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, U.S. Pat. Nos. 2,710,801 and 2,816,028; the 6-hydroxychromans, 5-hydroxycoumarans, and spirochromans are described in U.S. Pat. Nos. 3,432,300, 3,573,050, 3,574,627, 3,698,909, and 3,764,337, and JP-A-52-152225; the spiroindanes are described in U.S. Pat. No. 4,360,589; the p-alkoxyphenols are described in U.S. Pat. No. 2,735,765, British Patent 2,066,975, JP-A-59-10539, JP-B-57-19765; the hindered phenols are described in U.S. Pat. Nos. 3,700,455 and 4,228,235, JP-A-52-72224, and JP-B-52-6623; the gallic acid derivatives, methylenedioxybenzenes, and aminophenols are described in U.S. Pat. Nos. 3,457,079 and 4,332,886, and JP-B-56-21144, respectively; the hindered amines are described in U.S. Pat. Nos. 3,336,135 and 4,268,593, British Patents 1,326,889, 1,354,313, and 1,410,846, JP-B-51-1420 and JP-A-58-114036, JP-A-59-53846, and JP-A-59-78344; the ether and ester derivatives of the phenolic hydroxy groups are described in U.S. Pat. Nos. 4,155,765, 4,174,220, 4,254,216, 4,264,720, and 4,279,990, JP-A-54-145530, JP-A-55-6321, JP-A-58-105147, and JP-A-59-10539, JP-B-57-37856 and JP-B-53-3263; and the metal complexes are described in U.S. Pat. Nos. 4,050,938 and 4,241,155 and British Patent 2,027,731A.

By incorporating the aforesaid compounds in an emulsion with each corresponding color coupler in an amount of from 5 to 100% by weight based on the amount of the color coupler in each light-sensitive emulsion layer, objects of the present invention can be attained.

For inhibiting the deterioration of cyan dye images by heat and, in particular, light, it is effective to introduce a ultraviolet absorbent in layers adjacent to both the surfaces of a cyan coloring emulsion layer.

In the aforesaid fading inhibitors, spiroindanes and hindered amines are particularly preferred.

The photographic light-sensitive materials of this invention may contain ultraviolet absorbents in the hydrophilic colloid layers. As the ultraviolet absorbents, there are benzotriazole compounds having an aryl group as a substituent as described in U.S. Pat. No. 3,533,794, 4-thiazolidone compounds as described in U.S. Pat. Nos. 3,314,794 and 3,352,681, benzophenone compounds described in JP-A-46-2784, cinnamic acid ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

As ultraviolet absorbents, ultraviolet absorptive couplers (e.g., naphtholic cyan dye forming couplers) and ultraviolet absorptive polymers can be used. These ultraviolet absorbents may be mordanted to specific layers.

The photographic light-sensitive materials of this invention may further contain water-soluble dyes in hydrophilic colloid layers as filter dyes or other various purposes such as in irradiation inhibition, etc. Such dyes include oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloid for the emulsion layers of the photographic light-sensitive materials of this invention, gelatin is advantageously used but other hydrophilic colloids can be used solely or together with gelatin.

Gelatin for use in this invention may be limed gelatin or gelatin treated by an acid. Details of the production of gelatin are described in Arther Vaise, *The Macromolecular Chemistry of Gelatin*, published by Academic Press, 1964.

As the support for use in this invention, transparent films such cellulose nitrate films and polyethylene terephthalate films or reflection type supports, which are usually used for photographic light-sensitive materials, can be used. For the purpose of this invention, the use of reflection type supports is more preferred.

The term "reflective type support" in this invention means a support imparted with a high reflective property for clearing showing dye images formed in the silver halide emulsion layer(s). Such a reflection type support includes a support coated with a hydrophobic resin containing a light-reflective material such as titanium oxide, zinc oxide, calcium carbonate, calcium sulfate, etc., and a support composed of a hydrophobic resin containing the aforesaid light-reflective material.

For example, there are baryta-coated papers, polyethylene-coated papers, polypropylene series synthetic papers, transparent supports [such as, glass plates, polyester film (e.g., polyethylene terephthalate films, triacetyl cellulose films, and cellulose nitrate films), polyamide films, polycarbonate films, polystyrene films, polyvinyl chloride films, etc.] having thereon the aforesaid light reflective layer, and the supports composed of the aforesaid polymer film containing the aforesaid light-reflective material and these supports can be properly selected according to the purposes.

In the case of using the light-reflective material, it is preferred to knead well a white pigment as the light-reflective material in the existence of a surface active agent and also it is preferred to use pigment particles the surface of which was treated with a dihydric to tetrahydric alcohol.

The occupied area ratio (%) of the white pigment fine particles per definite unit area, in the case of using the pigment particles as the light-reflective material for the photographic light-sensitive material, can be obtained by dividing the observed area into adjacent unit areas each of 6 μm×6 μm and measuring the occupied area ratio (%) (Ri) of the fine particle projected onto the unit area. The variation coefficient of the occupied area ratio (%) can be obtained by $s/\overline{R}$, i.e., the ratio of the standard deviation s of Ri to the mean value ($\overline{R}$). The number (n) of the unit areas being measured is preferably at least 6. Accordingly, the coefficient of variation $s/\overline{R}$ can be obtained by the following formula $$\sqrt{\frac{\sum_{i=1}^{n}(Ri-R)^2}{n-1}} \Big/ \frac{\sum_{i=1}^{n} Ri}{n}$$

In this invention, the variation coefficient of the occupied area ratio (%) of the fine pigment particles is preferably 0.15 or less, and particularly preferably 0.08 or less. When the coefficient of variation is 0.08 or less, it can be said that the dispersibility of the grain is substantially "homogeneous".

It is preferred that the color photographic light-sensitive material of this invention is, after imagewise exposure, then color developed, bleach-fixed (blixed), and washed (or stabilized). The bleach and fix may be separately performed in place of performing in one bath as described above.

When the color photographic materials are continuously processed, it is preferred that the amount of the replenisher for the developer is less from the view points of resource saving and low environmental pollution.

The amount of the replenisher for the color developer is preferably 200 ml or less, and more preferably 120 ml or less per square meter of the light-sensitive material. In this case, the replenisher amount is the amount of a replenisher for a color developer being replenished to the color developer and does not include the amounts of additives for correcting the deterioration of the color developer with the passage of time and the concentrated portion thereof. In addition, the additives include water being added for diluting the concentrated composition and a preservative which is liable to be deteriorated with the passage of time, or an alkali agent for increasing pH thereof.

A color developer which is used for developing the color photographic light-sensitive materials of this invention is an alkaline aqueous solution containing an aromatic primary amine color developing agent as the main component. As the color developing agent, p-aminophenol series compounds are useful but p-phenylenediamine series compounds are also preferably used. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochloride, and p-toluenesulfonates of the aforesaid anilines. These compounds can be used solely or as a combination thereof.

The color developer generally contains a pH buffer such as carbonates, borates, or phosphates of an alkali metal or a development inhibitor or an antifoggant such as bromides, iodides, benzimidazoles, benzothiazoles, and mercapto compounds. Also, if necessary, the color developer may further contain a preservative such as hydroxylamine, diethylhydroxylamine, hydrazine sulfites, phenylsemicarbazides, triethanolamine, catechol sulfonic acids, triethylenediamine-1,4-diazabicyclo[2,2,-2]octanes, etc.; an organic solvent such as ethylene glycol, diethylene glycol, etc.; a development accelerator such as benzyl alcohol, polyethylene glycol, quaternary ammonium salts, amines, etc.; a dye forming coupler, a competing coupler, a fogging agent such as sodium boron hydride, etc.; an auxiliary developing agent such as 1-phenyl-3-pyrazolidone, etc.; a tackifier, and a chelating agent such as aminopolycarboxylic acids, aminopolyphosphonic acids, alkylphosphonic acids, and phosphonocarboxylic acids. Specific examples of the chelating agent are ethylenediamineteraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and the salts thereof.

Also, when a reversal processing is applied, a color development is usually carried out after performing a black and white development. For the black and white developer, known black and white developing agents such as dihydroxybenzenes (e.g., hydroquinone), 3-pyrazolidones (e.g., 1-phenyl-3-pyrazolidone), and aminophenols (e.g., N-methyl-p-aminophenol) can be used solely or as a combination thereof.

The pH of the color developer or the black and white developer is generally from 9 to 12. Also, the replenisher amount of these developers depends upon the kind of the color photographic materials being processed but is generally 3 liters or less per square meter of the color photographic material. Also, the replenisher amount can be reduced 500 ml or less by reducing the bromide ion concentration in the replenisher. In the case of reducing the replenisher amount, it is preferred to reduce the contact area of the surface of the developer and air to inhibit the evaporation and air-oxidation of the developer. Also, the amount of the replenisher can be reduced by using a means of restraining the accumulation of bromide ions in the developer.

After color development, the photographic emulsion layers are usually bleached. The bleach process may be performed simultaneously with a fix process (blix process) or separately from a fix process. Furthermore, for quickening the processing, a blix process may be performed after bleach process. Moreover, a process of performing the bleach by continuous two baths, a process of performing a fix process before blix process, or a process of performing a bleach process after blixing can be optionally employed according to the purposes.

As the bleaching agent, compounds of multivalent metals such as iron(III), cobalt(III), chromium(VI), copper(II), etc., peracids, quinones, nitro compounds, etc., are used.

Typical examples of the bleaching agent are ferricyanides, perchromates, organic complex salts of iron(III) or cobalt(III) (e.g., the complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.; and the complex salts of citric acid, tartaric acid, malic acid, etc.), persulfates, hydrobromides, permanganates, and nitrobenzenes. In these compounds, aminopolycarboxylic acid iron(III) complex salts such as ethylenediaminetetraacetic acid iron(III) complex salts, etc., and persulfates are preferred from the viewpoints of quick processing and the prevention of environmental pollution. Furthermore, aminopolycarboxylic acid iron(III) complex salts are particularly useful for a bleach solution and blix solution.

The pH of the bleach solution or blix solution using the aminopolycarboxylic acid iron(III) complex salt is usually from 5.5 to 8 but for quickening the processing, a lower pH can be employed for the processing.

For the bleach solution, blix solution or the pre-bath thereof can be used, if necessary, a bleach accelerator. Specific examples of the useful bleach accelerator are the compounds having mercapto group or a disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure*, No. 17129 (July, 1978); thiazolidine derivatives described in JP-A-140129; thiourea derivatives described in JP-B-45-8506, JP-A-52-20832 and JP-A-53-32735, and U.S. Pat. No. 3,706,561; the iodides described in West German Patent 1,127,715 and JP-A-58-16235; polyoxyethylene compounds described in West German Patents 996,410 and 2,748,430; the compounds described in JP-A-49-42434, JP-A-49-59644, JP-A-53-94927, JP-A-54-35727, JP-A-55-26506, and JP-A-58-163940; and bromide ions.

In these compounds, the compounds having a mercapto group or a disulfide group are preferred in the viewpoint of showing a large bleach accelerating effect and in particular, the compounds described in U.S. Pat. No. 3,893,858, West German Patent 1,290,812, and JP-A-53-95630 are preferred. These bleach accelerators may be incorporated in the photographic light-sensitive materials. The aforesaid bleach accelerators are particularly effective in the case of bleaching the color photographic materials for camera use.

As the fixing agent, there are thiosulfates, thiocyanates, thioether series compounds, thioureas, a large amount of iodides, etc., but the use of thiosulfates is general and in particular, ammonium thiosulfate is most widely used.

As a preservative for the blix solution, sulfites, hydrogensulfites, or carbonyl sulfite addition products are preferably used.

After desilvering processing, the silver halide color photographic materials of this invention are generally washed and/or stabilized. The amount of wash water can be widely selected according to the characteristics of the photographic materials (e.g., materials such as couplers, etc.), the uses of the photographic materials, the temperature of wash water, the number (stage number) of wash tanks, the replenishing system such as countercurrent system or regular current system, and other various conditions. The relation of the number of wash tanks and the amount of water in a multistage countercurrent system can be obtained by the method described in *Journal of the Society of Motion Picture and Television Engineers*, Vol. 64, pages 248–253 (May, 1955).

By the multistage countercurrent system described in the aforesaid literature, the amount of wash water can be greatly reduced but the increase of the residence time of water in the tanks causes a problem that bacteria grows and floats, and attaches to the light-sensitive materials. In the processing color photographic materials of this invention, the process of reducing calcium ions and magnesium ions described in JP-A-62-288838 can be very effectively used as a means for solving the problem. Also, chlorine series antibacterial agents such as iodothiazolone compounds described in JP-A-57-8542, cyabendazoles, chlorinated sodium isocyanurates, etc., and also the antibacterial agents, such as benzotriazole, described in Hiroshi Horiguchi, *Sakkin Boobaizai no Kagaku* (*Chemistry of Antibacterial and Antifungal Agents*), *Biseibutsu no Mekkin, Sakkin Boobai Gijutsu* (*Antibacterial and Antifungal Techniques of Microorganism*), edited by Eisei Gijutsu Kai, and *Bookin-Boobaizai Jiten (Antibacterial and Antifungal Agent Hankbook)*, edited by Nippon Bookin Boobai Gakkai can be used.

The pH of wash water in processing of the photographic light-sensitive materials of this invention is from 4 to 9, and preferably from 5 to 9. The washing temperature and washing time can be suitably selected according to the characteristics and uses of the photographic materials but are generally selected in the ranges of from 20 seconds to 10 minutes at from 15° to 45° C., and preferably from 30 seconds to 5 minutes at from 25° to 40° C. Furthermore, the photographic materials of this invention can be directly processed by a stabilizer without being washed. For such a stabilization process, the processes described in JP-A-57-8543, JP-A-58-14834, and JP-A-60-220345 can be used.

Also, as the case may be, a stabilization process is applied after the aforesaid wash process and as an examples of such a stabilization, there is a stabilization bath containing formalin and a surface active agent, which is used as the final bath in processing of color photographic materials for camera use. The stabilizer can contain a chelating agent and an antifungal agent.

The overflow solution formed by replenishing wash water and/or stabilization solution described above can be reused for the desilvering steps, etc.

The silver halide color photographic materials of this invention may contain a color developing agent for simplifying and quickening the processing process. For the purpose, it is preferred to use various precursors for color developing agents. Examples of such precursors are indoaniline series compounds described in U.S. Pat. No. 3,342,597, Schiff base type compounds described in U.S. Pat. No. 3,342,599, *Research Disclosure*, No. 14850, and ibid., No. 151559, aldol compounds described in ibid., No. 13924, metal complex salts described in U.S. Pat. No. 3,719,492, and urethane series compound described in JP-A-53-135628.

The silver halide color photographic materials of this invention may contain various 1-phenyl-3-pyrazolidone compounds as described in JP-A-56-64339, JP-A-57-144547, and JP-A-58-115438.

The various processing solutions disclosed in this invention are used at temperatures of from 10° to 50° C., and typically from 33° to 38° C. However, a higher temperature can be employed for accelerating the processing to shorten the processing time and a lower temperature may be used for improving the image quality formed and improving the stability of processing solutions. Also, for saving silver of the photographic light-sensitive materials, processing using a cobalt intensification or hydrogen peroxide intensification described in West German Patent 2,226,770 and U.S. Pat. No. 3,674,499 may be employed.

For obtaining the excellent features of the silver halide photographic materials of this invention, it is preferred to process the photographic materials by a color developer containing substantially no benzyl alcohol and containing 0.002 mol/liter or less of bromide ions, within 2 minutes and 30 seconds or less of developing time.

The term "containing substantially no benzyl alcohol" in this invention means that the color developer contains 2 ml or less, preferably 0.5 ml or less of benzyl alcohol per liter of the color developer, and most preferably contains no benzyl alcohol.

EXAMPLE 1

A multilayer color photographic paper having the following layers on a paper support, both surface of which were coated with polyethylene, was prepared.

The coating compositions for the layers prepared is as follows.

In a mixture of 27.2 ml of ethyl acetate and 8.2 g of solvent (Solv-3) shown below were dissolved 19.1 g of yellow coupler (ExY), 4.4 g of a color image stabilizer (Cpd-1), and 0.7 g of a color image stabilizer (Cpd-7) shown below and the solution thus formed was dispersed by emulsification in 185 ml of 10% aqueous gelatin solution containing 8 ml of an aqueous solution of 10% sodium dodecylbenzenesulfonate. On the other hand, after adding two kinds of blue-sensitive sensitizing dyes each in an amount of $2.0\times10^{-4}$ per mol of silver halide to a silver chlorobromide emulsion (cubic grains having a mean grain size of 0.85 μm and a coefficient of variation of 0.07 and containing 1 mol % silver bromide based on the whole grain as a localized portion of the surface of the grain), the emulsion was subjected to a sulfur sensitizing. The emulsified dispersion described above was mixed with the silver chlorobromide emulsion and the composition of the mixture was adjusted as shown below to provide the coating composition for the 1st layer.

The coating compositions for the 2nd layer to 7th layer were also prepared in a similar manner to the case of preparing the coating composition for the 1st layer.

In addition, 1-oxy-3,5-dichloro-s-triazine sodium salt was used as a gelatin hardening agent for each layer.

The spectral sensitizing dyes used for the layers were as follows.

Blue-Sensitive Emulsion Layer:

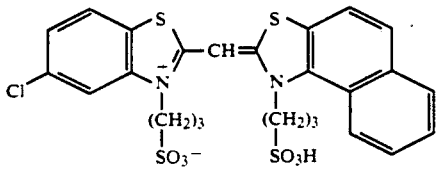

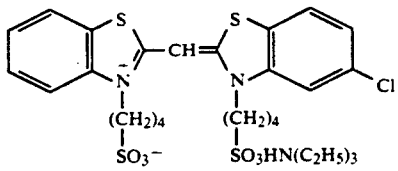

(aforesaid two kinds of dyes each in an amount of $2.0\times10^{-4}$ mol per mol of silver halide)

Green-Sensitive Emulsion Layer:

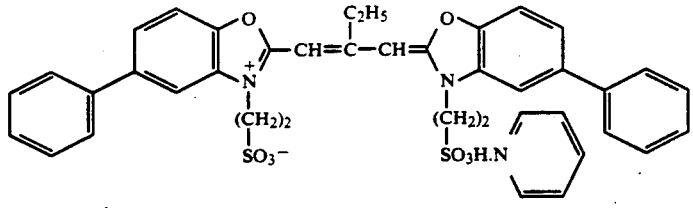

($4.0\times10^{-4}$ mol per mol of silver halide)

and

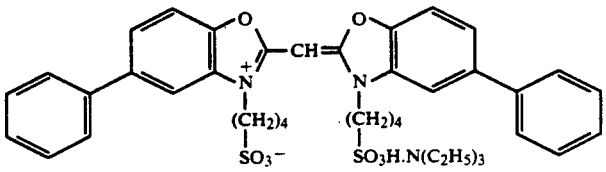

($7.0\times10^{-5}$ mol per mol of silver halide)

Red-Sensitive Emulsion Layer:

-continued

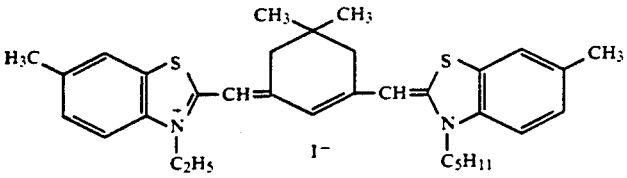

(0.9 × $10^{-4}$ mol per mol of silver halide)

To the red-sensitive emulsion layer was added the following compound in an amount of $2.6\times10^{-3}$ mol per mol of silver halide.

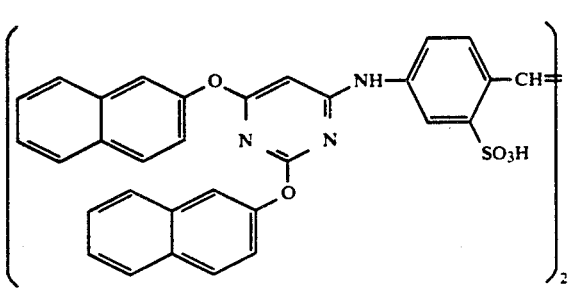

Also, to the blue-sensitive emulsion layer, the green-sensitive emulsion layer, and the red-sensitive emulsion layer was added 1-(5-methylureidophenyl)-5-mercaptotetrazole in the amounts of $8.5\times10^{-5}$ mol, $7.7\times10^{-4}$ mol, and $2.5\times10^{-4}$ mol, respectively, per mol of silver halide.

Also, the following dyes were added to each emulsion layer for irradiation prevention.

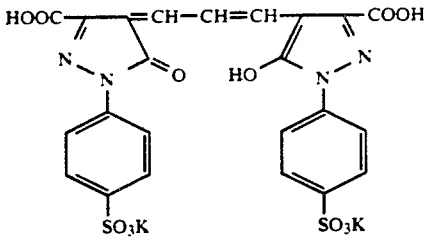

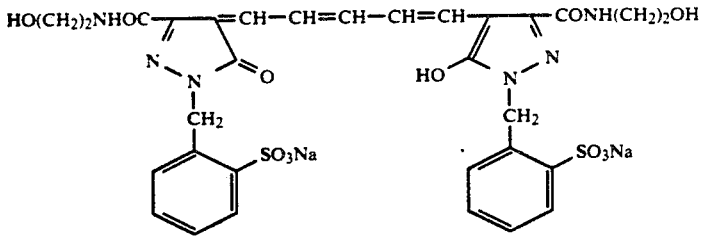

Layer Structure

The composition of each layer is shown below, in which the numeral is the coating amount (g/m$^2$) and the amount of silver halide emulsion is the amount calculated as silver.

Support

Polyethylene-coated paper [The polyethylene layer at the emulsion layer side contained a white pigment ($TiO_2$) and a bluish dye (ultramarine blue)].

| | |
|---|---|
| 1st Layer (Blue-Sensitive Emulsion Layer) | |
| Aforesaid Silver Halide Emulsion | 0.30 |
| Gelatin | 1.86 |
| Yellow Coupler (ExY) | 0.82 |
| Color Image Stabilizer (Cpd-1) | 0.19 |
| Color Image Stabilizer (Cpd-7) | 0.03 |
| Solvent (Solv-3) | 0.35 |
| 2nd Layer (Color Mixing Inhibition Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| 3rd Layer (Green-Sensitive Emulsion Layer) | |
| Silver Chloride Emulsion (cubic grains having mean grain size of 0.40 μm and variation coefficient of 0.09 and containing 1 mol % silver bromide based on the whole grains as a localized portion of the surface of the grain) | 0.20 |
| Gelatin | 1.24 |
| Magenta Coupler (Comparison Coupler (a)) | 0.29 |
| Color Image Stabilizer (Cpd-3) | 0.09 |
| Color Image Stabilizer (Cpd-4) | 0.06 |
| Solvent (Solv-2) | 0.32 |
| 4th Layer (Ultraviolet Absorptive Layer) | |
| Gelatin | 1.58 |
| Ultraviolet Absorbent (UV-1) | 0.47 |
| Color Mixing Inhibitor (Cpd-5) | 0.05 |
| Solvent (Solv-5) | 0.24 |
| 5th Layer (Red-Sensitive Emulsion Layer) | |
| Silver Chlorobromide Emulsion (cubic grains having mean grain size of 0.36 μm and variation coefficient of 0.11 and containing 1.6 mol % silver bromide based on the whole grains as a localized portion of the surface of the grain) | 0.21 |
| Gelatin | 1.34 |
| Cyan Coupler (ExC) | 0.34 |
| Color Image Stabilizer (Cpd-6) | 0.17 |

-continued

| | |
|---|---|
| Color Image Stabilizer (Cpd-7) | 0.34 |
| Color Image Stabilizer (Cpd-9) | 0.04 |
| Solvent (Solv-4) | 0.37 |
| 6th Layer (Ultraviolet Absorptive Layer) | |
| Gelatin | 0.53 |
| Ultraviolet absorbent (UV-1) | 0.16 |
| Color Mixing Inhibitor (Cpd-5) | 0.02 |
| Solvent (Solv-5) | 0.08 |

-continued

| | |
|---|---|
| 7th Layer (Protective Layer) | |
| Gelatin | 1.33 |
| Acryl-modified copolymer of polyvinyl alcohol (modified degree 17%) | 0.17 |
| Fluid Paraffin | 0.03 |

The compounds used for the above layer were as follows.

(ExY) Yellow Coupler:

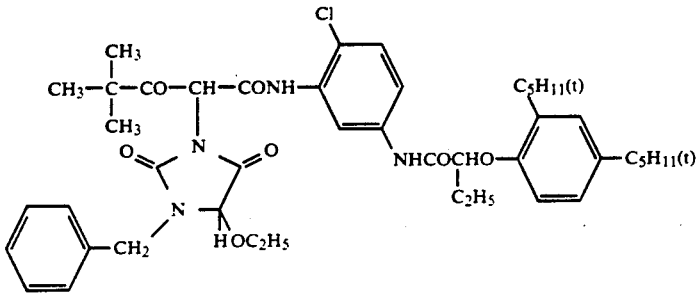

(ExC) Cyan Coupler

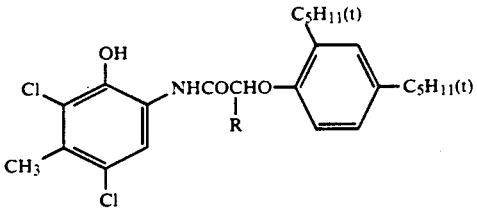

R = H, $C_2H_5$ and $C_4H_9$
1:3:6 mixture (weight ratio)

(Cpd-1) Color Image Stabilizer

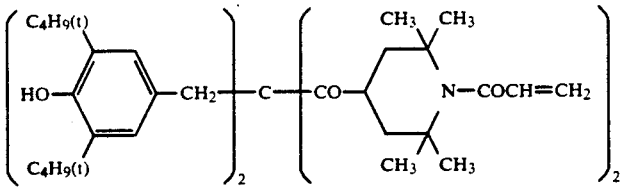

(Cpd-3) Color Image Stabilizer

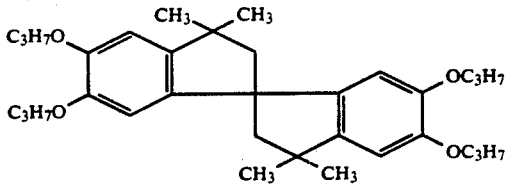

(Cpd-4) Color Image Stabilizer

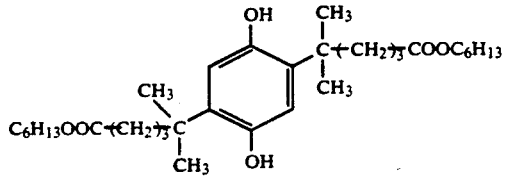

(Cpd-5) Fading Inhibitor

-continued
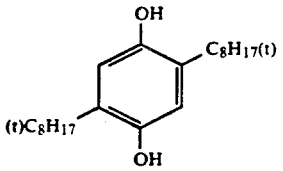
(Cpd-6) Color Image Stabilizer
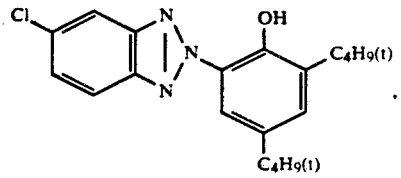
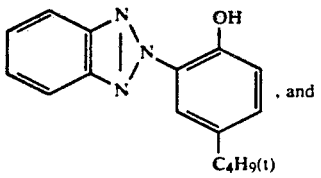
, and
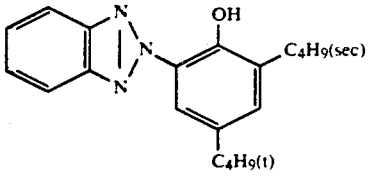
2:4:4 mixture (weight ratio)
(Cpd-7) Color Image Stabilizer
$$\left(CH_2-\underset{\substack{|\\ CONHC_4H_9(t)}}{CH}\right)_n$$
(average molecular weight: 60,000)
(Cpd-9)
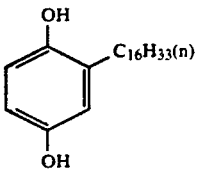
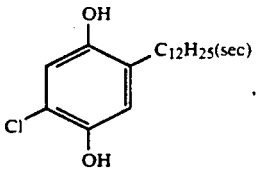
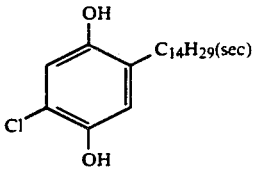
1:1:1 mixture (weight ratio)
(UV-1) Ultraviolet Absorbent
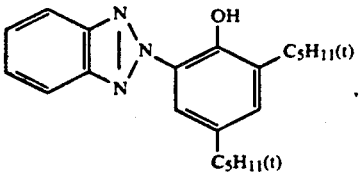
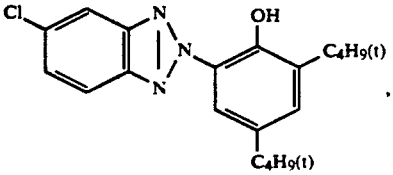
, and -continued

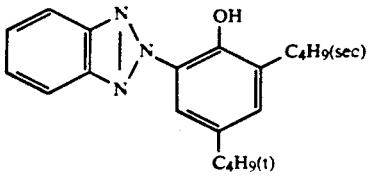

4:2:4 mixture (weight ratio)

(Solv-1) Solvent

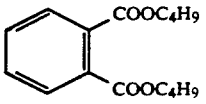

(Solv-2) Solvent

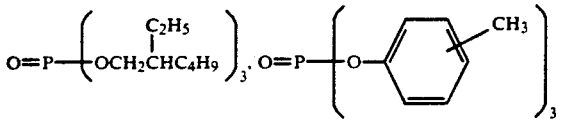

3:7 mixture (volume ratio)

(Solv-3) Solvent
$O{=}P{+}O{-}C_9H_{19}{-}(iso))_3$ (Solv-4) Solvent

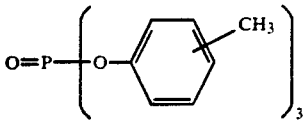

(Solv-5) Solvent
$COOC_8H_{17}$
|
$(CH_2)_8$
|
$COOC_8H_{17}$ (Solv-6) Solvent

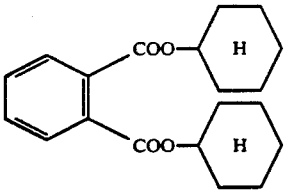

The color photographic material described above was light-exposed through an optical wedge and processed by the following process.

| Processing Step | Temperature (°C.) | Time |
|---|---|---|
| Color Development | 35 | 45 sec. |
| Blix | 35 | 45 sec. |
| Wash (1) | 35 | 30 sec. |
| Wash (2) | 35 | 30 sec. |
| Wash (3) | 35 | 30 sec. |
| Drying | 75 | 60 sec. |

The processing solutions used in the aforesaid process were as follows.

| | |
|---|---|
| Color Developer | |
| Water | 800 ml |
| Ethylenediamine N,N,N',N'-tetramethylenephosphonic Acid | 3.0 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Bis(carboxymethyl)hydrazine | 5.0 g |
| Optical Whitening agent (WHITEX 4B, trade name made by Sumitomo Chemical Co., Ltd.) | 1.0 g |
| Water to make | 1000 ml |
| pH (25° C.) | 10.05 |
| Blix Solution | |
| Water | 700 ml |
| Ammonium Thiosulfate (700 g/l) | 100 ml |
| Ammonium Sulfite | 18 g |
| Ethylenediaminetetraacetic Acid Ferric di-Hydrate | 55 g |
| Ethylenediaminetetraacetic Acid Di-sodium Salt | 3 g |
| Ammonium Bromide | 40 g |

-continued

| | |
|---|---|
| Glacial Acetic Acid | 8 g |
| Water to make | 1000 ml |
| pH (25° C.) | 5.5 |

Wash Water

City water treated by ion exchange resins to 3 ppm or less in the content of each of calcium and magnesium (the electric conductivity thereof at 25° C. was 5 μs/cm.).

Thus, Sample A was prepared. By following the same procedure as the case of preparing Sample A except that the combination of the magenta coupler and the color image stabilizers (color stain inhibitor) in the 3rd Layer was changed as shown in Table 1 below, other samples were prepared (the magenta coupler was replaced with a same molar amount of each coupler and the inhibitor was added at mol % to the coupler).

The density of each sample thus processed was measured of a self-recording densitometer. The maximum density of each sample is shown in Table 1.

Then, after measuring the magenta reflection density (stain) at the non-image portion of each sample processed, each sample was allowed to stand for 3 days at 80° C. and 70% R.H. or for 6 days at the same condition, and the magenta reflection density (stain) at the non-image portion was measured again. From these results, the increased stain density was obtained and they are shown in Table 1.

TABLE 1

| Sample | Magenta Coupler | Color Stain Inhibitor | Amount (mol % to Coupler) | Maximum Density | Increased Magenta Density 3 days | Increased Magenta Density 6 days | Note |
|---|---|---|---|---|---|---|---|
| A | Comparison Coupler (a) | — | — | 2.72 | 0.07 | 0.15 | Comparison |
| A1 | Comparison Coupler (a) | A-3 | 100 | 1.20 | 0.03 | 0.07 | " |
| A2 | Comparison Coupler (a) | A-28 | " | 1.08 | 0.03 | 0.08 | " |
| A3 | Comparison Coupler (a) | A-42 | " | 1.38 | 0.04 | 0.10 | " |
| A4 | Comparison Coupler (a) | A-59 | " | 1.46 | 0.03 | 0.09 | " |
| A5 | Comparison Coupler (a) | Comparison Compound (a) | " | 1.88 | 0.06 | 0.14 | " |
| A6 | Comparison Coupler (a) | Comparison Compound (b) | " | 2.02 | 0.06 | 0.13 | " |
| A7 | Comparison Coupler (b) | — | — | 2.81 | 0.09 | 0.20 | " |
| A8 | Comparison Coupler (b) | A-4 | 100 | 1.06 | 0.03 | 0.12 | " |
| A9 | Comparison Coupler (b) | A-43 | " | 1.18 | 0.05 | 0.14 | " |
| A10 | Comparison Coupler (c) | — | — | 2.79 | 0.12 | 0.25 | " |
| A11 | Comparison Coupler (c) | A-1 | 100 | 1.21 | 0.03 | 0.07 | Comparison |
| A12 | Comparison Coupler (c) | A-34 | " | 1.14 | 0.04 | 0.08 | " |
| A13 | Comparison Coupler (c) | A-54 | " | 1.32 | 0.04 | 0.10 | " |
| A14 | Comparison Coupler (c) | A-58 | " | 1.44 | 0.04 | 0.09 | " |
| A15 | Comparison Coupler (c) | Comparison Compund (b) | " | 1.82 | 0.06 | 0.14 | " |
| A-16 | Comparison Coupler (d) | — | — | 2.58 | 0.16 | 0.30 | " |
| A-17 | Comparison Coupler (d) | A-18 | 100 | 1.25 | 0.04 | 0.11 | " |
| A-18 | Comparison Coupler (d) | A-40 | " | 1.12 | 0.05 | 0.12 | " |
| A19 | Comparison Coupler (d) | A-41 | " | 1.42 | 0.06 | 0.14 | " |
| A-20 | Comparison Coupler (d) | A-63 | " | 1.78 | 0.03 | 0.09 | " |
| A-21 | M-2 (Invention) | — | — | 2.75 | 0.15 | 0.26 | " |
| A22 | M-2 (Invention) | Comparison Compound (a) | 100 | 1.82 | 0.14 | 0.23 | " |
| A23 | M-2 (Invention) | Comparison Compound (b) | 100 | 1.78 | 0.13 | 0.22 | Comparison |
| A24 | M-2 (Invention) | A-3 | " | 2.72 | 0.02 | 0.04 | Invention |
| A25 | M-2 (Invention) | A-28 | " | 2.70 | 0.01 | 0.02 | " |
| A-26 | M-2 (Invention) | A-42 | 100 | 2.73 | 0.02 | 0.03 | Invention |
| A27 | M-2 (Invention) | A-59 | " | 2.71 | 0.02 | 0.03 | " |
| A28 | M-3 (Invention) | — | — | 2.76 | 0.14 | 0.24 | Comparison |
| A29 | M-3 | A-4 | 100 | 2.70 | 0.01 | 0.02 | Invention |

TABLE 1-continued

| Sample | Magenta Coupler | Color Stain Inhibitor | Amount (mol % to Coupler) | Maximum Density | Increased Magenta Density 3 days | 6 days | Note |
|---|---|---|---|---|---|---|---|
| | (Invention) | | | | | | |
| A30 | M-3 (Invention) | A-43 | " | 2.72 | 0.02 | 0.04 | " |
| A31 | M-3 (Invention) | A-58 | " | 2.69 | 0.02 | 0.03 | " |
| A32 | M-12 (Invention) | — | — | 2.72 | 0.15 | 0.27 | Comparison |
| A33 | M-12 (Invention) | Comparison Compound (a) | 100 | 1.79 | 0.12 | 0.20 | " |
| A34 | M-12 (Invention) | A-1 | 100 | 2.73 | 0.02 | 0.03 | Invention |
| A35 | M-12 (Invention) | A-34 | " | 2.70 | 0.03 | 0.04 | " |
| A36 | M-12 (Invention) | A-40 | " | 2.68 | 0.02 | 0.04 | " |
| A37 | M-12 (Invention) | A-63 | " | 2.72 | 0.03 | 0.04 | " |

As is clear from the results shown in Table 1, it can be seen that the samples of this invention using the combination of the coupler having the releasable group shown by formula (I) and the compound shown by formula (II) show the specifically high density and are excellent in the magenta color stain inhibiting effect. The compound of formula (II) for use in this invention also has a color stain inhibiting effect for conventional 5-pyrazolone type magenta couplers but in the combinations of the compound and conventional couplers, the maximum density is too low to use for practical purpose and hence the aforesaid specific effect of this invention can never been anticipated by such combinations.

The comparison couplers and comparison compounds shown in Table 1 are as follows.

Comparison Coupler (a):

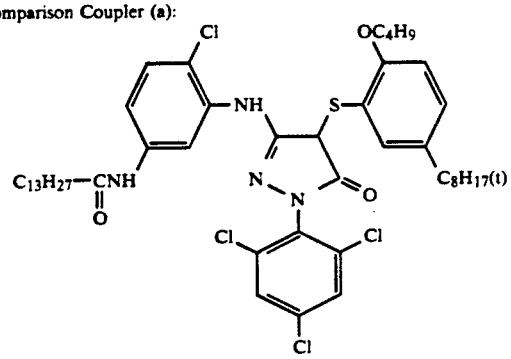

The coupler is described in European Patent (unexamined published) Applications 255,722, 258,662, and 230,048 and U.S. Pat. No. 4,483,919.

Comparison Coupler (b):

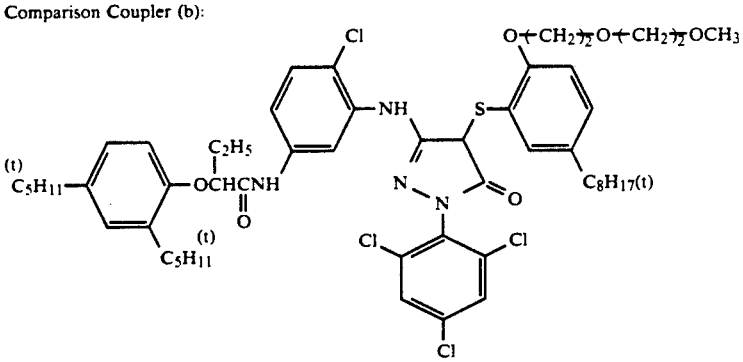

The coupler is described in European Patent (unexamined published) Applications 255,722 and 258,662.

Comparison Coupler (c):

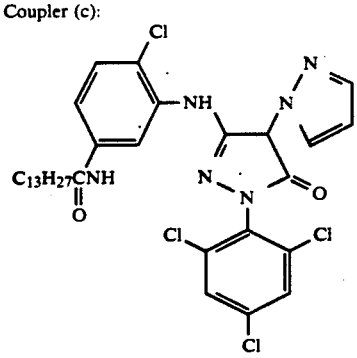

The coupler is described in U.S. Pat. Nos. 4,555,479 and JP-A-58-102231.

Comparison Coupler (d):

-continued

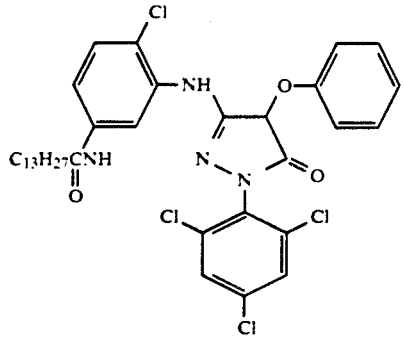

The same coupler being described in the same patent as the above Comparison Coupler (c).

Comparison Compound (a):

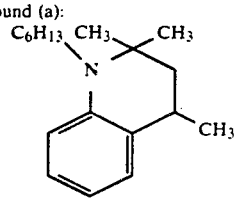

The compound is described in U.S. Pat. No. 4,483,919.

Comparison Compound (b):

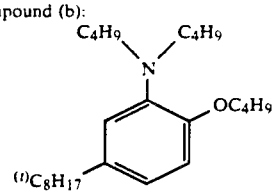

The compound is described in U.S. Pat. No. 4,483,919.

EXAMPLE 2

A multilayer color photographic paper having the layers shown below on a paper support, both surfaces of which were coated with polyethylene, was prepared. The coating composition for each layer was prepared as follows.

Preparation of Coating Compositions

In a mixture of 27.2 ml of acetaic acid , 4.1 g of Solvent (Solv-3) and 4.1 g of Solvent (Solv-6) were dissolved 19.1 g of Yellow Coupler (ExY), 4.4 g of Color Image Stabilizer (Cpd-1) and 1.8 g of color Image Stabilizer (Cpd-7) and the solution was dispersed by emulsification in 185 ml of an aqueous 10% gelatin solution containing 8 ml of an aqueous solution of 10% sodium dodecylbenzenesulfonate.

On the other hand, a silver chlorobromide emulsion (mixture of cubic grains containing 80.0 mol % silver bromide and having a mean grain size of 0.85 μm and a coefficient of variation of 0.08 and cubic grains containing 80.0 mol % silver bromide, and having a mean grain size of 0.62 μm and a coefficient of variation of 0.07 at 1:3 as mol ratio of Ag) was sulfur-sensitized and the blue sensitive sensitizing dye shown below was added to the emulsion in an amount of $5.0\times10-4$ mol per mol of silver.

The aforesaid emulsified dispersion was mixed with the silver chlorobromide emulsion and the composition was adjusted as shown below to provide the coating composition for the 1st layer.

The coating compositions for the 2nd layer to 7th layer were also prepared in a similar manner to the case of preparing the coating composition for the 1st layer.

For each layer, 1-oxy-3,5-dichloro-s-triazine sodium salt was used as a gelatin hardening agent.

Also, the spectral sensitizing dyes used for the layers were as follows.

Blue-Sensitive Emulsion Layer:

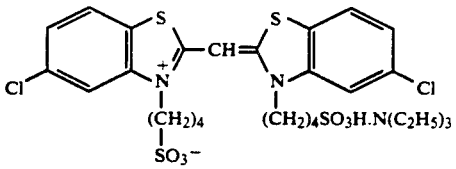

($5.0 \times 10^{-4}$ mol per mol of silver halide).

Green-Sensitive Emulsion Layer:

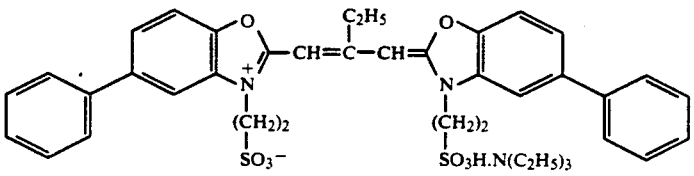

($4.0 \times 10^{-4}$ mol per mol of silver halide)

and

-continued

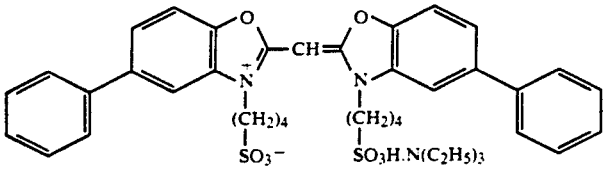

(7.0 × $10^{-5}$ mol per mol of silver halide).

Red-Sensitive Emulsion Layer:

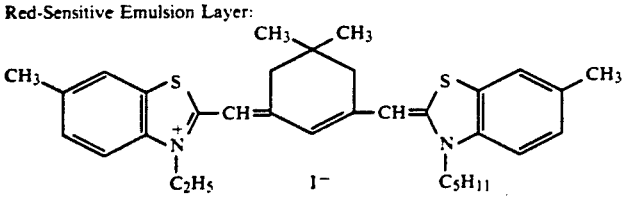

(0.9 × $10^{-4}$ mol per mol of silver halide).

To the red-sensitive emulsion layer was added the following compound in an amount of $2.6\times10^{-3}$ mol per mol of silver halide.

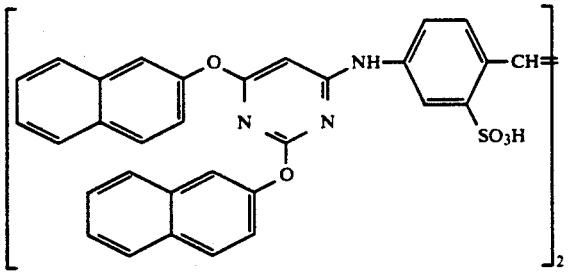

Also, to the blue-sensitive emulsion layer, the green-sensitive emulsion layer, and the red-sensitive emulsion layer were added 1-(5-methylureidophenyl)-5-mercaptotetrazole in an amount of $4.0\times10^{-6}$ mol, $3.0\times10^{-5}$ mol, and $1.0\times10^{-5}$ mol, respectively, per mol of silver halide and 2-methyl-5-t-octylhydroquinone in an amount of $8\times10^{-3}$ mol, $2\times10^{-2}$ mol, and $2\times10^{-2}$ mol, respectively, per mol of silver halide.

Also, to the blue-sensitive emulsion layer and the green-sensitive emulsion layer was added 4-hydroxy-6-methyl-1,3,3a,7-tetraazaindene in an amount of $1.2\times10^{-2}$ mol and $1.1\times10^{-2}$ mol, respectively, per mol of silver halide.

Furthermore, the following dyes were added to each emulsion layer for irradiation prevention.

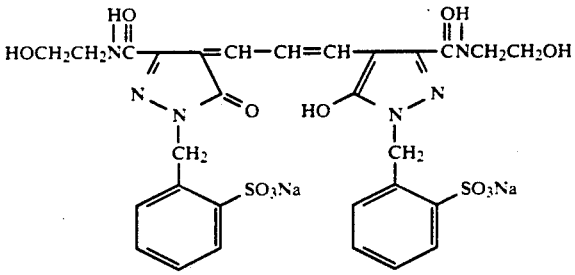

and

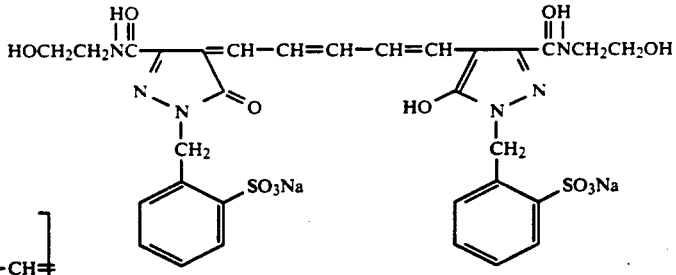

Layer Structure

The composition of each layer is shown below, in which the numeral is a coating amount (g/m²) and the amount for a silver halide emulsion is the amount calculated as silver.

Support

Polyethylene-coated paper (the polyethylene layer at the emulsion side contained a white pigment ($TiO_2$) and a bluish dye (ultramarine blue)).

1st Layer (Blue-Sensitive Emulsion Layer)

-continued

| | |
|---|---|
| Aforesaid Silver Chlorobromide Emulsion (AgBr: 80 mol %) | 0.26 |
| Gelatin | 1.83 |
| Yellow Coupler (ExY) | 0.83 |
| Color Image Stabilizer (Cpd-1) | 0.19 |
| Color Image Stabilizer (Cpd-7) | 0.08 |
| Solvent (Solv-3) | 0.18 |
| Solvent (Solv-6) | 0.18 |
| 2nd Layer (Color Mixing Inhibition Layer) | |
| Gelatin | 0.99 |
| Color Mixing Inhibitor (Cpd-6) | 0.08 |
| Solvent (Solv-1) | 0.16 |
| Solvent (Solv-4) | 0.08 |
| 3rd Layer (Green-Sensitive Emulsion Layer) | |
| Silver Chlorobromide Emulsion (mixture of cubic grains containing 90 mol % silver bromide and having mean grain size of 0.47μ and variation coefficient of 0.12 and cubic grains containing 90 mol % silver bromide and having mean grain size of 0.36 μm and variation coefficient of 0.09 at 1:1 as mol ratio of Ag) | 0.16 |
| Gelatin | 1.79 |
| Magenta Coupler (Comparison Coupler (g)) | 0.32 |
| Color Image Stabilizer (Cpd-3) | 0.20 |
| Color Image Stabilizer (Cpd-4) | 0.01 |
| Solvent (Solv-2) | 0.65 |
| 4th Layer (Ultraviolet Absorptive Layer) | |
| Gelatin | 1.58 |

-continued

| | |
|---|---|
| Ultraviolet Absorbent (UV-1) | 0.47 |
| Color Image Inhibitor (Cpd-5) | 0.05 |
| Solvent (Solv-5) | 0.24 |
| 5th Layer (Red-Sensitive Emulsion Layer) | |
| Silver Chlorobromide Emulsion (mixture of cubic grains containing 70 mol % silver bromide and having mean grain size of 0.49 μm and variation coefficient of 0.08 and cubic grains containing 70 mol % silver bromide and having mean grain size of 0.34 μm and variation coefficient of 0.10 at 1:2 as mol ratio of Ag) | 0.23 |
| Gelatin | 1.34 |
| Cyan Coupler (ExC) | 0.30 |
| Color Image Stabilizer (Cpd-6) | 0.17 |
| Color Image Stabilizer (Cpd-7) | 0.40 |
| Solvent (Solv-6) | 0.20 |
| 6th Layer (Ultraviolet Absorptive Layer) | |
| Gelatin | 0.53 |
| Ultraviolet absorbent (UV-1) | 0.16 |
| Color Mixing Inhibitor (Cpd-5) | 0.02 |
| Solvent (Solv-5) | 0.08 |
| 7th Layer (Protective Layer) | |
| Gelatin | 1.33 |
| Acryl-modified copolymer of polyvinyl alcohol (modified degree 17%) | 0.17 |
| Fluid Paraffin | 0.03 |

The compounds used for the aforesaid layers were as follows.

(Cpd-1) Color Image Stabilizer

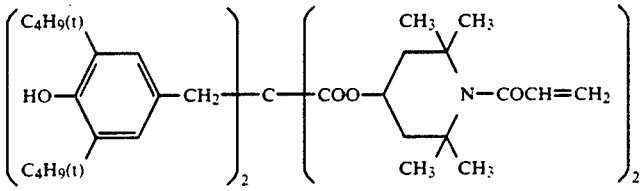

(Cpd-3) Color Image Stabilizer

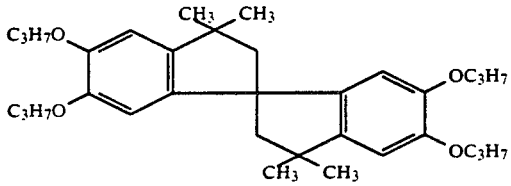

(Cpd-4) Color Image Stabilizer

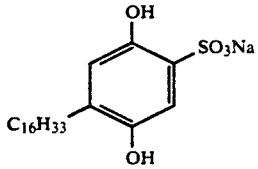

(Cpd-5) Fading Inhibitor

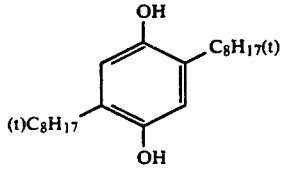

(Cpd-6) Color Image Stabilizer

-continued
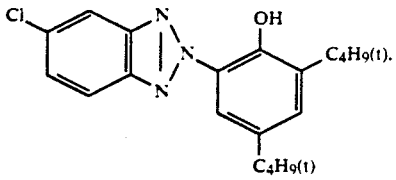
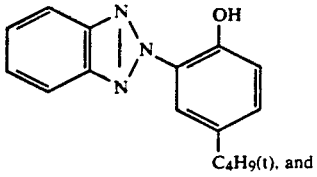
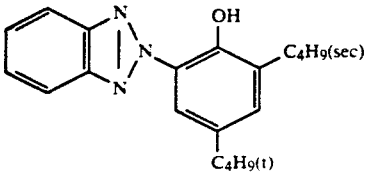
2:4:4 mixture (weight ratio)
(Cpd-7) Color Image Stabilizer
$$\left(CH_2-\underset{\substack{|\\ CONHC_4H_9(t)}}{CH}\right)_n$$
(average molecular weight: 80.000)
(Cpd-9)
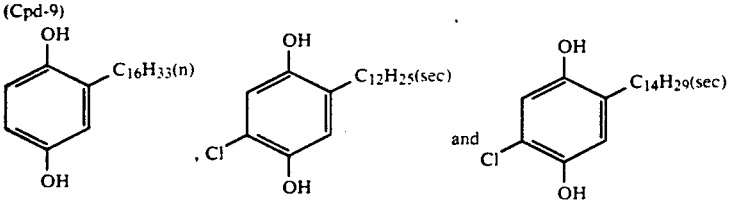
1:1:1 mixture (weight ratio)
(UV-1) Ultraviolet Absorbent
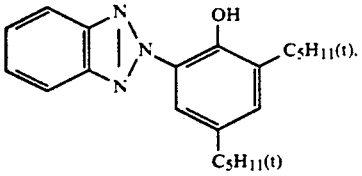
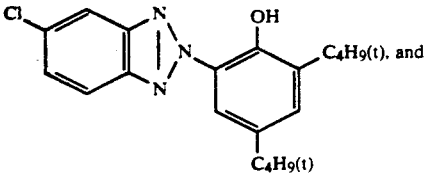
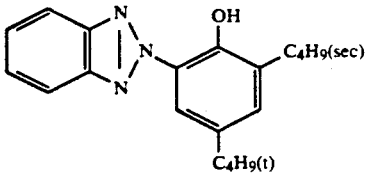
4:2:4 mixture (weight ratio)
(Solv-1) Solvent -continued

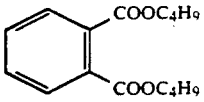

(Solv-2) Solvent

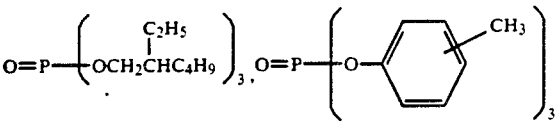

2:1 mixture (Solv-3) Solvent
$O{=}P{+}O{-}C_9H_{19}{-}(iso))_3$ (Solv-4) Solvent

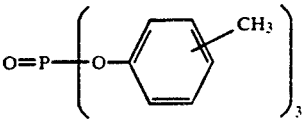

(Solv-5) Solvent
$(COOC_8H_{17})_2(CH_2)_8$ (Solv-6) Solvent
$C_8H_{17}CHCH(CH_2)_7COOC_8H_{17}$
O (ExY) Yellow Coupler:

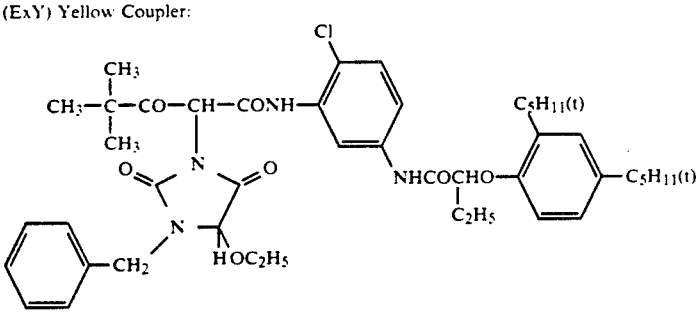

(ExC) Cyan Coupler

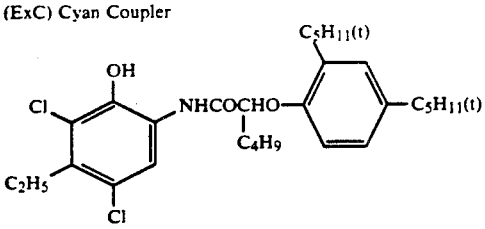

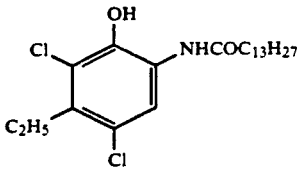

1:1 mixture (mol ratio)

The color photographic material was light-exposed through an optical wedge and processed by the following process.

| Processing Step | Temperature (°C.) | Time |
|---|---|---|
| Color Development | 37 | 3 min. 30 sec. |
| Blix | 33 | 1 min. 30 sec. |

-continued

| Processing Step | Temperature (°C.) | Time |
|---|---|---|
| Wash | 24 to 34 | 3 min. |
| Drying | 70 to 80 | 1 min. |

The compositions of the processing solutions used for the above process were as follows.

| Color Developer | |
|---|---|
| Water | 800 ml |
| Diethylenetriaminepentaacetic Acid | 1.0 g |
| Nitrilotriacidic Acid | 2.0 g |
| 1-Hydroxyethylidene-1,1-diphosphonic Acid (60% solution) | 1.0 ml |
| Benzyl Alcohol | 15 ml |
| Diethylene Glycol | 10 ml |
| Sodium Sulfite | 2.0 g |
| Potassium Bromide | 1.0 g |
| Potassium Carbonate | 30 g |
| N-Ethyl-N-(β-methanesulfonamido-ethyl)-3-methyl-4-aminoaniline Sulfate | 4.5 g |
| Hydroxylamine Sulfate | 3.0 g |
| Optical Whitening Agent (Whitex 4, trade name, made by Sumitomo Chemical Company, Limited) | 1.0 g |

-continued

| | |
|---|---|
| Water to make | 1000 ml |
| pH (25° C.) | 10.25 |
| Blix Solution | |
| Water | 400 ml |
| Ammonium Thiosulfate (70%) | 150 ml |
| Sodium Sulfite | 18 g |
| Ethylenediaminetetraacetic Acid Iron(III) Ammonium | 55 g |
| Ethylenediaminetetraacetic Acid Di-sodium | 5 g |
| Water to make | 1000 ml |
| pH (25° C.) | 6.70 |

Thus, Sample B was obtained. Also, by following the same procedure as the case of preparing Sample B except that the combination of the magenta coupler and the color stain inhibitor (color image stabilizers) in the 3rd layer was changed as shown in Table 2 below. (the coupler was replaced with an equimolar amount of the coupler and the addition amount of the inhibitor was the mol ratio to the coupler shown by %).

Then, the maximum density of each sample and the increase of the stain density of each sample, after allowing to stand each sample for 6 days at 80° C. and 70% RH were measured as in Example 1. The results obtained are shown in Table 2 below.

TABLE 2

| Sample | Magenta Coupler | Color Stain Inhibitor | Amount | Maximum Density | Increased Magenta Density | Note |
|---|---|---|---|---|---|---|
| B | Comparison Coupler (a) | — | — | 2.65 | 0.16 | Comparison |
| B1 | Comparison Coupler (a) | A-3 | 120 | 1.23 | 0.09 | " |
| B2 | Comparison Coupler (a) | A-28 | " | 1.10 | 0.10 | " |
| B3 | Comparison Coupler (a) | A-42 | " | 1.34 | 0.11 | " |
| B4 | Comparison Coupler (a) | A-59 | " | 1.41 | 0.10 | " |
| B5 | Comparison Coupler (e) | — | — | 2.68 | 0.29 | " |
| B6 | Comparison Coupler (e) | A-3 | 120 | 1.36 | 0.10 | " |
| B7 | Comparison Coupler (e) | A-28 | " | 1.29 | 0.09 | " |
| B8 | Comparison Coupler (e) | A-34 | " | 1.28 | 0.08 | " |
| B9 | Comparison Coupler (e) | A-42 | " | 1.40 | 0.09 | " |
| B10 | Comparison Coupler (e) | A-59 | " | 1.49 | 0.10 | " |
| B11 | Comparison Coupler (f) | — | — | 2.66 | 0.30 | " |
| B12 | Comparison Coupler (f) | A-1 | 120 | 1.12 | 0.10 | Comparison |
| B13 | Comparison Coupler (f) | A-43 | " | 1.32 | 0.09 | " |
| B14 | Comparison Coupler (f) | A-58 | " | 1.61 | 0.08 | " |
| B15 | M-1 (Invention) | — | — | 2.64 | 0.25 | " |
| B16 | M-1 (Invention) | A-1 | 120 | 2.58 | 0.03 | Invention |
| B17 | M-1 (Invention) | A-28 | " | 2.61 | 0.02 | " |
| B18 | M-1 (Invention) | A-42 | " | 2.59 | 0.03 | " |
| B19 | M-1 (Invention) | A-59 | " | 2.62 | 0.03 | " |
| B20 | M-2 (Invention) | — | — | 2.68 | 0.26 | Comparison |
| B21 | M-2 (Invention) | A-1 | 120 | 2.62 | 0.03 | Invention |
| B22 | M-2 (Invention) | A-4 | " | 2.60 | 0.03 | " |
| B23 | M-2 | A-19 | " | 2.61 | 0.02 | " |

TABLE 2-continued

| Sample | Magenta Coupler | Color Stain Inhibitor | Amount | Maximum Density | Increased Magenta Density | Note |
|---|---|---|---|---|---|---|
| | (Invention) | | | | | |
| B24 | M-2 (Invention) | A-31 | " | 2.58 | 0.03 | " |
| B25 | M-2 (Invention) | A-34 | 120 | 2.62 | 0.03 | Invention |
| B26 | M-2 (Invention) | A-43 | " | 2.60 | 0.02 | " |
| B27 | M-2 (Invention) | A-58 | " | 2.62 | 0.04 | " |
| B28 | M-2 (Invention) | A-63 | " | 2.63 | 0.04 | " |

The comparison couplers shown in Table 2 were as follows.

Comparison Coupler (e):

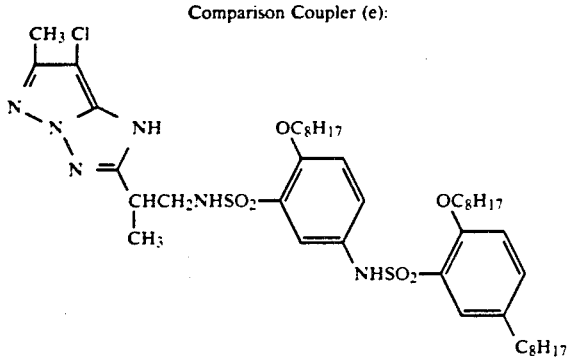

The couplers described in European Patent (unexamined published) Applications 255,722, 258.662, 230,048 and 228,655 and U.S. Pat. No. 4,704,350.

Comparison Coupler (f):

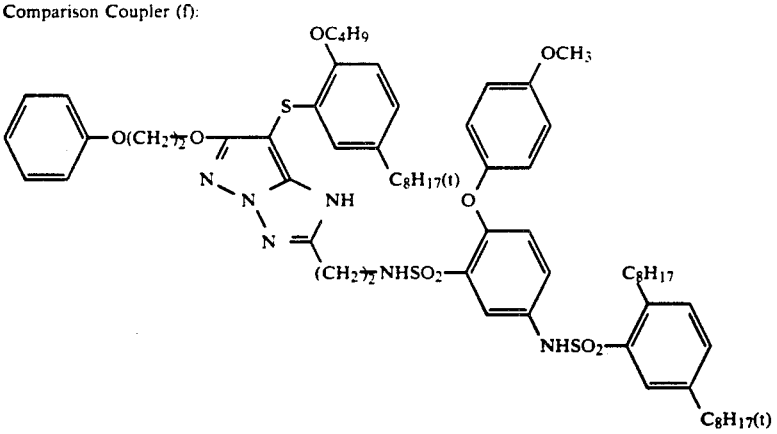

The coupler described in European Patent (unexamined published) Application 230,048.

Comparison Coupler (a) was same as the coupler in Example 1.

From the results shown in Table 2, it can be seen that the combinations of this invention, only, are excellent in the effect of inhibiting color stain without reducing the coloring density.

EXAMPLE 3

A multilayer color photographic paper having the following layers on a paper support, both surfaces of which were coated with polyethylene, was prepared.

The coating composition for each layer was prepared as follows.

Preparation of Coating Compositions

In a mixture of 150 ml of ethylene acetate, 1.0 ml of Solvent (Solv-3), and 3,0 ml of Solvent (Solv-4) were dissolved 60.0 g of Yellow Coupler (ExY) and 28.0 g of Fading Inhibitor (Cpd-1). The solution was added to 450 ml of an aqueous 10% gelatin solution containing sodium dodecylbenzenesulfonate followed by dispersion with ultrasonic homogenizer and the dispersion thus obtained was mixed with 420 g of a silver chlorobromide emulsion (silver bromide 0.7 mol %) containing the blue-sensitive sensitizing dye shown below to provide the coating composition for the 1st layer.

The coating compositions for the 2nd layer to the 7th layer were prepared in a similar manner to the case of preparing the coating composition for the 1st layer. For each layer, 1,2-bis(vinylsulfonyl)ethane was used as a gelatin hardening agent.

Also, each emulsion layer further contained the following spectral sensitizing dye.

Blue-Sensitive Emulsion Layer:

Anhydro-5,5'-dichloro-3,3'-disulfoethylthiacyanine hydroxide.

Green-Sensitive Emulsion Layer:

Anhydro-9-ethyl-5,5'-diphenyl-3,3'-disulfoethyloxacarbocyanine hydroxide

Red-Sensitive Emulsion Layer:

3,3'-Diethyl-5-methoxy-8,8'-(2,2'-dimethyl-1,3-propano)thiacarbocyanine iodide.

Also, for each emulsion layer, the following compounds were used as stabilizers.

A 7:2:1 (mol ratio) mixture of 1-(2-acetaminophenyl)-5-mercaptotetrazole, 1-phenyl-5-mercaptotetrazole, and 1-(p-methoxyphenyl)-5-mercaptotetrazole.

Furthermore, for each layer, the following compounds were used as irradiation inhibiting dyes.

[3-Carboxy-5-hydroxy-4-(3-(3-carboxy-5-oxo-1-(2,5-disulfonatophenyl)-2-pyrazoline-4-iridene)-1-propenyl)-1-pyrazolyl]benzene-2,5-disulfonate disodium salt, N,N'-(4,8-Dihydroxy-9,10-dioxo-3,7-disulfonatoanthracene-1,5-diyl)bis(aminomethanesulfonato) tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonate sodium salt.

Layer Structure

The composition of each layer is shown below, wherein the numeral shows a coating amount (g/m$^2$) and the amount for silver halide emulsion is the amount calculated as silver.

Support

Paper support both the surfaces of which are coated with polyethylene.

| | |
|---|---|
| 1st Layer (Blue-Sensitive Emulsion Layer) | |
| Aforesaid Silver Chlorobromide Emulsion (cubic grains containing 0.7 mol % silver bromide and having mean grain size of 0.9 μm) | 0.29 |
| Gelatin | 1.80 |
| Yellow Coupler (ExY) | 0.60 |
| Fading Inhibitor (Cpd-1) | 0.28 |
| Solvent (Solv-3) | 0.01 |
| Solvent (Solv-4) | 0.03 |
| 2nd Layer (Color Mixing Inhibiting Layer) | |
| Gelatin | 0.80 |
| Color Mixing Inhibitor (Cpd-2) | 0.055 |
| Solvent (Solv-1) | 0.03 |
| Solvent (Solv-2) | 0.015 |
| 3rd Layer (Green-Sensitive Emulsion Layer) | |
| Silver Chlorobromide Emulsion (cubic grains containing 0.7 mol % silver bromide and having mean grain size of 0.45 μm) | 0.305 |
| Gelatin | 1.40 |
| Magenta Coupler (M-2) | 0.67 |
| Fading Inhibitor (Cpd-3) | 0.23 |
| Fading Inhibitor (Cpd-4) | 0.11 |
| Solvent (Solv-1) | 0.20 |
| Solvent (Solv-2) | 0.02 |
| 4th Layer (Color Mixing Inhibiting Layer) | |
| Gelatin | 1.70 |
| Color Mixing Inhibitor (Cpd-2) | 0.065 |
| Ultraviolet Absorbent (UV-1) | 0.45 |
| Ultraviolet Absorbent (UV-2) | 0.23 |
| Solvent (Solv-1) | 0.05 |
| Solvent (Solv-2) | 0.05 |
| 5th Layer (Red-Sensitive Emulsion Layer) | |
| Silver Chlorobromide Emulsion (cubic grains containing 4 mol % silver bromide and having mean grain size of 0.5 μm) | 0.21 |
| Gelatin | 1.80 |
| Cyan Coupler (ExC-1) | 0.26 |
| Cyan Coupler (ExC-2) | 0.12 |
| Fading Inhibitor (Cpd-1) | 0.20 |
| Color Developing Accelerator (Cpd-5) | 0.15 |
| Solvent (Solv-1) | 0.16 |
| Solvent (Solv-2) | 0.09 |
| 6th Layer (Ultraviolet Absorptive Layer) | |
| Gelatin | 0.70 |
| Ultraviolet Absorbent (UV-1) | 0.26 |
| Ultraviolet Absorbent (UV-2) | 0.07 |

-continued

| | |
|---|---|
| Solvent (Solv-1) | 0.30 |
| Solvent (Solv-2) | 0.09 |
| 7th Layer (Protective Layer) | |
| Gelatin | 1.07 |

The Compounds use for the layers were as follows.

(ExY) Yellow Coupler:

α-Pivalyl-α-(3-benzyl-1-hydantoinyl)-2-chloro-5-[8-(dodecylsulfonyl)butylamido]acetanilide.

(ExC-1) Cyan Coupler:

2-Pentafluorobenzamido-4-chloro-5-[2-(2,4-ditertamylphenoxy)-3-methylbutylamidophenol.

(ExC 2) Cyan Coupler:

2,4-Dichloro-3-methyl-6 [α-(2,4-di-tert-amylphenoxy)-butylamido]phenol.

(Cpd 1) Fading Inhibitor:

2,5-Di-tert-amylphenyl-3,5-di-tert-butylhydroxybenzoate.

(Cpd-2) Color Mixing Inhibitor:

2,5-Di-tert-octylhydroquinone (Cpd-3) Fading Inhibitor:

1,4-Di-tert-amyl-2,5-dioctyloxybenzene.

(Cpd-4) Fading Inhibitor:

2,2'-Methylenebis(4 methyl-6-tert-butylphenol).

(Cpd-5)

p-(p-Toluenesulfonamido)-phenyldodecane.

(Solv-3) Solvent:

Di-i-nonyl Phthalate.

(Solv-4) Solvent:

N,N-Diethylcarbonamido-methoxy-2,4-di-t-amylbenzene.

(UV-1) Ultraviolet Absorbent:

2-(2-Hydroxy-3,5-di-tert-amylphenyl)benzotriazole.

(UV-1) Ultraviolet Absorbent:

2-(2-Hydroxy-3,5-di-tert-butylphenyl)benzotriazole (Solv-1) Solvent:

Di-(2-ethylhexyl) Phthalate (Solv-2) Solvent:

Dibutylphthalate.

The aforesaid color photographic material was light-exposed through an optical wedge and processed by the following process.

| Processing Step | Temperature (°C.) | Time |
|---|---|---|
| Color Development | 35 | 45 sec. |
| Blix | 30 to 36 | 45 sec. |
| Stabilization (1) | 30 to 37 | 20 sec. |
| Stabilization (2) | 30 to 37 | 20 sec. |
| Stabilization (3) | 30 to 37 | 20 sec. |
| Stabilization (4) | 30 to 37 | 30 sec. |
| Drying | 70 to 85 | 60 sec. |

(Stabilization was performed by a 4 tank countercurrent system of from stabilization (4) to stabilization (1)).

The composition of each processing solution was as follows.

| | |
|---|---|
| Color Development | |
| Water | 800 ml |
| Ethylenediaminetetraacetic Acid | 2.0 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |

-continued

| | |
|---|---|
| 5,6-Dihydroxybenzene-1,2,4-trisulfonic Acid | 0.3 g |
| Optical Whitening Agent (4,4'-diaminostilbene series) | 2.0 g |
| Water to make | 1000 ml |
| pH (25° C.) | 10.10 |
| Blix Solution | |
| Water | 400 ml |
| Ammonium Thiosulfate (70%) | 100 ml |
| Sodium Sulfite | 18 g |
| Ethylenediaminetetraacetic Acid Iron(III) Ammonium | 55 g |
| Ethylenediaminetetraacetic Acid Di-sodium | 3 g |
| Glacial Acetic Acid | 8 g |
| Water to make | 1000 ml |
| pH (25° C.) | 5.5 |
| Stabilization Solution | |
| Formalin (37%) | 0.1 g |
| Formalin-Sulfurous Acid Addition Product | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1000 ml |
| pH (25° C.) | 4.0 |

Thus, Sample C was obtained. Also, by following the same procedure as the case of obtaining Sample C except that Compound A-48 of this invention was added to the 3rd layer in an amount of 100 mole % based on the amount of the coupler in the layer, Sample $C_1$ was obtained.

Then, Sample D and Sample $D_1$ were also prepared in the following manner.

Preparation of Coating Compositions

In a mixture of 150 ml of ethyl acetate, 3.0 ml of Solvent (Solv-1), and 1.5 ml of Solvent (Solv-2) were dissolved 60.0 g of Yellow Coupler (ExY) and 28.0 g of Fading Inhibitor (Cpd-1). The solution was added to 450 ml of an aqueous 10% gelatin solution containing sodium dodecylbenzenesulfonate followed by dispersion with a homogenizer and the dispersion obtained was mixed with 420 g of a silver chlorobromide emulsion (silver bromide 90.0 mol %) containing the blue-sensitive sensitizing dye shown below to provide the coating composition for the 1st layer.

The coating compositions for the 2nd layer to 7th layer were also prepared by the similar manner to the case of preparing the coating composition for the 1st layer.

For each layer, 1,2-bis(vinylsulfonyl)ethane was used as a gelatin hardening agent.

Also, the spectral sensitizing dye shown below was used for each emulsion layer.

Blue-Sensitive Emulsion Layer:

Anhydro-5-methoxy-5'-methyl-3,3'-disulfopropylselenacyanine hydroxide

Green-Sensitive Emulsion Layer:

Anhydro-9-ethyl-5,5'-diphenyl-3,3'-disulfoethyloxacarbocyanine hydroxide

Red-Sensitive Emulsion Layer:

3,3'-Diethyl-5-methoxy-9,9'-(2,2'-dimethyl-1,3-propano)thiacarbocyanine iodide.

Also, for each emulsion layer, the following compound was used as a stabilizer.

1-Methyl-2-mercapto-5-acetylamino-1,3,4-triazole.

Furthermore, the following compounds were used as irradiation inhibiting dyes for each emulsion layer.

[3-Carboxy-5-hydroxy-4-(3-(3-carboxy-5-oxo-1-(2,5-disulfonatophenyl)-2-pyrazolin-4-iridene)-1-propenyl)-1-pyrazolyl]benzene-2,5-disulfonate Disodium Salt, and N,N'-(4,8-Dihydroxy-9,10-dioxo-3,7-disulfonatoanthracene-1,5-diyl)bis(aminomethanesulfonate) Tetrasodium Salt.

Layer Structure

The composition of each layer is shown below, wherein the numeral shows a coating amount (g/m²) and the amount for silver halide emulsion is shown by the amount calculated as silver.

Support

Paper support both the surfaces of which are coated with polyethylene.

| | |
|---|---|
| 1st Layer (Blue-Sensitive Emulsion Layer) | |
| Silver Halide Emulsion (Br 90%) | 0.29 |
| Gelatin | 1.80 |
| Yellow Coupler (ExY) | 0.60 |
| Fading Inhibitor (Cpd-1) | 0.28 |
| Solvent (Solv-1) | 0.03 |
| Solvent (Solv-2) | 0.015 |
| 2nd Layer (Color Mixing Inhibiting Layer) | |
| Gelatin | 0.80 |
| Color Mixing Inhibitor (Cpd-2) | 0.055 |
| Solvent (Solv-1) | 0.03 |
| Solvent (Solv-2) | 0.015 |
| 3rd Layer (Green-Sensitive Emulsion Layer) | |
| Silver Halide Emulsion (Br 74%) | 0.305 |
| Gelatin | 1.40 |
| Magenta coupler (M-1) | 0.67 |
| Color Mixing Inhibitor (Cpd-3) | 0.23 |
| Color Mixing Inhibitor (Cpd-4) | 0.11 |
| Solvent (Solv-1) | 0.20 |
| Solvent (Solv-2) | 0.02 |
| 4th Layer (Color Mixing Inhibiting Layer) | |
| Gelatin | 1.70 |
| Color Mixing Inhibitor (Cpd-2) | 0.065 |
| Ultraviolet Absorbent (UV-1) | 0.45 |
| Ultraviolet Absorbent (UV-2) | 0.23 |
| Solvent (Solv-1) | 0.05 |
| Solvent (Solv-2) | 0.05 |
| 5th Layer (Red-Sensitive Emulsion Layer) | |
| Silver Halide Emulsion (Br 74%) | 0.21 |
| Gelatin | 1.80 |
| Cyan Coupler (ExC-1) | 0.26 |
| Cyan Coupler (ExC-2) | 0.12 |
| Fading Inhibitor (Cpd-1) | 0.20 |
| Solvent (Solv-1) | 0.16 |
| Solvent (Solv-2) | 0.09 |
| 6th Layer (Ultraviolet Absorptive Layer) | |
| Gelatin | 0.70 |
| Ultraviolet absorbent (UV-1) | 0.26 |
| Ultraviolet Absorbent (UV-2) | 0.07 |
| Solvent (Solv-1) | 0.30 |
| Solvent (Solv-2) | 0.09 |
| 7th Layer (Protective Layer) | |
| Gelatin | 1.07 |

The Compounds used for the above layers were as follows.

(ExY) Yellow Coupler:

α-Pivalyl-α-(3-benzyl-1-hydantoinyl)-2-chloro-5-[γ-(2,4-di-tert-amylphenoxy)butylamido]acetanilide.

(ExC-1) Cyan Coupler:

2-Pentafluorobenzamido-4-chloro-5-[2-(2,4-di-tert-amylphenoxy)-3-methylbutylamidophenol.

(ExC-2) Cyan Coupler:

2,4-Dichloro-3-methyl-6-[α-(2,4-di-tert-amylphenoxy)-butylamido]phenol.

(Cpd-1) Fading Inhibitor:

2,5-Di-tert-amylphenyl-3,5-di-tert-butylhydroxybenzoate.

(Cpd-2) Color Mixing Inhibitor:

2,5-Di-tert-octylhydroquinone.

(Cpd-3) Fading Inhibitor:

1,4-Di-tert-amyl-2,5-dioctyloxybenzene.

(Cpd-4) Fading Inhibitor:

2,2'-Methylenebis(4-methyl-6-tert-butylphenol).

(UV-1) Ultraviolet Absorbent:

2-(2-Hydroxy-3,5-di-tert-amylphenyl)benzotriazole (UV-2) Ultraviolet Absorbent:

2-(2-Hydroxy-3,5-di-tert-butylphenyl)benzotriazole (Solv-1) Solvent:

Di(2-ethylhexyl)Phthalate.

(Solv-2) Solvent:

Dibutyl Phthalate.

The color photographic material thus obtained was light-exposed through an optical wedge and processed as in Example 1 to provide Sample D.

By following the same procedure as above except that Compound A-59 of this invention was added to the 3rd layer in an amount of 100% based on the magenta coupler, Sample $D_1$ was prepared.

The maximum density and the increase of color stain after allowing to stand for 6 days at 80° C. and 70% RH were measured on each sample by the same manner as in Example 2. The results showed that the samples using the compounds shown by formula (II) of this invention gave substantially no color stain without reducing the coloring density.

As described above, according to this invention, color photographs causing less color stain (in particular, magenta stain) after processing, while keeping a high coloring density can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing at least one silver halide emulsion layer and at least one kind of 5-pyrazolone couplers represented by following formula (I') and at least one kind of the amine-type compounds represented by following formula (II):

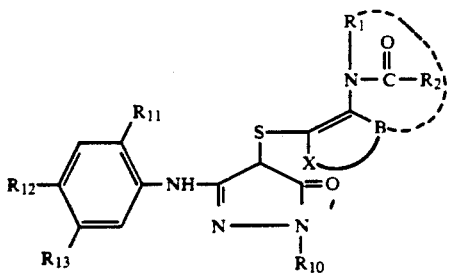

(I')

wherein $R_1$ represents a hydrogen atom, an alkyl group, an aryl group, or a heterocyclic group; $R_2$ is an alkyl group, an aryl group, an alkylamino group or an anilino group; $R_{10}$ represents a substituted or unsubstituted aryl group; $R_{11}$ represents an alkoxy group, an aryloxy group, or a halogen atom; $R_{12}$ and $R_{13}$ each represents a hydrogen atom, a halogen atom, an alkyl group, an alkoxy group, an acylamino group, a sulfonamide group, a sulfamoyl group, a sulfamido group, a carbamoyl group, a diacylamino group, an aryloxycarbonyl group, an alkoxycarbonyl group, an alkoxysulfonyl group, an aryloxysulfonyl group, an alkanesulfonyl group, an aryloxysulfonyl group, an alkanesulfonyl group, an arylsulfonyl group, an alkylthio group, an arylthio group, an alkoxycarbonylamino group, an alkyalureido group, an acyl group, a nitro group, or a carboxyl group; B represents a carbon atom, an oxygen atom, a nitrogen atom, or a sulfur atom; X represents an atomic group necessary for forming a ring; said $R_1$ and $R_2$ may combine with each other to form a ring; and when B is a carbon atom or a nitrogen atom, said B and $R_2$ may combine with each other to form a ring;

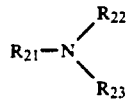

(II)

wherein $R_{21}$ represents a hydrogen atom, a hydroxy group, or a substituted or unsubstituted alkyl group, a substituted or unsubstituted alkenyl group, a substituted or unsubstituted alkoxy group, a substituted or unsubstituted acyl group, a substituted or unsubstituted aryloxy group, a substituted or unsubstituted heterocyclicoxy group or a substituted or unsubstituted acyloxy group and $R_{22}$ and $R_{23}$ each represents a substituted or unsubstituted alkyl group, a substituted or unsubstituted alkenyl group or a substituted or unsubstituted heterocyclic group; said $R_{21}$, $R_{22}$ and $R_{23}$ may form together a nitrogen-containing heterocyclic ring which is monocyclic or polycyclic and the sum of the carbon atom numbers of $R_{21}$, $R_{22}$, and $R_{23}$ is at least 10.

2. A silver halide color photographic material as claimed in claim 1, wherein a substituent for the substituted alkyl, alkenyl, aryl, heterocyclic group represented by $R_{21}$, $R_{22}$ and $R_{23}$ is a halogen atom, an alkyl group, an alkoxy group, an acylamino group, a sulfonamide group, a sulfamoyl group, a sulfamido group, a carbamoyl group, a diacylamino group, an aryloxycarbonyl group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, a carboxyl group, a hydroxy group, or a cyano group.

3. A silver halide color photographic material as claimed in claim 1, wherein the substituent for the substituted alkyl group represented by $R_{21}$, $R_{22}$ and $R_{23}$ is a halogen atom, an alkyl group, an alkoxy group, an acylamino group, a sulfonamide group, a sulfamoyl group, a sulfamido group, a diacylamino group, an aryloxycarbonyl group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, a hydroxy group or a cyano group.

4. A silver halide color photographic material as claimed in claim 1, wherein the sum of the carbon atoms of $R_{21}$, $R_{22}$ and $R_{23}$ is from 12 to 50.

5. A silver halide color photographic material as claimed in claim 1, wherein $R_{21}$, $R_{22}$ and $R_{23}$ each represents an alkyl group.

6. A silver halide color photographic material as claimed in claim 1, wherein said magenta coupler of formula (I') is incorporated in a silver halide emulsion layer in an amount of from $2\times10^{-3}$ to $5\times10^{-1}$ mols per mol of silver in the emulsion.

7. A silver halide color photographic material as claimed in claim 1, wherein said compound of formula (II) is used in an amount of from $1\times10^{-2}$ to 10 mols per mol of the magenta coupler.

8. A silver halide color photographic material as claimed in claim 1, wherein said compound of formula (II) is used in an amount of from $3\times10^{-2}$ to 5 mols per mol of the magenta coupler.

9. A silver halide color photographic material as claimed in claim 1, wherein $R_1$ of formula (I') represents a hydrogen atom.

10. A silver halide photographic material as claimed in claim 1, wherein $R_1$ represents a hydrogen atom or an alkyl group.

11. A silver halide photographic material as claimed in claim 1, wherein B represents a carbon atom or a nitrogen atom.

12. A silver halide photographic material as claimed in claim 11, wherein B represents a carbon atom.

13. A silver halide photographic material as claimed in claim 1, wherein X represents an atomic group composed of atoms selected from a carbon atom, an oxygen atom, a nitrogen atom and a sulfur atom necessary to form a saturated or unsaturated 5-membered, 6-membered or 7-membered ring.

14. A silver halide photographic material as claimed in claim 2, wherein the ring formed with $R_1$ and $R_2$ is a saturated or unsaturated 5-membered or 6-membered ring.

15. A silver halide photographic material as claimed in claim 1, wherein the ring formed with B and $R_2$ is a saturated or unsaturated 5-membered or 6-membered ring.

16. A silver halide color photographic material as claimed in claim 1, wherein said 5-pyrazolone coupler is represented by one of the following formulae (i), (ii), or (iii):

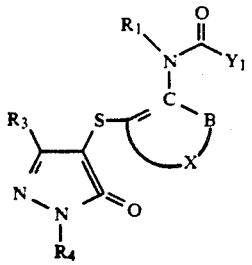

(i)

wherein $Y_1$ represents Ra; Ra represents a substituted or unsubstituted aryl group, or a secondary or tertiary group shown

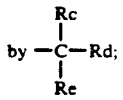

by —C(Rc)(Re)—Rd;

Rc and Rd each represent a halogen atom, a substituted or unsubstituted aryl group, a substituted or unsubstituted heterocyclic group, or $Z_2Rg$; Re represents a hydrogen atom or a group defined by Rc and Rd; $Z_2$ represents an oxygen atom, a sulfur atom, or NRh; Rg and Rh represent a hydrogen atom, a substituted or unsubstituted alkyl group, a substituted or unsubstituted aryl group, or a substituted or unsubstituted heterocyclic group; Rc may combine with at least one of Rd and Re to form one or two carbon rings or heterocyclic rings, which may further have a substituent; $R_1$, X and B are the same as recited in claim 21; $R_3$ represents a group of

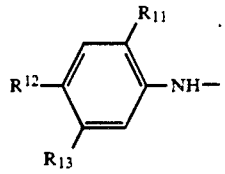

wherein $R_{11}$, $R_{12}$ and $R_{13}$ are as defined in claim 21; and $R_4$ represents a substituted or unsubstituted aryl group;

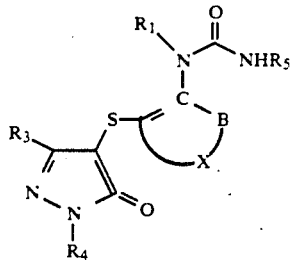

(ii)

wherein $R_5$ represents a substituted or unsubstituted alkyl group, or a substituted or unsubstituted aryl group; and $R_1$, $R_3$, $R_4$, X and B have the same values as defined for the 5-pyrazolone coupler of formula (i);

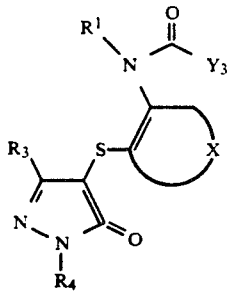

(iii)

wherein $R_1$, $R_3$, $R_4$, and X have the same values as defined above for the 5-pyrazolone coupler of formula (i), and $Y_3$ represents a substituted or unsubstituted methylene group, or a substituted or unsubstituted ethylene group.

17. A silver halide photographic material as claimed in claim 1, wherein $R_{21}$, $R_{22}$, and $R_{23}$ may be substituted by a hydroxy group, a cyano group, or an $R_{21}$ group, as defined above.

18. A silver halide photographic material as claimed in claim 1, wherein $R_2$, $R_{22}$, and $R_{23}$ combined to form a 5-membered or 6-membered ring, and provide a compound of the formula as follows:

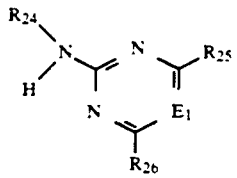

(V)

wherein $R_{24}$ has the same values as defined above for $R_{23}$; $R_{25}$ and $R_{26}$ each represents a hydrogen atom, a halogen atom, a hydroxy group, a cyanothio group, a nitro group, a cyano group or a substituted or unsubstituted alkyl, aryl, alkoxy, aryloxy, heterocyclicoxy, acylamino, alkylamino, arylamino, heterocyclic amino, ureido, sulfonamido, sulfamoylamino, N-imido, alkylthio, arylthio, heterocyclic thio, alkoxycarbonylamino, aryloxycarbonylamino, carbamoyl, sulfamoyl, sulfonyl, sulfinyl, acyl, alkoxycarbonyl, aryloxycarbonyl, phosphonyl, imino, acyloxy, or sulfonyloxy group; and $E_1$ represents a methine group, $—(R_{27})C=$ or $—N=$, $R_{27}$ has the same values as defined above for $R_{25}$ and $R_{26}$.

19. A silver halide photographic material as claimed in claim 1, wherein the sum of carbon atoms of $R_{21}$, $R_{22}$, and $R_{23}$ is from 12 to 15.

20. A silver halide photographic material as claimed in claim 1, wherein $R_{22}$ or $R_{23}$ is a heterocyclic ring, to provide a compound shown by the following formula:

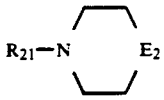

(VI)

wherein $R_{21}$ has the same values as defined in formula (II) and $E_2$ represents a simple bond, $—CH_2—$, $N—R_{28}$, —O—, or $—SO_n—$, $R_{28}$ has the same values as defined for $R_{21}$ and n represents an integer of from 0 to 2.

21. A silver halide photographic material as claimed in claim 1, wherein said silver halide emulsion layer comprises silver chlorobromide or silver chloride which does not contain substantially silver iodide.

22. A silver halide photographic material as claimed in claim 1, wherein said silver halide emulsion layer comprises high silver chloride content emulsion containing 90 mol % or more of silver chloride.

* * * * *